US006641182B2

(12) United States Patent
Schlack et al.

(10) Patent No.: US 6,641,182 B2
(45) Date of Patent: Nov. 4, 2003

(54) MULTI-POINT LATCH SYSTEM

(75) Inventors: Richard E. Schlack, Rising Sun, MD (US); Richard B. Langkamp, Jr., Hemlock, NY (US); D. Dale Turner, Honeoye Falls, NY (US); Stephen Keith Spatig, West Chester, PA (US); Paul Dulieu, Honeoye Falls, NY (US); Richard S. Perriello, Rochester, NY (US)

(73) Assignee: Southco, Inc., Concordville, PA (US)

( * ) Notice: Subject to any disclaimer, the term of this patent is extended or adjusted under 35 U.S.C. 154(b) by 70 days.

(21) Appl. No.: 09/759,939

(22) Filed: Jan. 12, 2001

(65) Prior Publication Data

US 2001/0026070 A1 Oct. 4, 2001

Related U.S. Application Data

(63) Continuation-in-part of application No. 09/657,933, filed on Sep. 8, 2000, now abandoned.

(60) Provisional application No. 60/152,913, filed on Sep. 8, 1999, and provisional application No. 60/207,378, filed on May 26, 2000.

(51) Int. Cl.[7] ..... E05C 9/10

(52) U.S. Cl. ..... 292/36; 292/336.3

(58) Field of Search ..... 292/36, 196, 113, 292/66, 5, 6, 336.3

(56) References Cited

U.S. PATENT DOCUMENTS

| | | | | |
|---|---|---|---|---|
| 2,662,790 A | * | 12/1953 | Hogg | 292/332 |
| 4,387,917 A | | 6/1983 | Cocker | 292/40 |
| 4,693,503 A | | 9/1987 | Bisbing | 292/210 |
| 4,714,283 A | | 12/1987 | Dignan | 292/48 |
| 4,740,021 A | * | 4/1988 | Hildebrand | 292/196 |
| 4,893,849 A | | 1/1990 | Schlack | 292/7 |
| 4,913,476 A | * | 4/1990 | Cook | 292/196 |
| 4,951,486 A | | 8/1990 | Braun et al. | 70/208 |
| 4,961,330 A | | 10/1990 | Evans | 292/21 |
| 5,129,694 A | | 7/1992 | Tanimoto et al. | 292/247 |
| 5,201,557 A | | 4/1993 | Schlack | 292/161 |
| 5,375,894 A | | 12/1994 | Schlack | 292/36 |
| 6,152,497 A | | 11/2000 | Vickers et al. | 292/34 |

FOREIGN PATENT DOCUMENTS

| | | |
|---|---|---|
| DE | 124143 | 9/1900 |
| DE | 512930 | 11/1930 |
| DE | 77 23 134 | 12/1977 |
| DE | 79 36 680 | 7/1980 |
| DE | 83 28 207.6 | 3/1985 |
| DE | 198 01 721 C1 | 4/1999 |
| DE | 198 01 719 A1 | 7/1999 |
| EP | 0 665 349 A1 | 8/1995 |
| WO | PCT/EP98/08033 | 7/1999 |

* cited by examiner

*Primary Examiner*—Gary Estremsky
(74) *Attorney, Agent, or Firm*—Paul & Paul

(57) ABSTRACT

A multipoint latch system for releasably securing a first panel member against an enclosure cabinet or frame, the latch system having a translatable rod member adapted to be carried on a door panel, a rod guide which is fixably mounted on the door panel, a panel block which is connected to the translatable rod member and a pawl member rotatably mounted to the panel block so that the arm translates with the rod member, there further being a camming mechanism which causes the pawl to move relative to the rod member as the pawl is translated with the rod. A keeper is provided for installation on a corresponding enclosure frame, and an actuator is provided to facilitate translation of the rod member to release the pawl from engagement with a keeper after.

27 Claims, 51 Drawing Sheets

EXPLODED ISOMERTIC

EXPLODED ISOMERTIC

SNAP PILLOW BLOCK INTO ROD

PLACE PAWL ONTO PILLOW BLOCK
AND INSERT CONNECTOR TO LINK

INSERT CONNECTOR TO LINK PIN

INSERT ROD GUIDE
INSERT INTO ROD GUIDE SHELL.

SLIDE ROD GUIDE SHELL/INSERT ASSEMBLY ONTO PAWL AND PIN.

INSERT M5 SHOULDER NUT THROUGH ROD GUIDE INSERT, ROD GUIDE SHELL, AND ROD THEN FLARE.

ASSEMBLED

ACTUATOR OPEN
ISOMETRIC

ACTUATOR CLOSED
ISOMETRIC

PARTIALLY CLOSED POSITION
ONE LATCH POINT

CLOSED POSITION
ONE LATCH POINT

OPEN POSITION
SINGLE LATCH POINT

STEP 1 : INSERT PAWL TO GUIDE PIN INTO PAWL

STEP 2 : SNAP PILLOW BLOCK INTO ROD

STEP 3 : PLACE PAWL ONTO PILLOW BLOCK AND INSERT CONNECTOR TO LINK PIN.

STEP 5 : INSERT M5 SHOULDER NUT THROUGH ROD GUIDE AND ROD THEN FLARE.

ASSEMBLED

ACTUATOR CLOSED ISOMETRIC

ACTUATOR OPEN ISOMETRIC

MULTI-POINT LATCH SYSTEM

CROSS REFERENCE TO RELATED APPLICATIONS

This continuation-in-part application claims the benefit of U.S. Utility application Ser. No. 09/657,933 filed on Sep. 8, 2000 now abandoned, which claims the benefit of U.S. Provisional Application No. 60/152,913 filed Sep. 8, 1999 and U.S. Provisional Application No. 60/207,378 filed May 26, 2000.

BACKGROUND OF THE INVENTION

1. Field of Invention

The present invention relates to a latch for securing a first panel member to a second panel member, and more particularly to a multi-point latch system for use on in-door telecommunication, computer, and industrial cabinets.

2. Brief Description of the Prior Art

The prior art in the general field of latches for storage cabinets of the type used for electronic equipment, storing supplies and industrial uses, is rather highly developed. For example, some types of prior art latching devices incorporate a slide fastener for fastening a hinged door panel and the like. In some latches a spring is incorporated to bias a latch bolt into a latched position about a keeper. Rotary handles may be provided so the latch bolt may be rotated away from the keeper in opposition of the spring, and into an unlatched position. However, the handle of such a latch, which extends beyond the body, may cause inadvertent latching and unlatching in response to impact forces.

U.S. Pat. No. 4,693,503, "Lever Latch" issued Sep. 15, 1987 to Robert H. Bisbing and assigned to Southco, Inc., comprises a flanged housing, a handle and a latch, which are inserted within an opening in a door. The handle and latch are positioned substantially flush with the outer door surface when the handle and latch are in the latched position. The handle is provided with an arm and a stop for engagement with an inner surface of a cabinet frame when the door is closed and latched. However, the arm and stop portions of the Lever Latch which extend inward from the handle may prevent use of the device in certain confined areas. In addition, the mounting of the Lever Latch on the inside of the outer seal of the cabinet may require that additional sealing may be applied to the latch.

A "Slide Fastener" is shown in U.S. Pat. No. 5,201,557 issued on Apr. 3, 1993 to Richard E. Schlack and assigned to Southco, Inc. The Slide Fastener secures a door of an electrical cabinet to the cabinet frame and releasably retains the door against the frame when the door and frame are latched together. The Slide Fastener includes a door assembly secured to the door and slide keepers attached to the frame. The door assembly further includes a lever assembly and a slide assembly. The lever assembly is rotatable between an open position and a closed position and engages and slides the slide assembly in response to rotation of the lever assembly. The slide assembly engages the slide keepers as the lever assembly is rotated.

A need exists for a latch assembly, which can be used to secure a panel to a corresponding enclosure frame and has improved latching and retaining properties.

SUMMARY OF THE INVENTION

A novel multipoint latch system for securing a door panel to a cabinet frame and releasably retaining the door panel against the frame is provided by the applicant. The multipoint latch system has a one-piece rod guide, or alternatively, a two-piece rod guide shell and rod guide insert, which is fixably mounted to a door panel surface to secure a rod member, which translates relative to said fixed rod guide. A connecting element is secured on the rod member and translates therewith. The connecting element carries a pawl, which is rotatably mounted to the connecting element and connected to the fixed rod guide to be cammed between open and closed positions when the rod is translated. An actuator for actuating the translation of the rod is provided, and a keeper member adapted to be mounted on an enclosure cabinet engages and secures the pawl.

Preferably, the keeper can be configured for facilitating the sliding of the pawl, such as, for example, by having a roller element mounted thereon against which a pawl arm will engage as the latch is being secured. Furthermore, the rod guide, or alternatively, the rod guide insert and rod guide shell, which is fixed to the door panel may include cam slots configured to facilitate maximizing the compression when the latch is fully latched to draw the pawl to a compressed position.

Alternatively, the rod guide shell retains an inserted rod guide insert. The insert has molded-in cam features. The rod guide shell also keeps the pin through the pawl in the cam profile. Preferably, the rod guide insert would be made of plastic while the rod guide shell would be metal, whereby this arrangement provides a better wear surface for the guide pin. Also, it creates less noise and gives the system a smoother operation due to the improved lubricity of the plastic component.

The assembly of the two-component rod guide is unique in that the insert is molded in the flat condition to allow for less expensive tooling and easier handling up to the assembly station. At the assembly station the insert is folded along two "living hinges" and fed into the shell.

It is the object of the present invention to provide a novel multipoint latch system, which can secure a panel member against corresponding enclosure frame.

It is another object of the present invention to secure the multipoint latch system components to a door panel and to secure a keeper to a corresponding enclosure frame so that the pawl of the latch system can engage with the keeper to shut the door panel and maintain the door panel in a closed position.

It is another object of the present invention to provide a multipoint latch system where a pawl is fixed at one point for rotation about an axis, and to translate the pawl, as well as provide a camming mechanism for controlling the position of the pawl with respect to the door panel throughout the rotation range of the pawl.

It is another object of the present invention to provide a multipoint latch system, which can be readily installed with minimal or no tools required.

It is a further object of the present invention to provide a multipoint latch system, which can be installed in relation to a cabinet and corresponding door panel in a minimal amount of space.

It is another object of the present invention to provide a multipoint latch system, which can be switched from the left hand to right hand door operation as desired by the user.

It is a further object of the present invention to provide a multipoint latch system which ensures engagement of all latch points before the door panel to which the latch is attached can be closed against a corresponding enclosure frame.

BRIEF DESCRIPTION OF THE DRAWING FIGURES

Figure 3A:
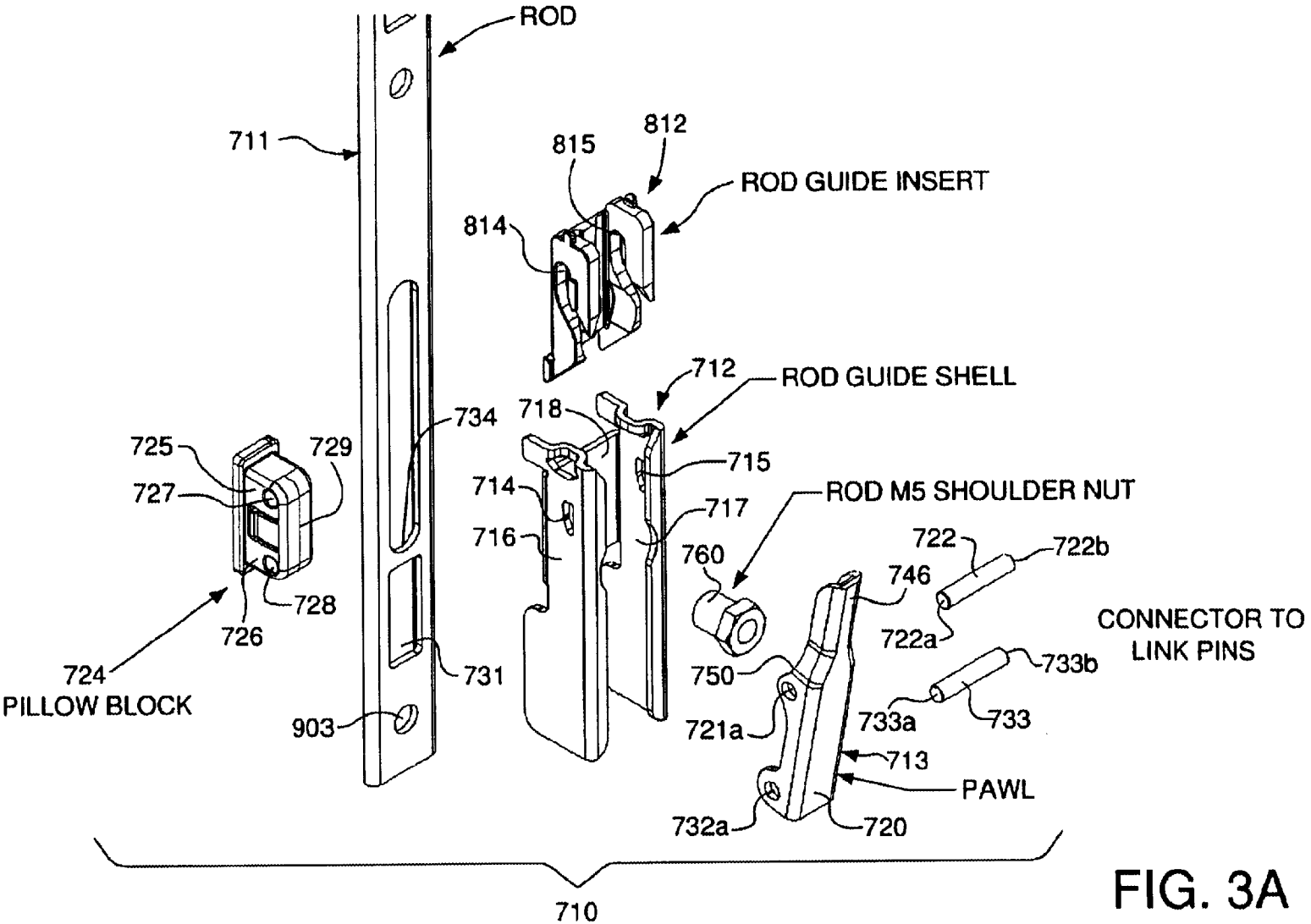

FIG. 3*a* is a first embodiment of an exploded view of a multi-point latch system according to the present invention.

Figure 3B:
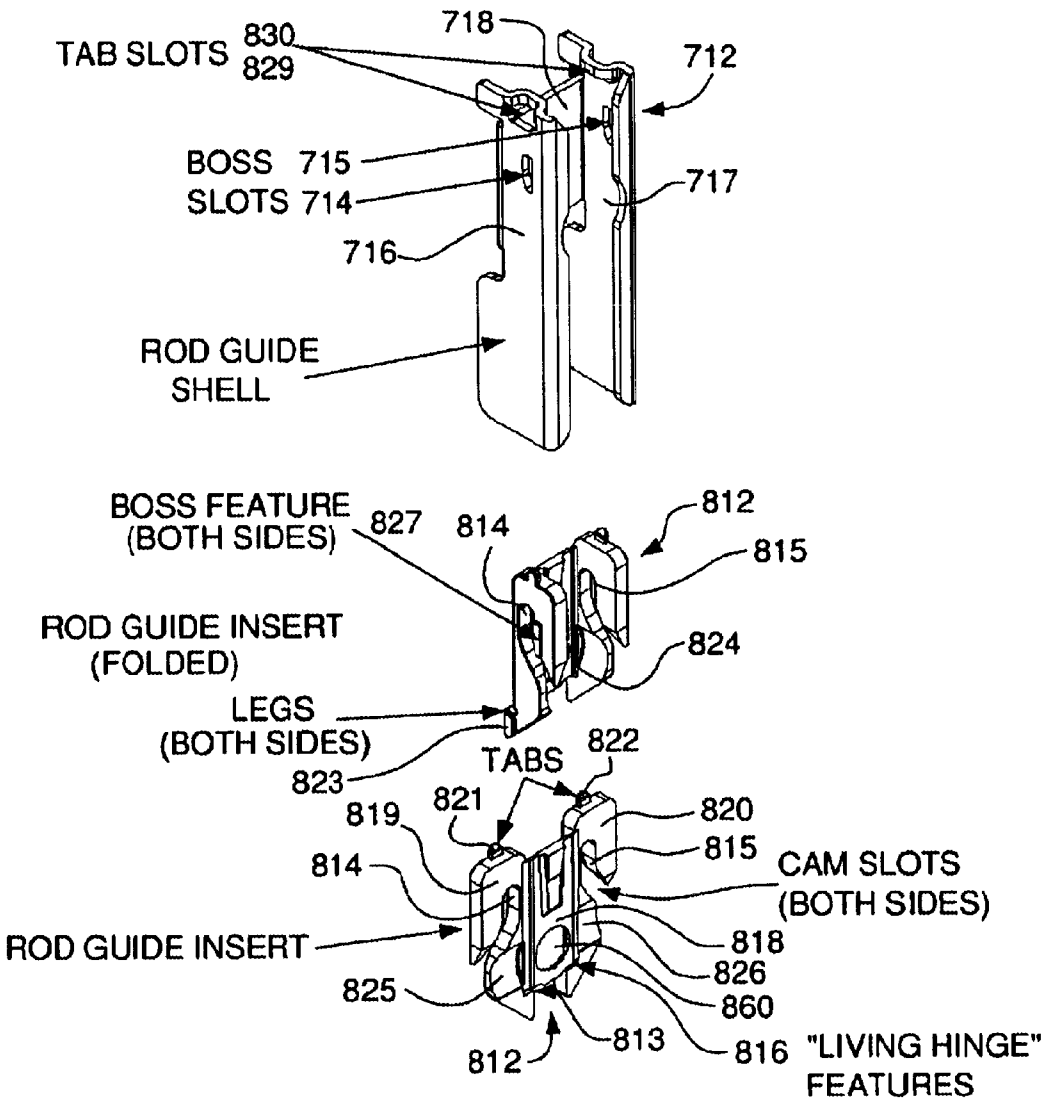

FIG. 3*b* is a perspective view of the rod guide mechanism of the multi-point latching system of FIG. 3*a*.

Figure 3C:
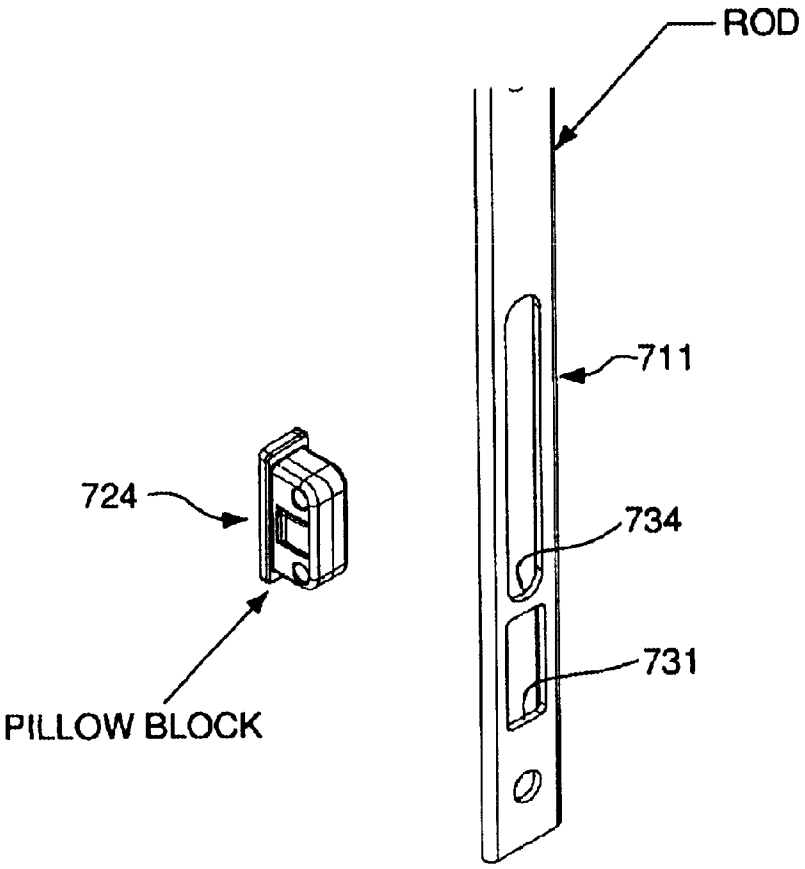

FIG. 3*c* is a perspective view of the pillow block and rod of the multi-point latching system of FIG. 3*a*.

Figure 3D:
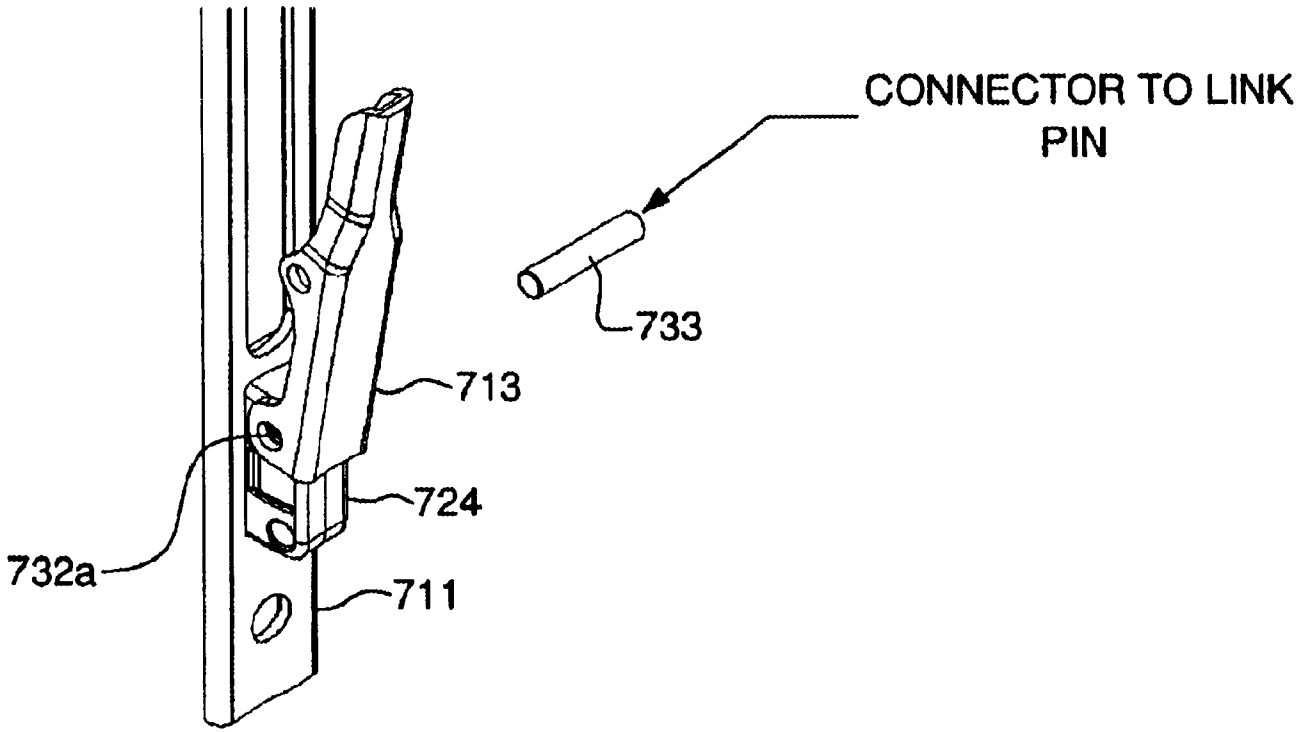

FIG. 3*d* is a perspective view of the pawl assembled onto the pillow block with a first pin, and assembled onto the rod of the multi-point latching system of FIG. 3*a*.

Figure 3E:
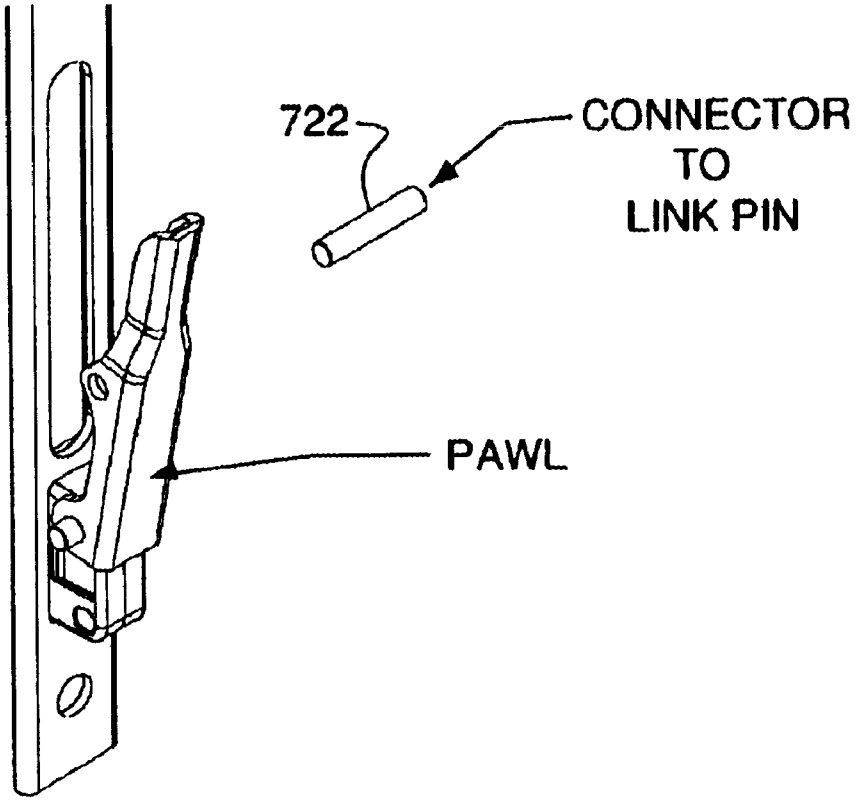

FIG. 3*e* is a perspective view of a second pin being inserted into the pawl assembly as shown in FIG. 3*d*.

Figure 3F:
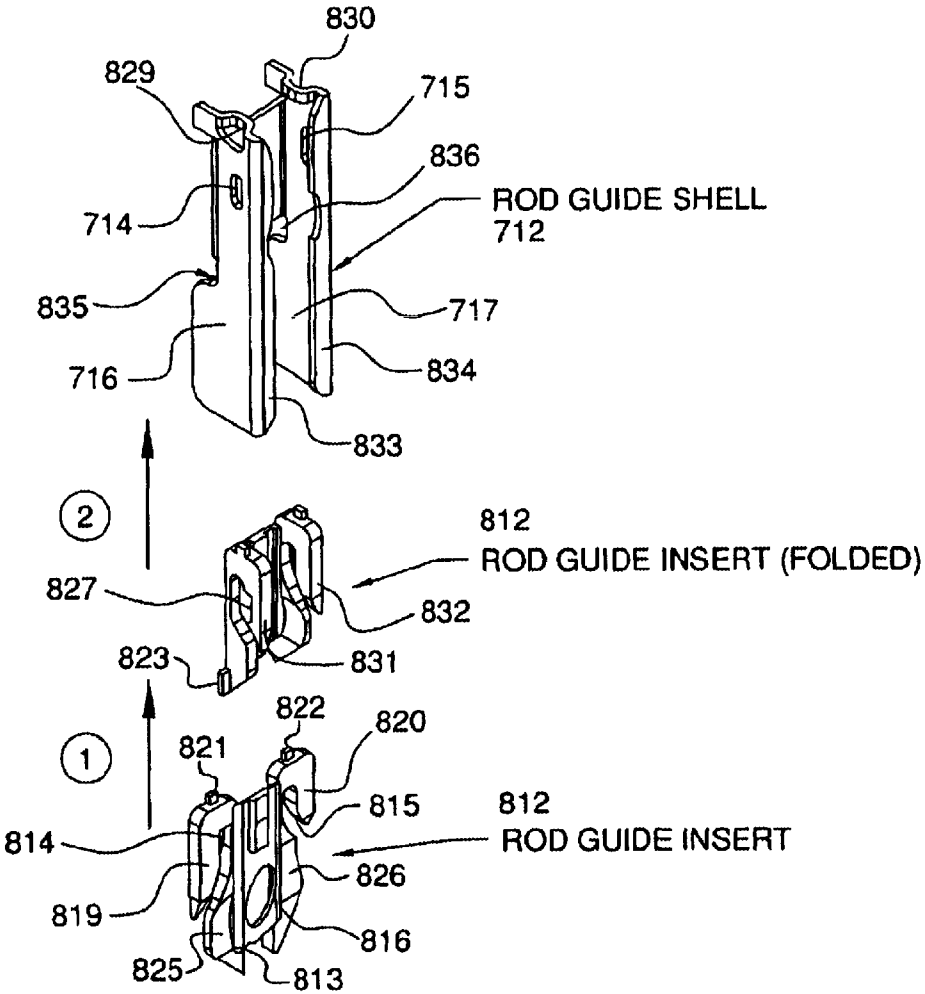

FIG. 3*f* is a perspective view of the assembling sequence of the rod guide mechanism as shown in FIG. 3*b*.

Figure 3G:
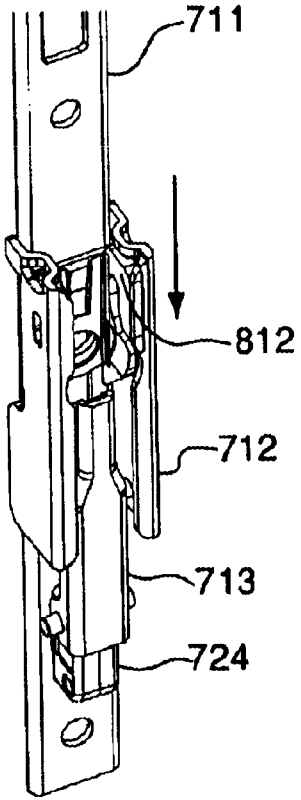

FIG. 3*g* is a perspective view of the rod guide mechanism assembled onto the rod of the multi-point latching system of FIG. 3*a*.

Figure 3H:
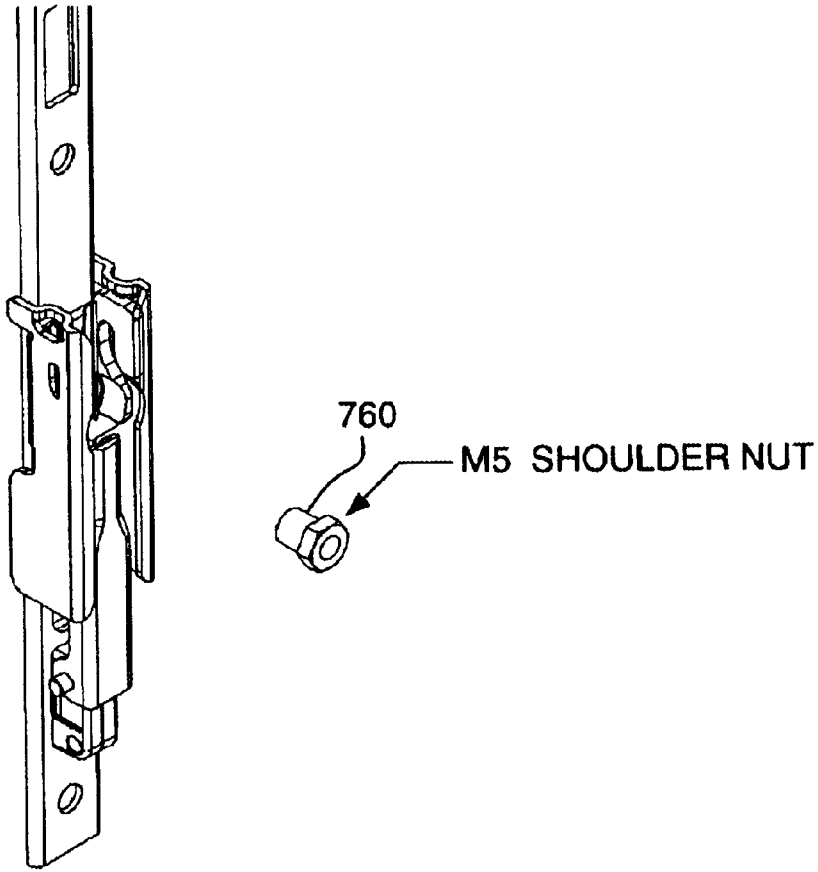

FIG. 3*h* is a perspective view of the shoulder nut of the multi-point latching system of FIG. 3*a*.

Figure 3I:
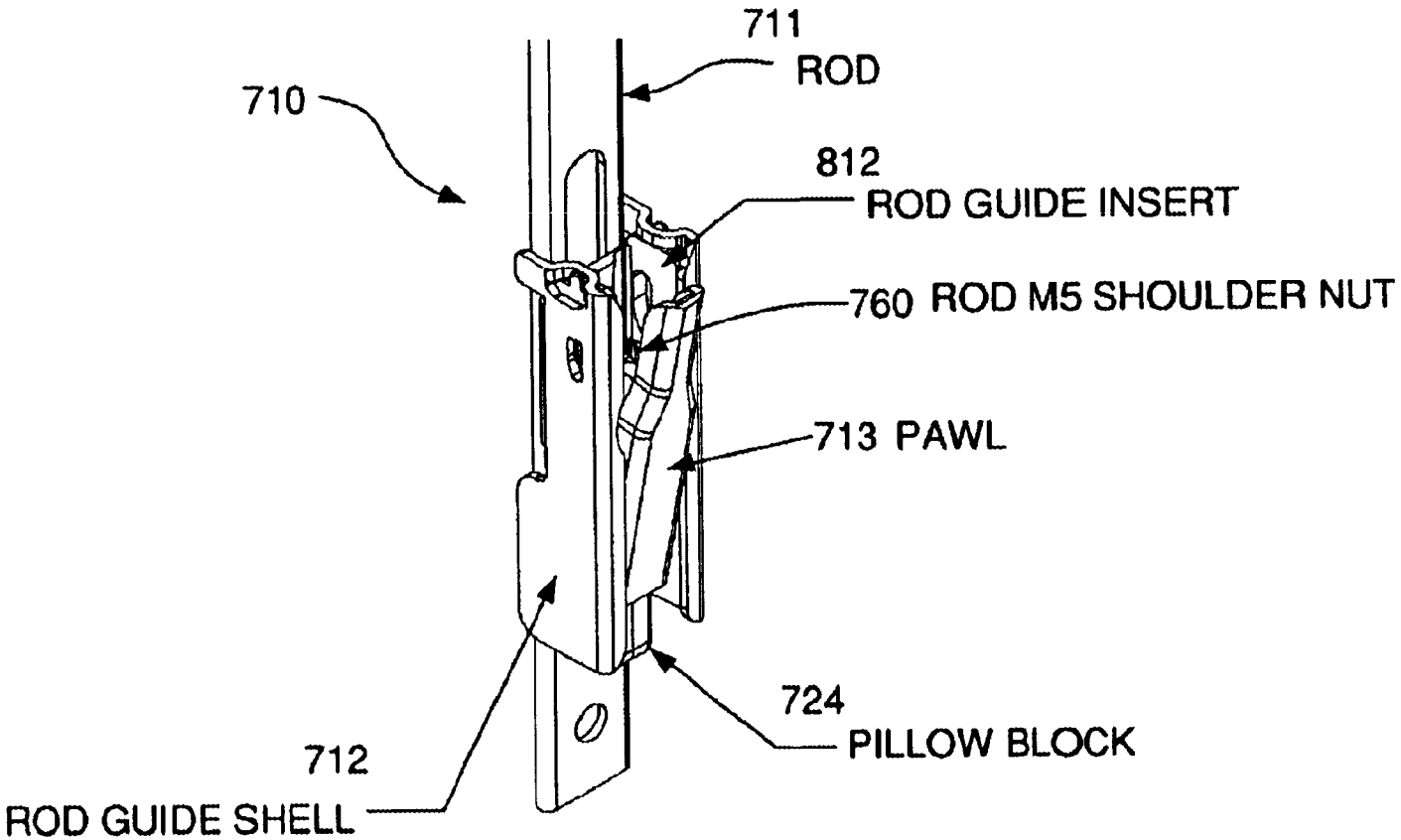

FIG. 3*i* is a perspective view of the assembled multi-point latching system of FIG. 3*a*.

Figure 3J:
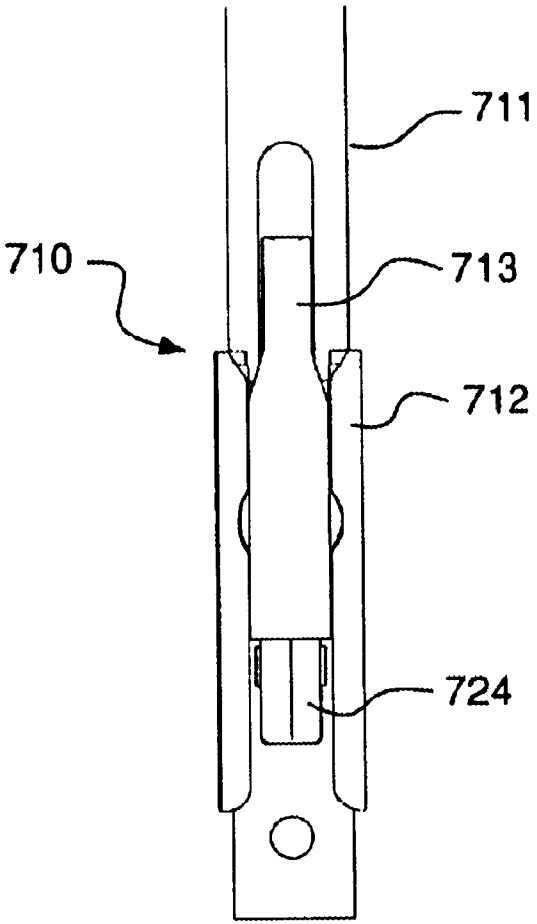

FIG. 3*j* is a front view of the assembled multi-point latching system of FIG. 3*a*.

Figure 4A:
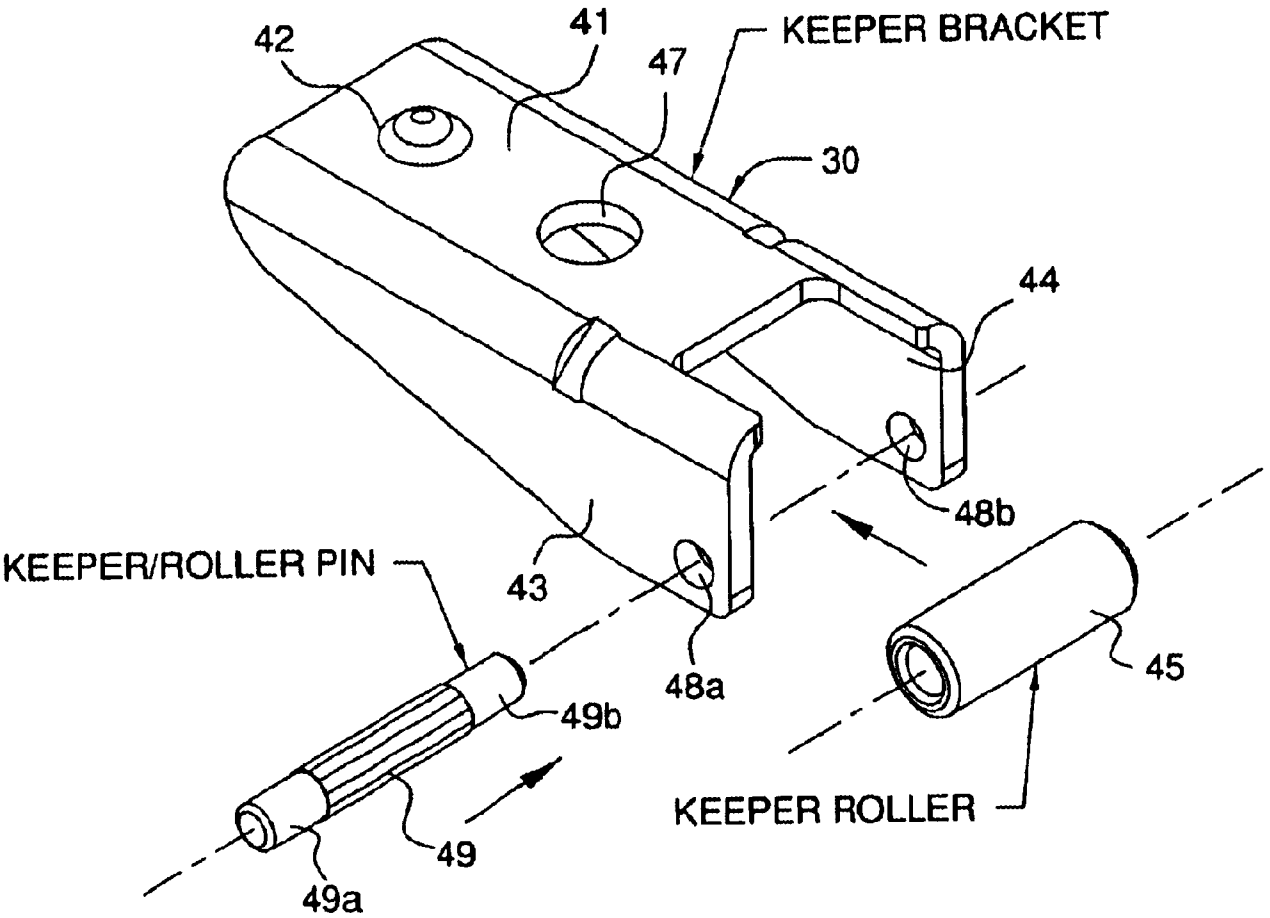

FIG. 4*a* is an exploded view of the keeper bracket assembly.

Figure 4B:
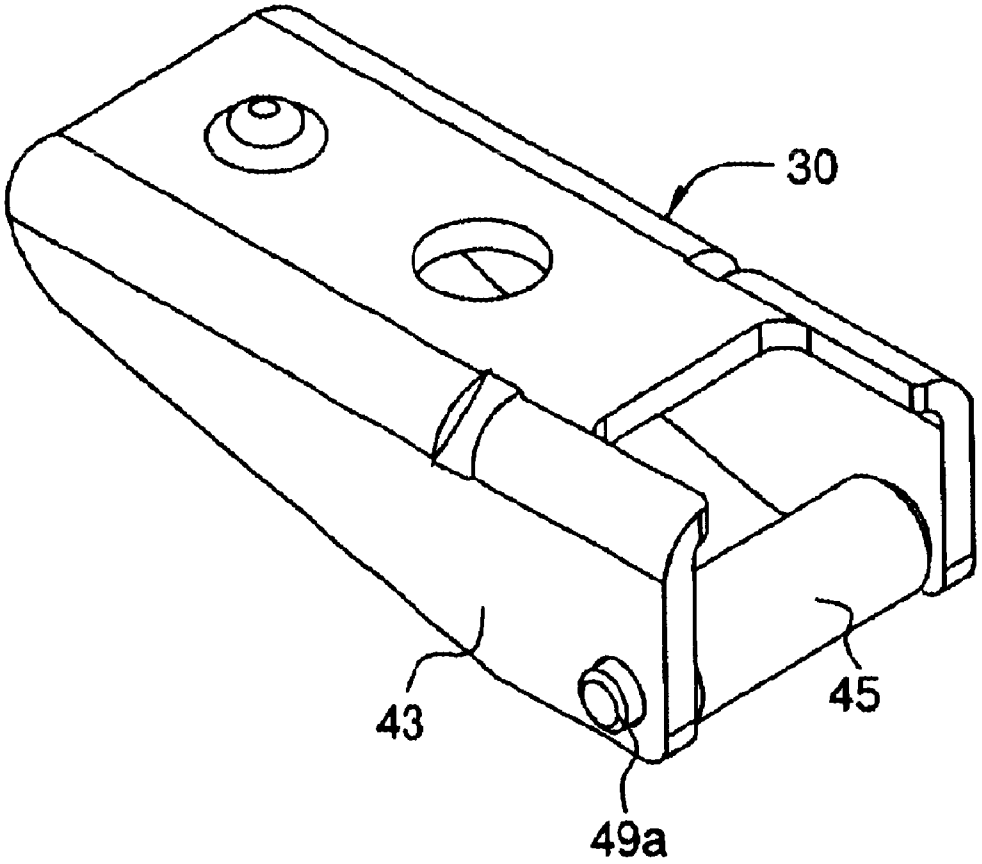

FIG. 4*b* is a perspective view of the assembled keeper bracket assembly.

Figure 4C:
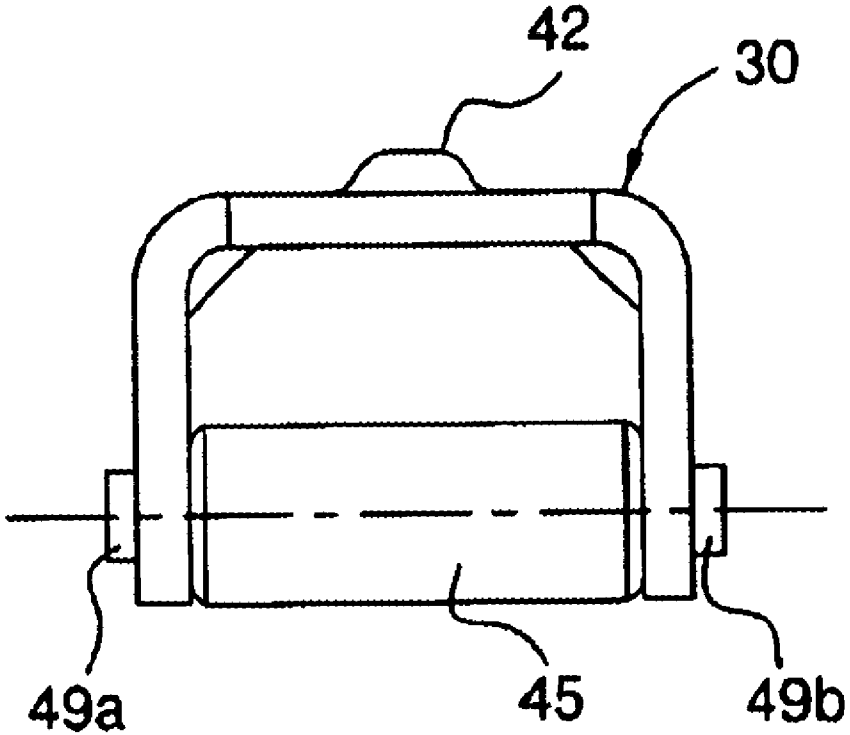

FIG. 4*c* is a bottom view of the assembled keeper bracket assembly.

Figure 5:
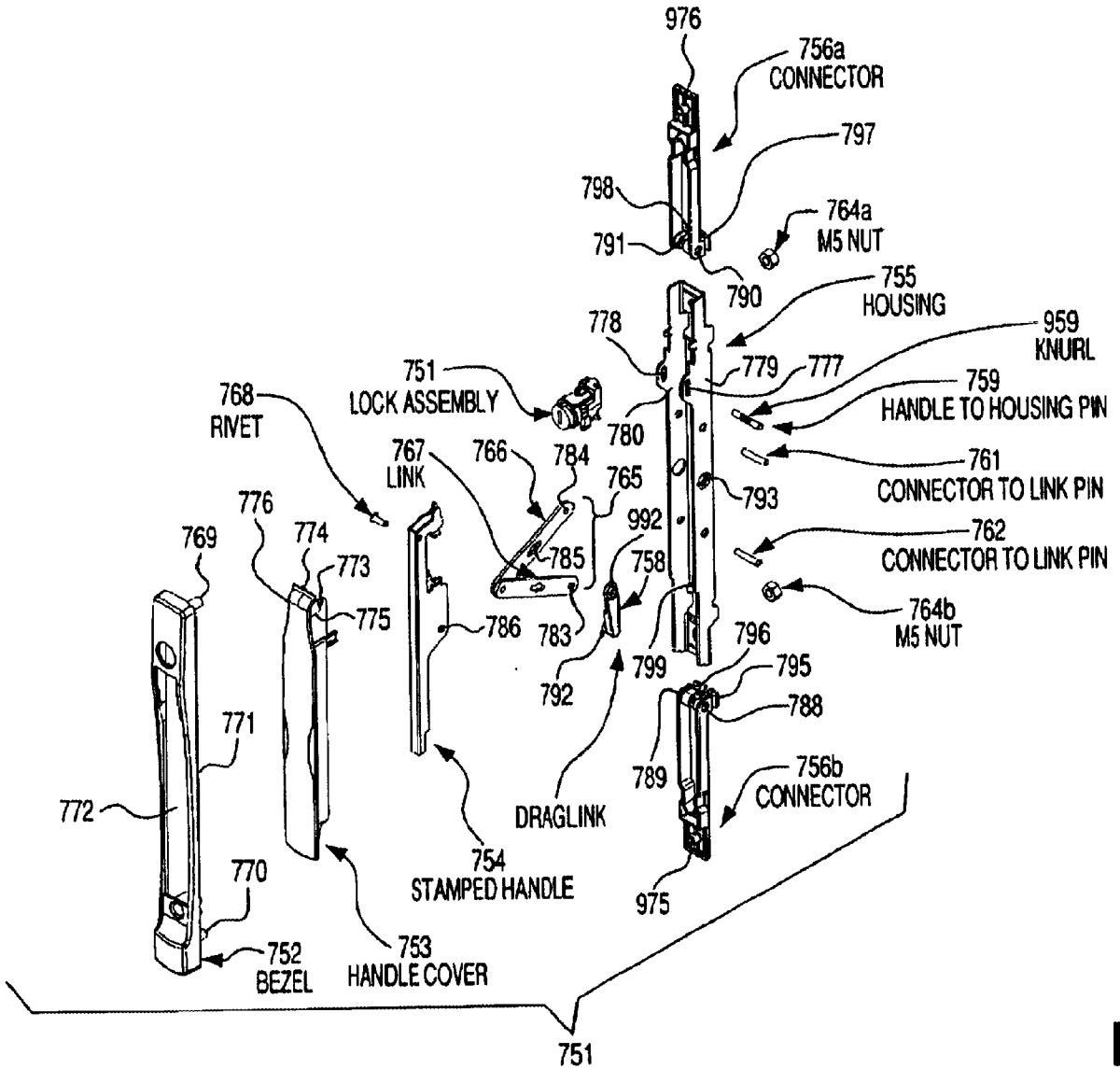

FIG. 5 is an exploded view of the actuator assembly.

Figure 6:
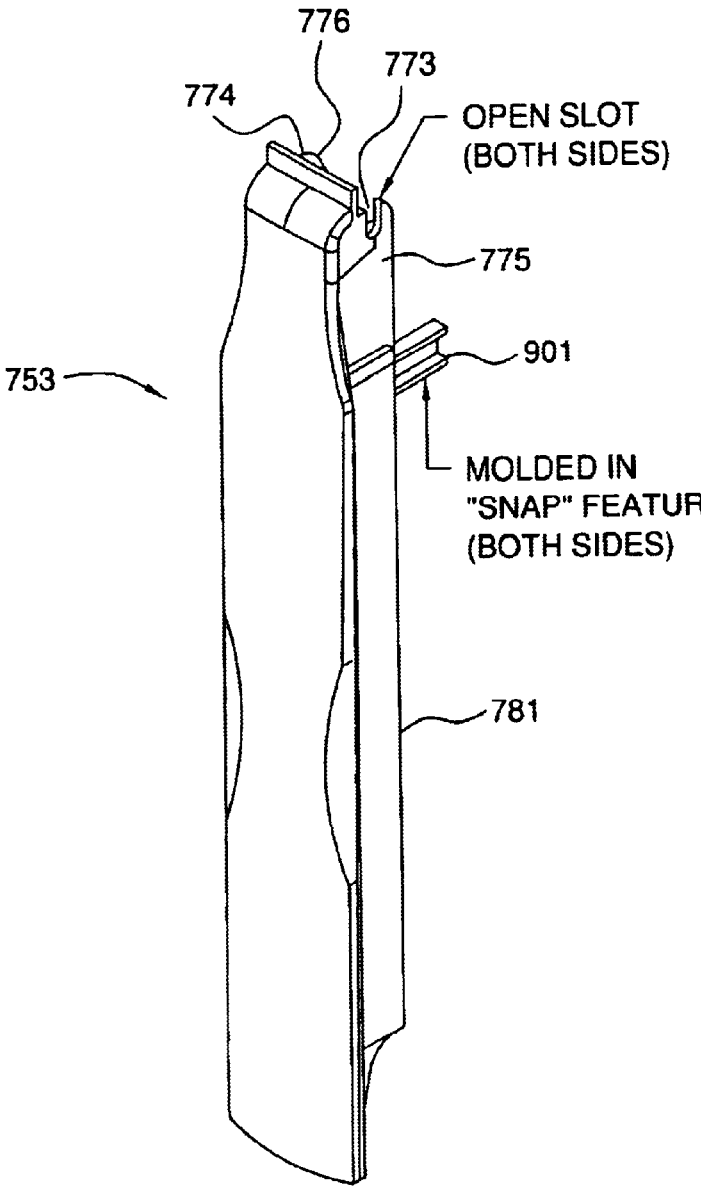

FIG. 6 is a perspective view of the handle cover of FIG. 5.

Figure 7:
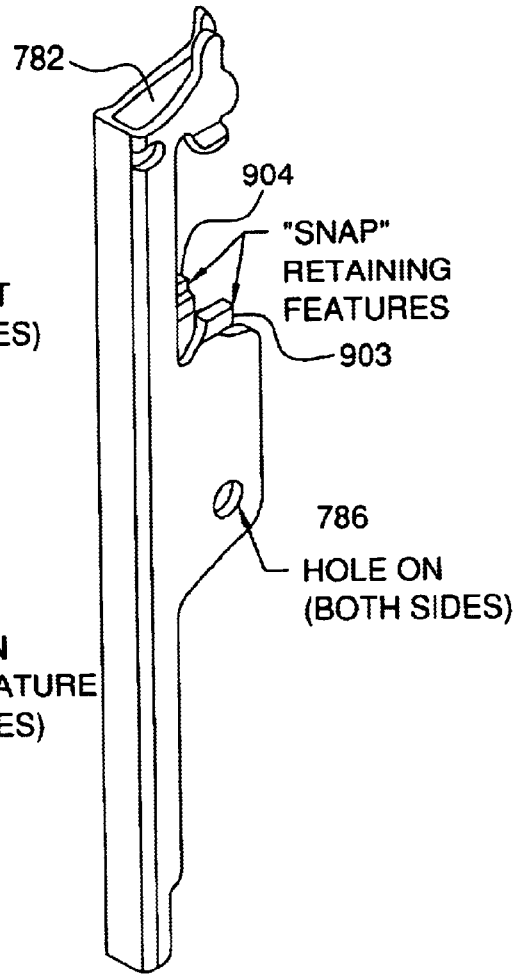

FIG. 7 is a perspective view of the stamped handle of FIG. 5.

Figure 8A:
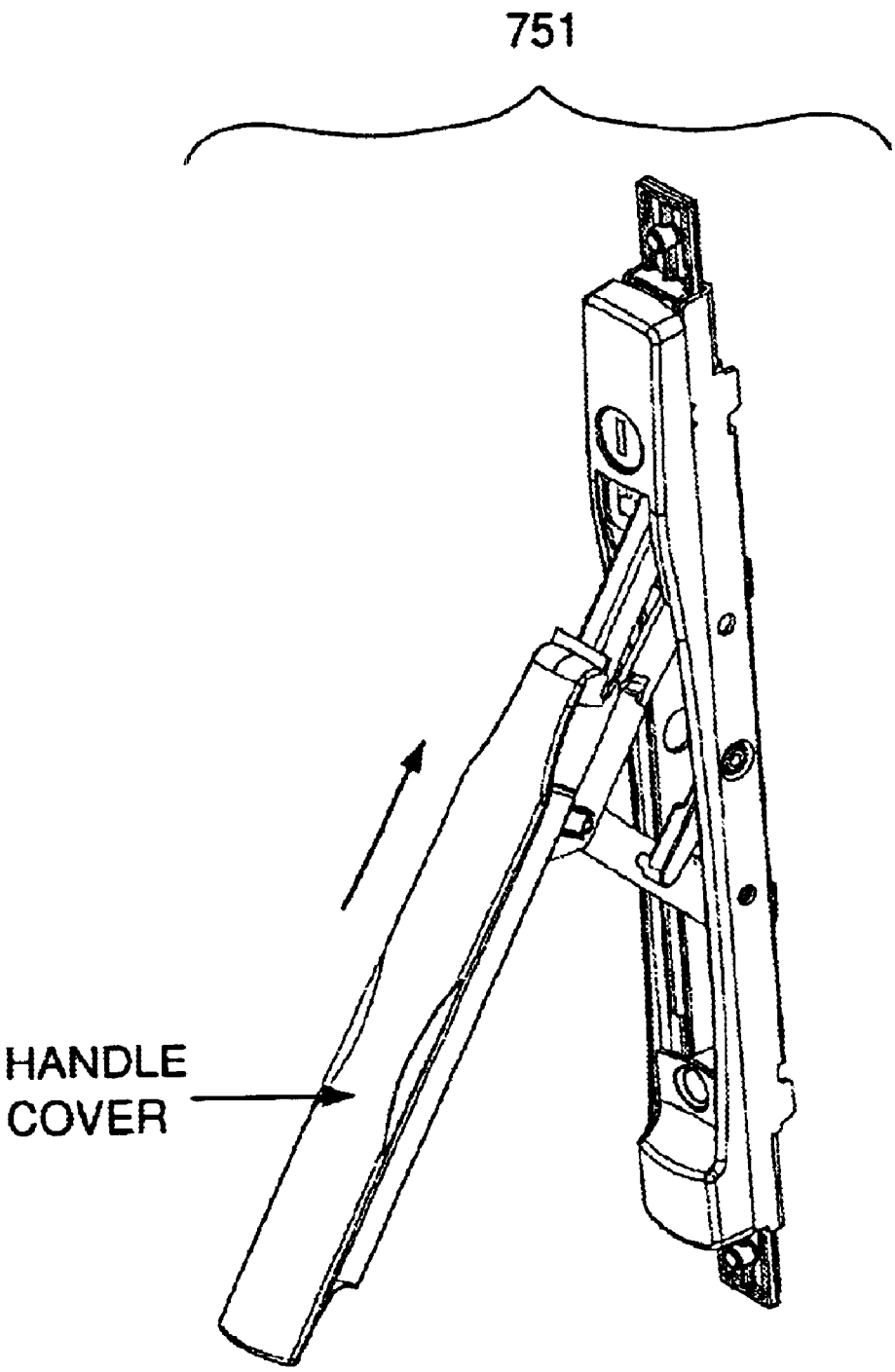

FIG. 8*a* is a perspective view of the actuator assembly of FIG. 5, showing the handle cover being installed.

Figure 8C:
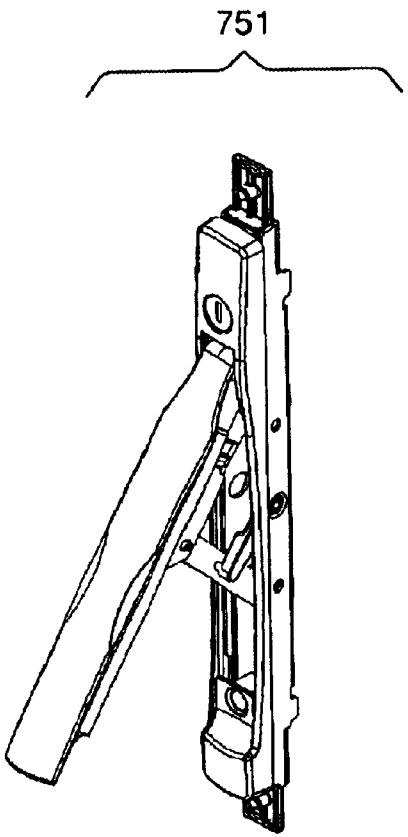
Figure 8B:
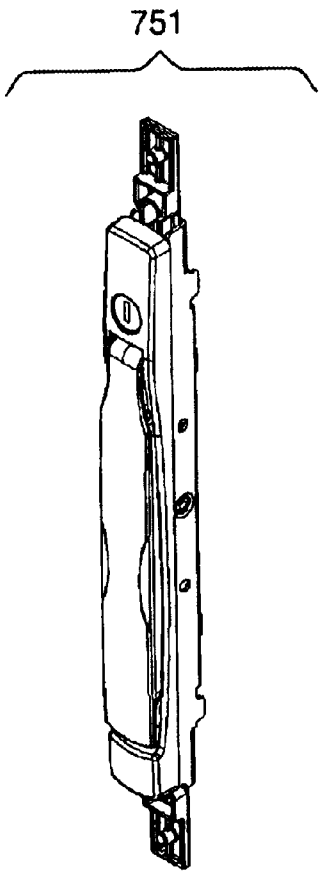

FIG. 8*b* is a perspective view of the actuator assembly of FIG. 5, shown in the closed position.

FIG. 8*c* is a perspective view of the actuator assembly of FIG. 5, shown in the open position.

Figure 9A:
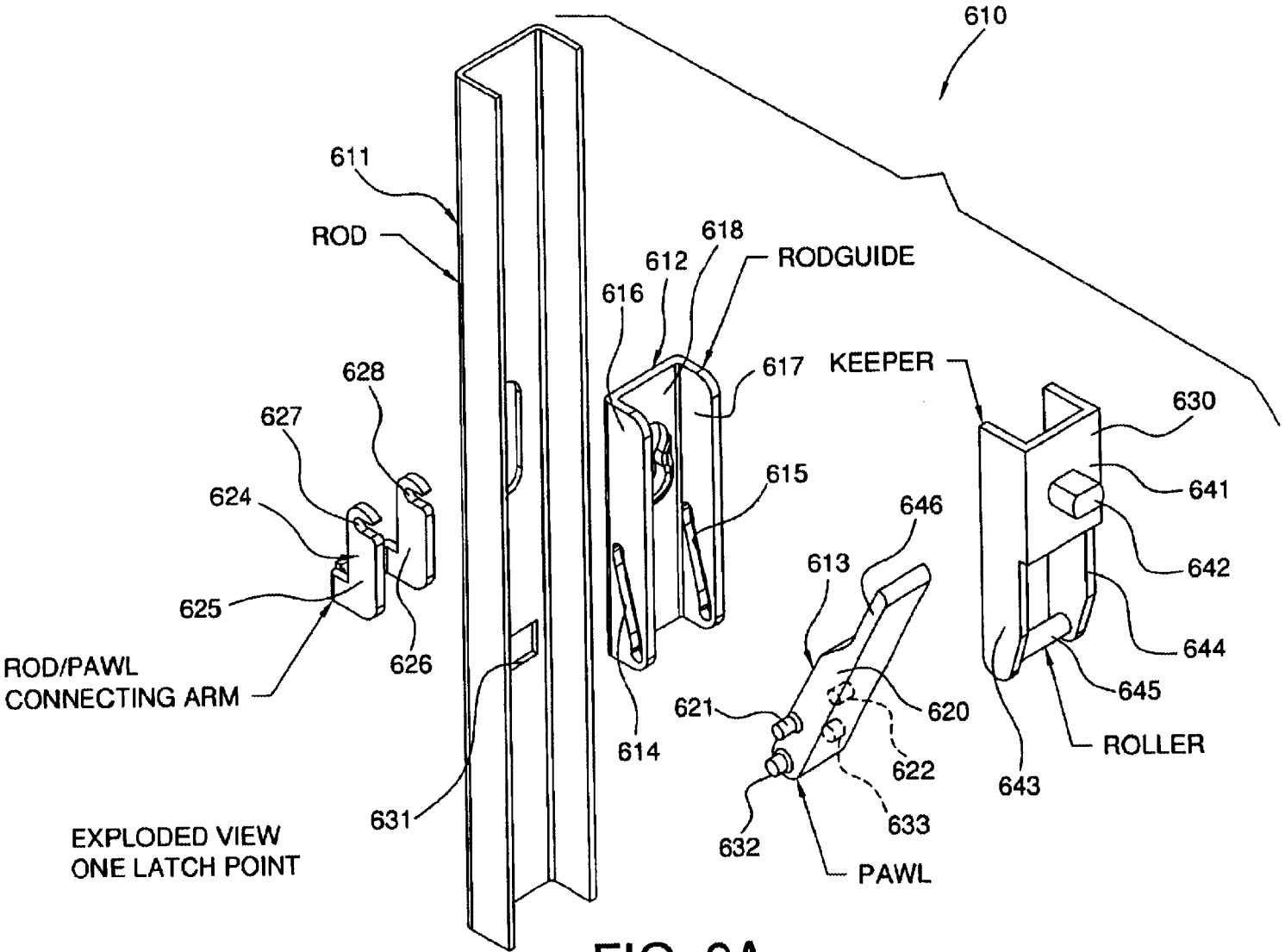

FIG. 9*a* is an exploded view of a second alternate embodiment of a multi-point latching system according to the present invention.

Figure 9C:
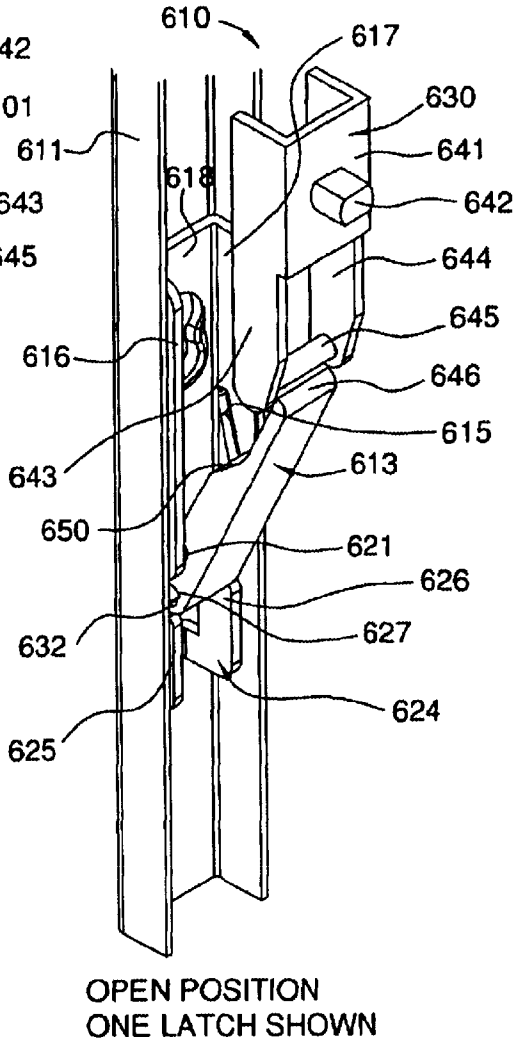
Figure 9B:
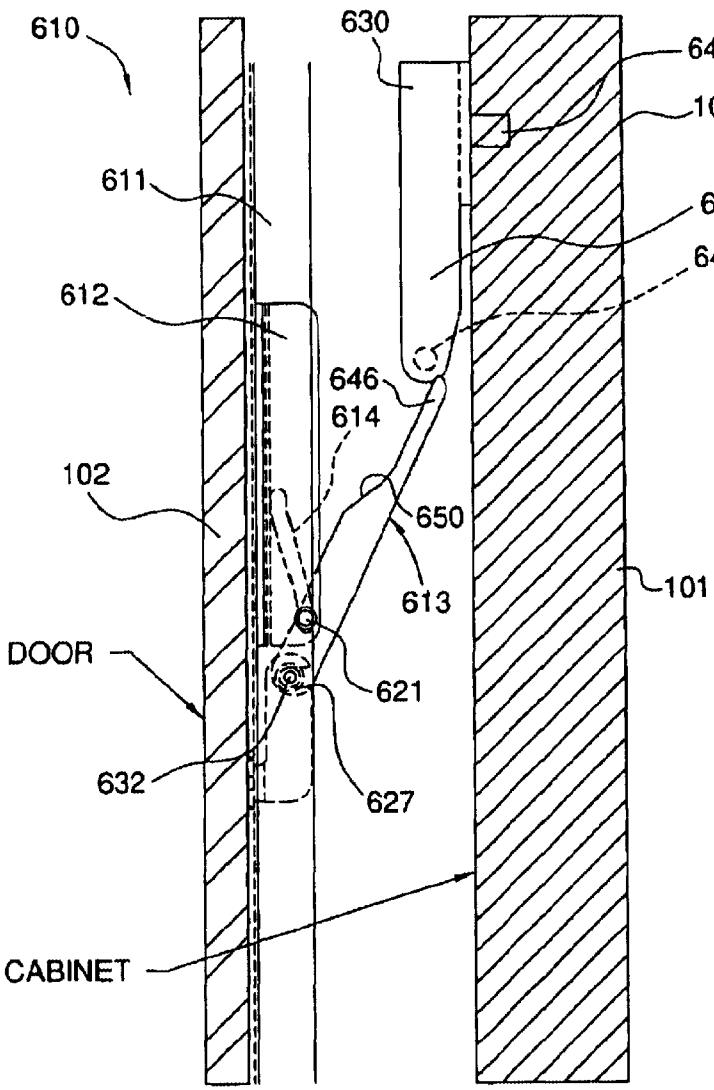

FIG. 9*b* is a left side elevation view of the multi-point latching system of FIG. 9*a* installed with a door and cabinet, the door and cabinet being shown in sectional view.

FIG. 9*c* is a parallel perspective view, as viewed from the top left side of the multi-point latching system of FIGS. 9*a* and 9*b* shown in an open position.

Figure 9E:
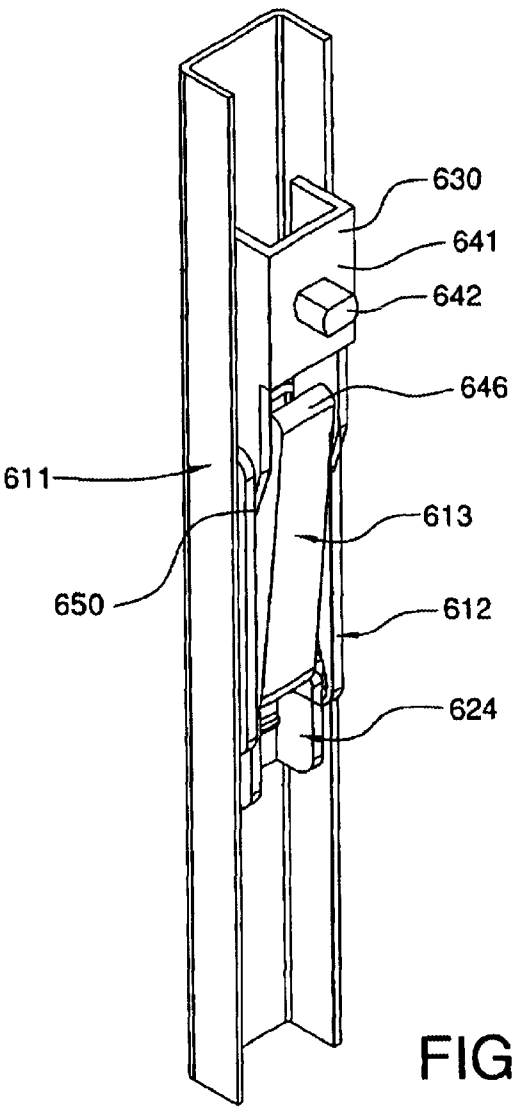
Figure 9D:
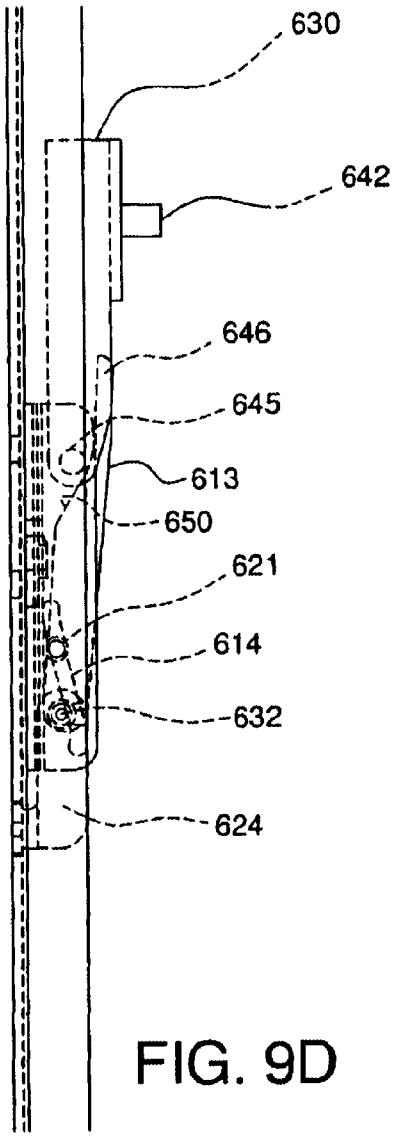

FIG. 9*d* is a left side elevation view of the multi-point latching system of FIG. 9*b*, shown in a partially closed position.

FIG. 9*e* is the same view of the multi-point latching system shown in FIG. 9*c*, but appearing in the partially closed position.

Figure 9G:
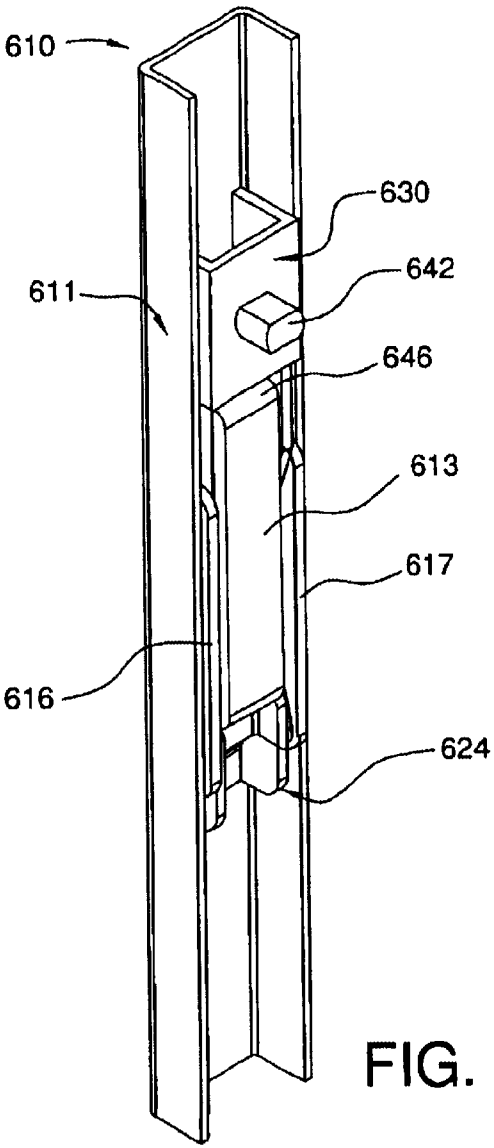
Figure 9F:
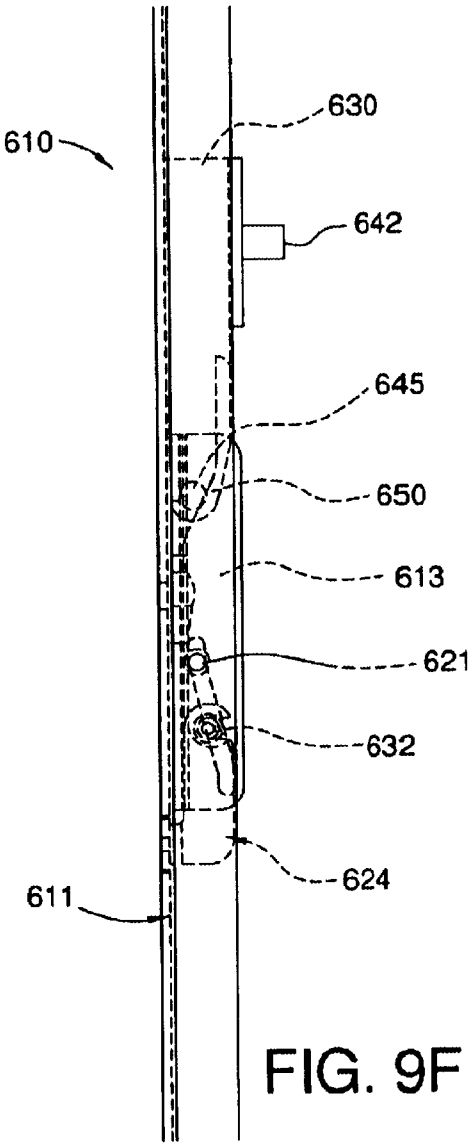

FIG. 9*f* is a left side elevation view of the latch shown in the view of FIG. 9*d*, but in the closed position.

FIG. 9*g* is a perspective view of the latch shown in FIG. 9*e*, shown in the same view, but in the closed position.

Figure 10A:
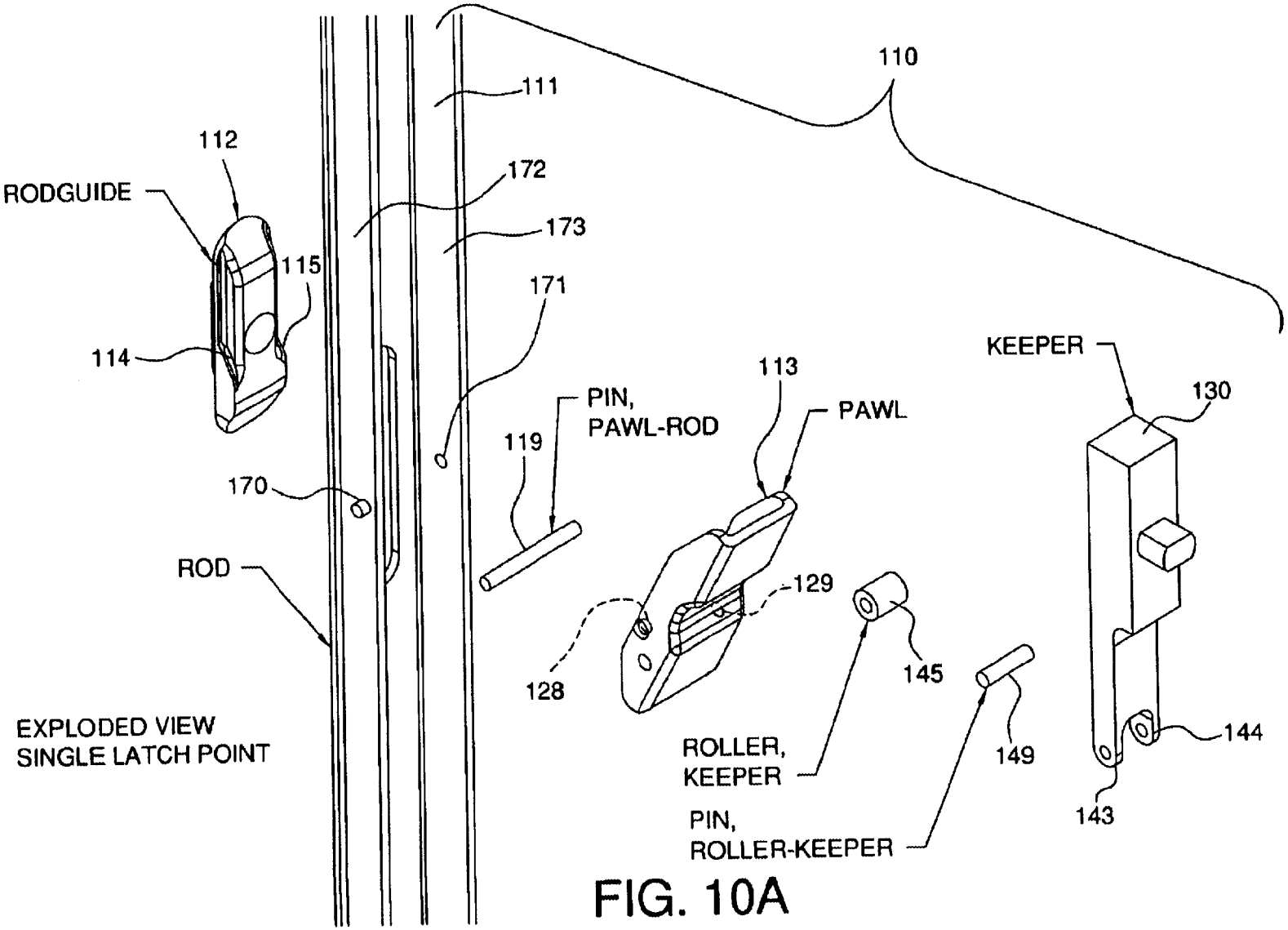

FIG. 10*a* is an exploded view of a third alternate embodiment of a multi-point latching system according to the present invention.

Figure 10C:
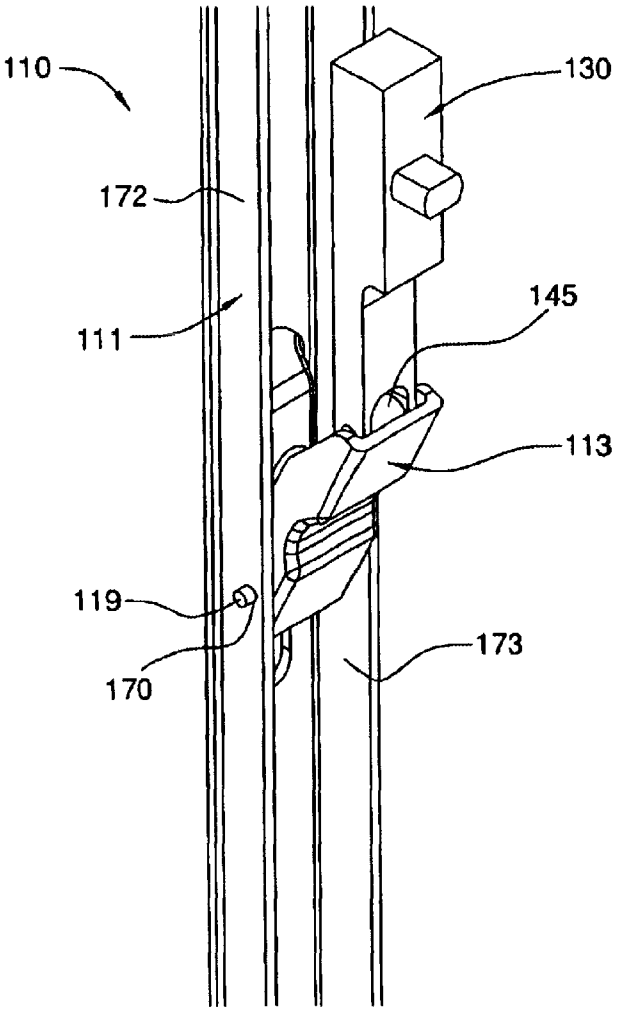
Figure 10B:
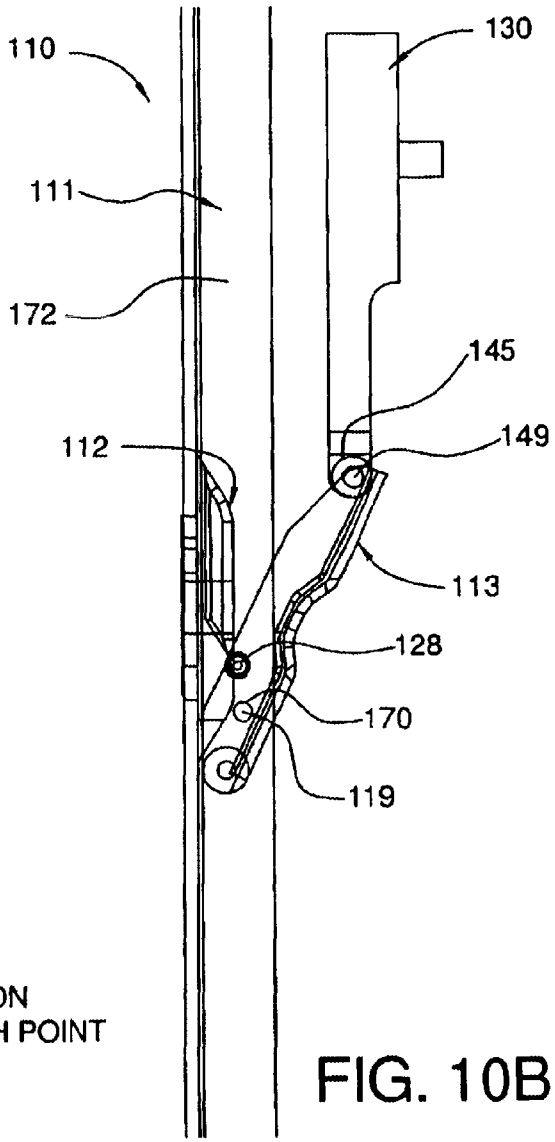

FIG. 10*b* is a left side elevation view of the multi-point latching system of FIG. 10*a*, shown assembled and in a partially open position.

FIG. 10*c* is a parallel perspective view, looking from the top left of the third alternate embodiment of the multi-point latching system in FIGS. 10*a* and 10*b*, shown in the partially open position.

Figures 10D, 10E, 10F, 10G:
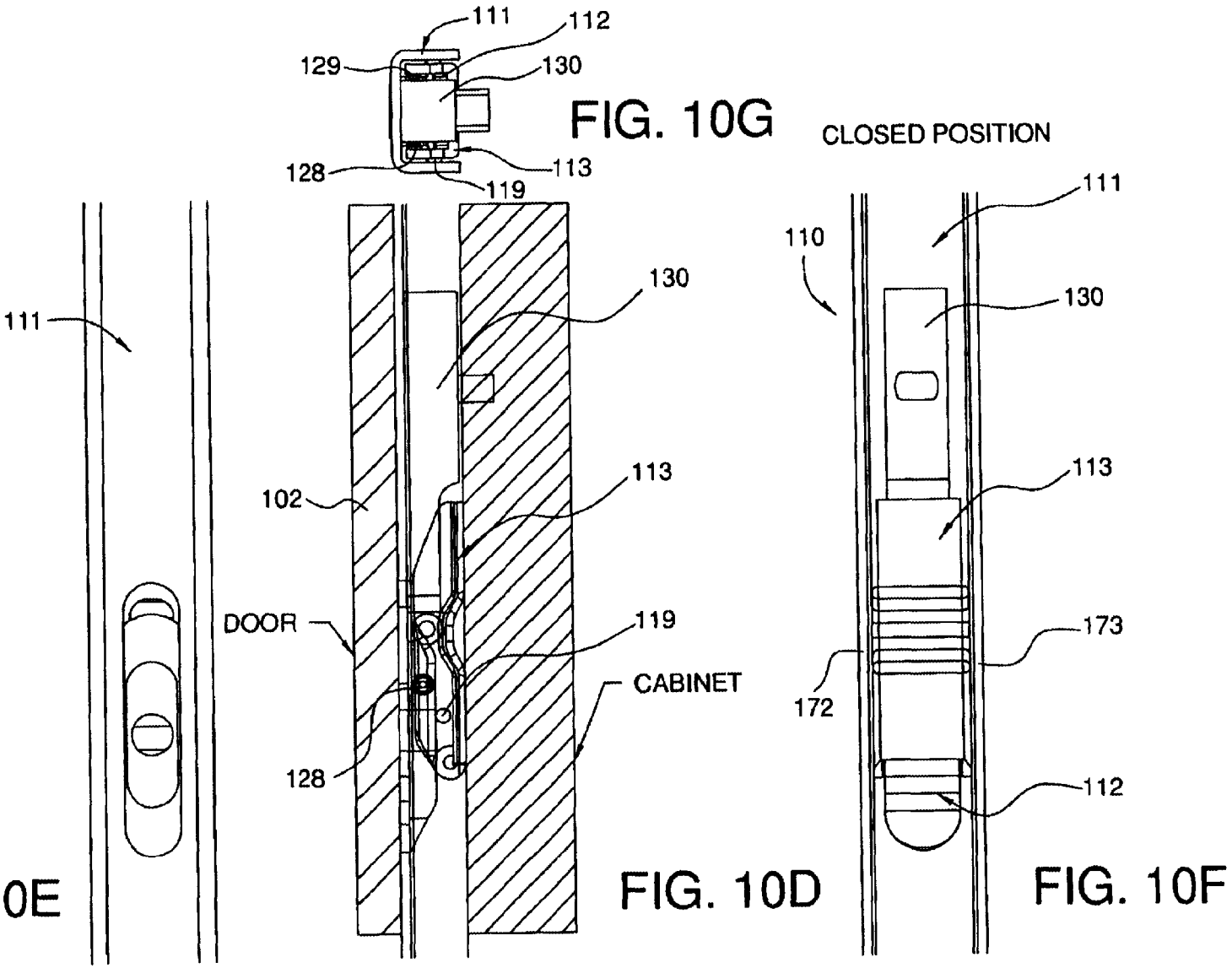

FIG. 10*d* is a left side elevation view of the third alternate embodiment of the multi-point latching system according to the present invention shown installed with a door and cabinet, the door and cabinet being shown in sectional view.

FIG. 10*e* is a rear elevation view of the multi-point latching system shown in FIG. 10*d*.

FIG. 10*f* is a front elevation view of the multi-point latching system shown in FIG. 10*d*.

FIG. 10*g* is a top plan view of the multi-point latching system shown in FIG. 10*d*.

Figure 11A:
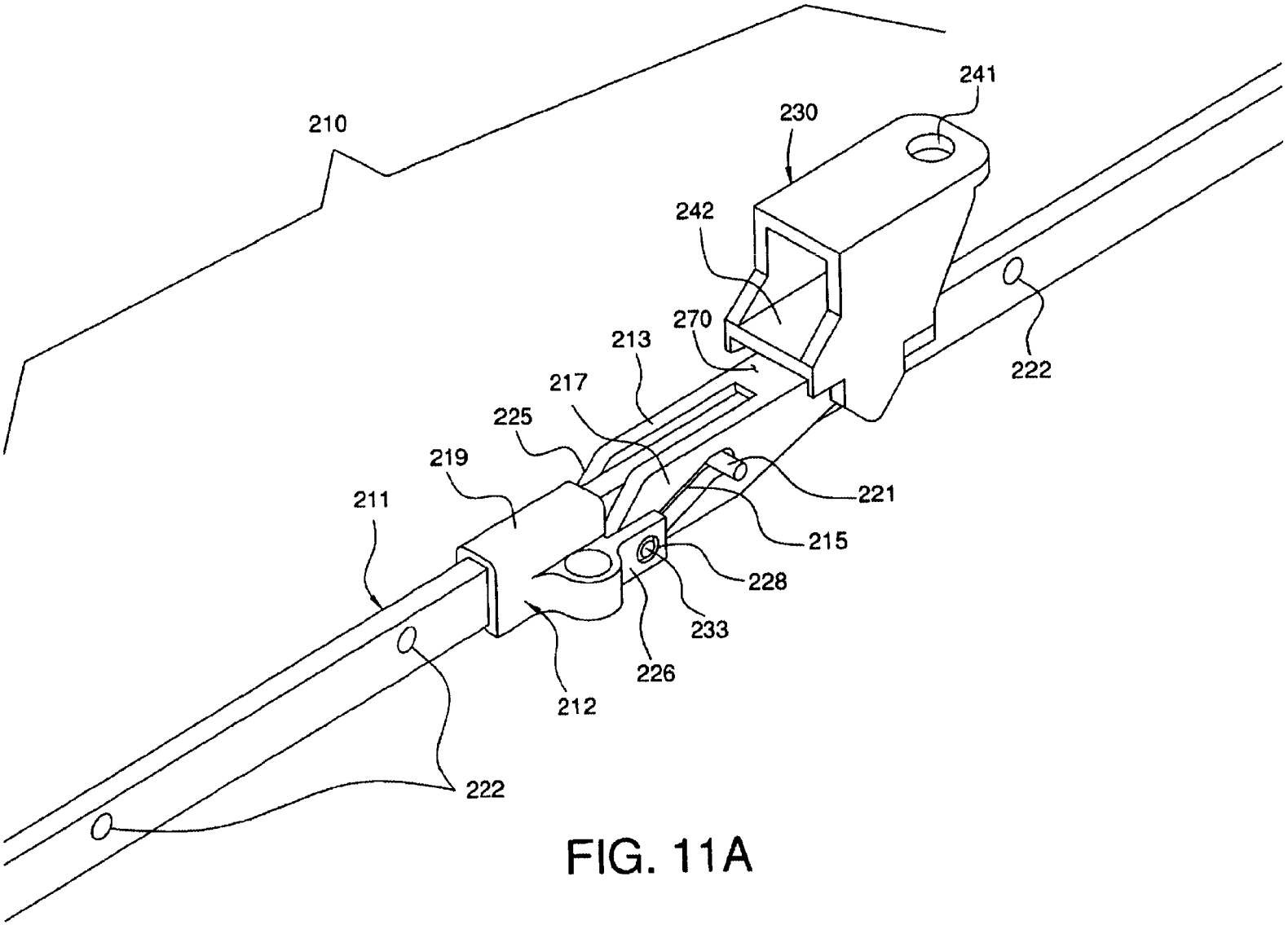

FIG. 11*a* is a parallel perspective view of a fourth alternate embodiment of a multi-point latch system according to the present invention.

Figure 11B:
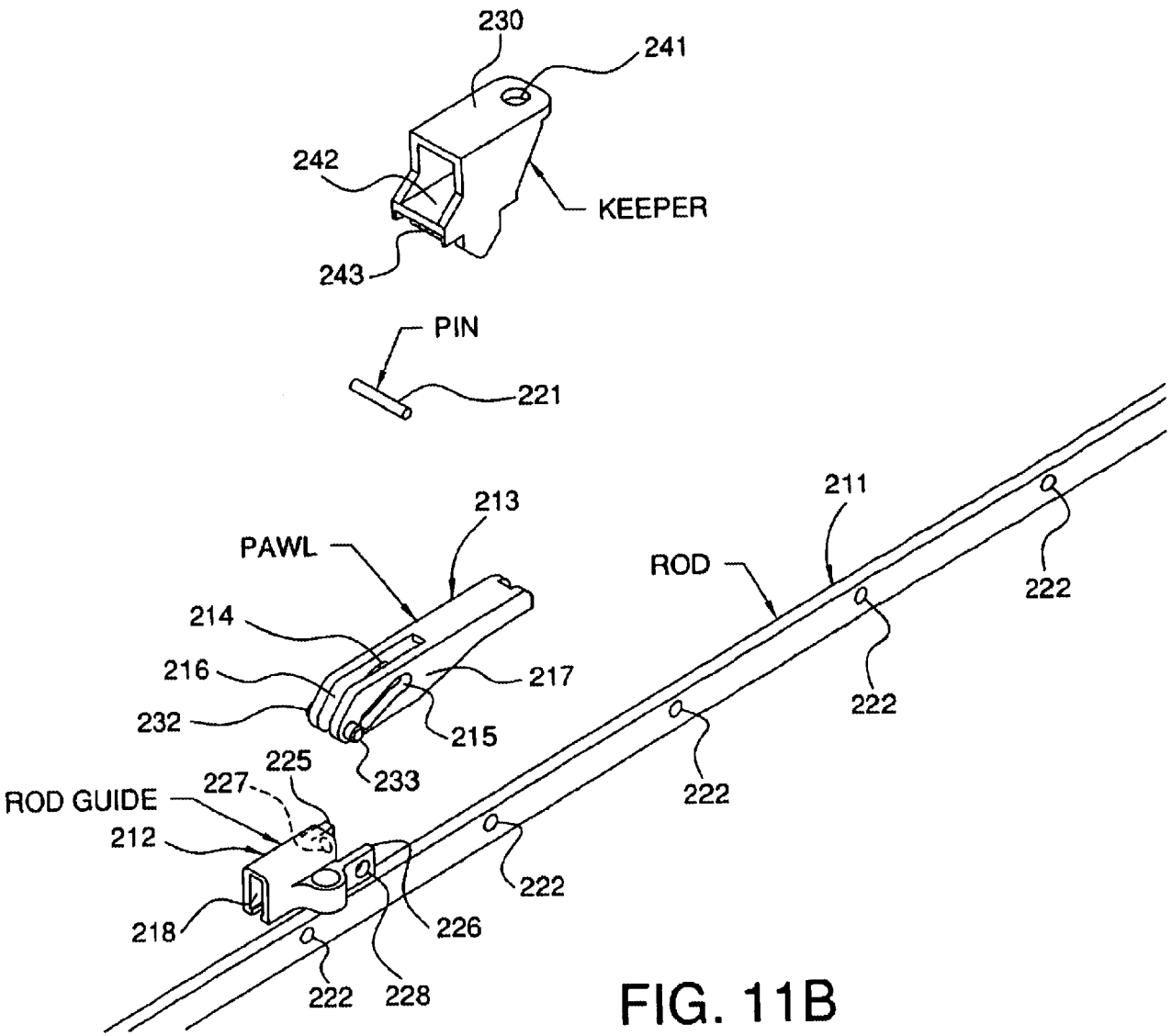

FIG. 11*b* is an exploded view of the fourth alternate embodiment of the present invention shown in FIG. 11*a*.

Figure 11C:
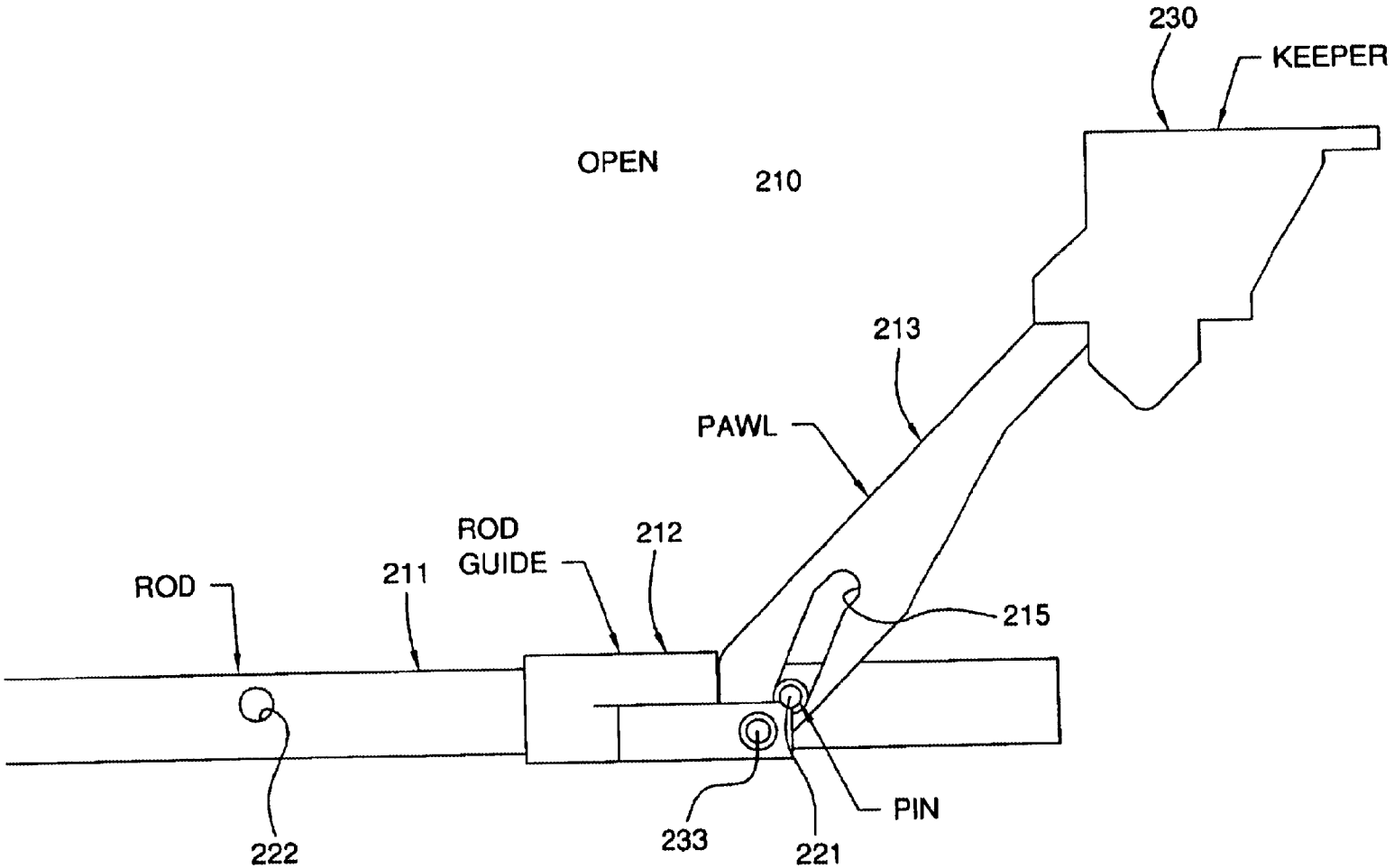

FIG. 11*c* is a right side elevation view of the fourth alternate embodiment of the multi-point latching system, shown in an open position.

Figure 11D:
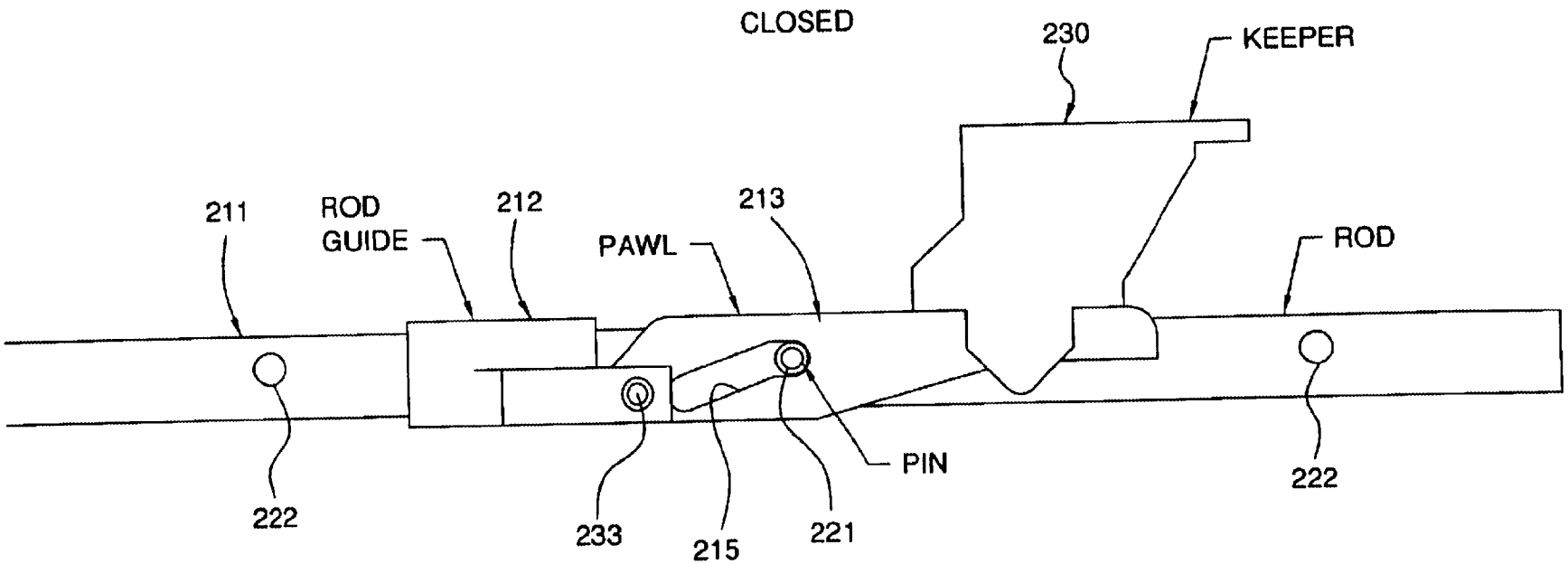

FIG. 11*d* is a right side elevation view of the fourth alternate embodiment of the multi-point latching system, shown in the closed position.

Figure 12A:
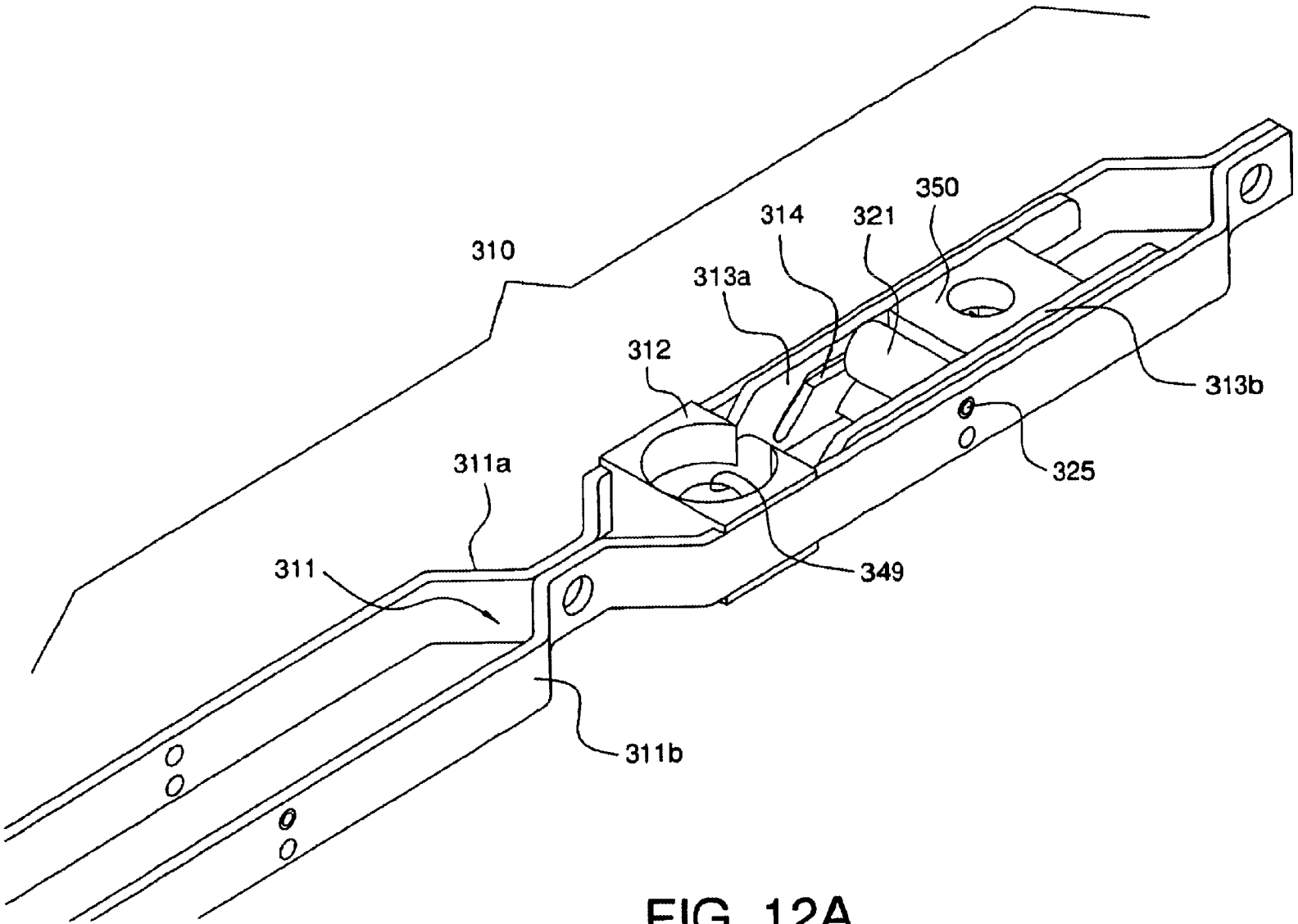

FIG. 12*a* is a parallel perspective view of a fifth alternate embodiment of a multi-point latching system according to the present invention.

Figure 12B:
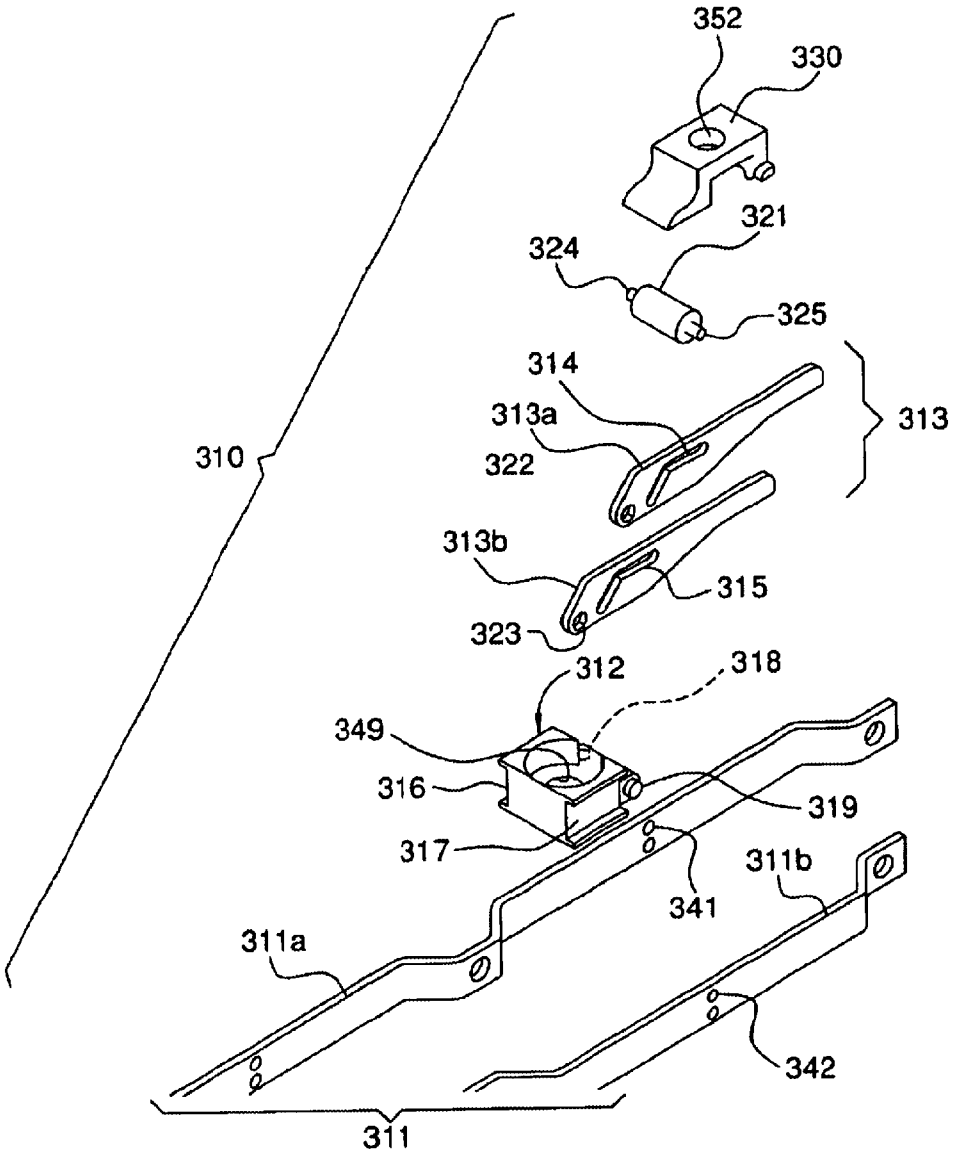

FIG. 12*b* is an exploded view of the fifth alternate embodiment of the multi-point latching system shown in FIG. 12*a*.

Figure 12C:
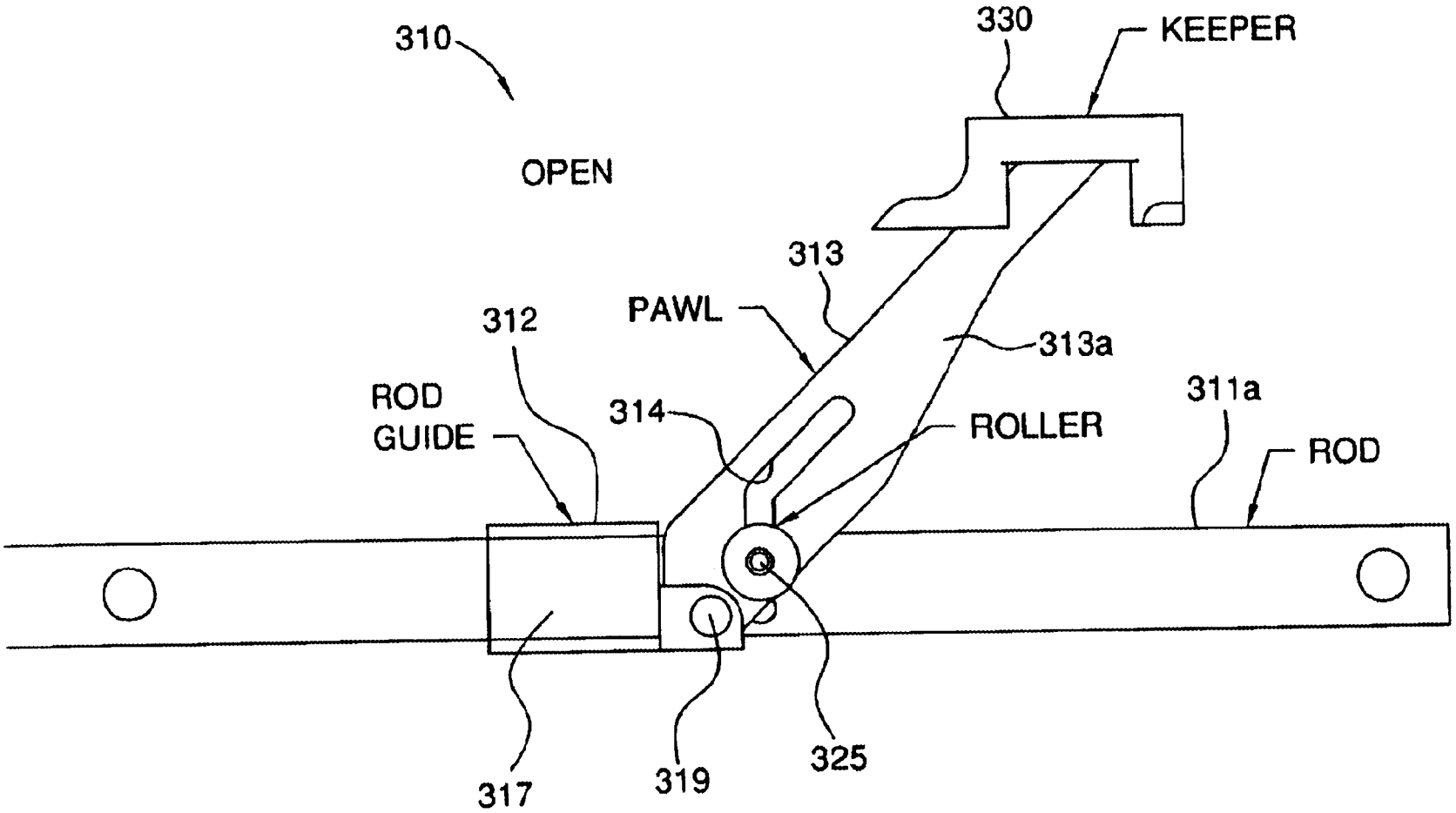

FIG. 12*c* is a right side elevation view of the fifth alternate embodiment of a multi-point latching system according to the present invention, shown in the open position.

Figure 12D:
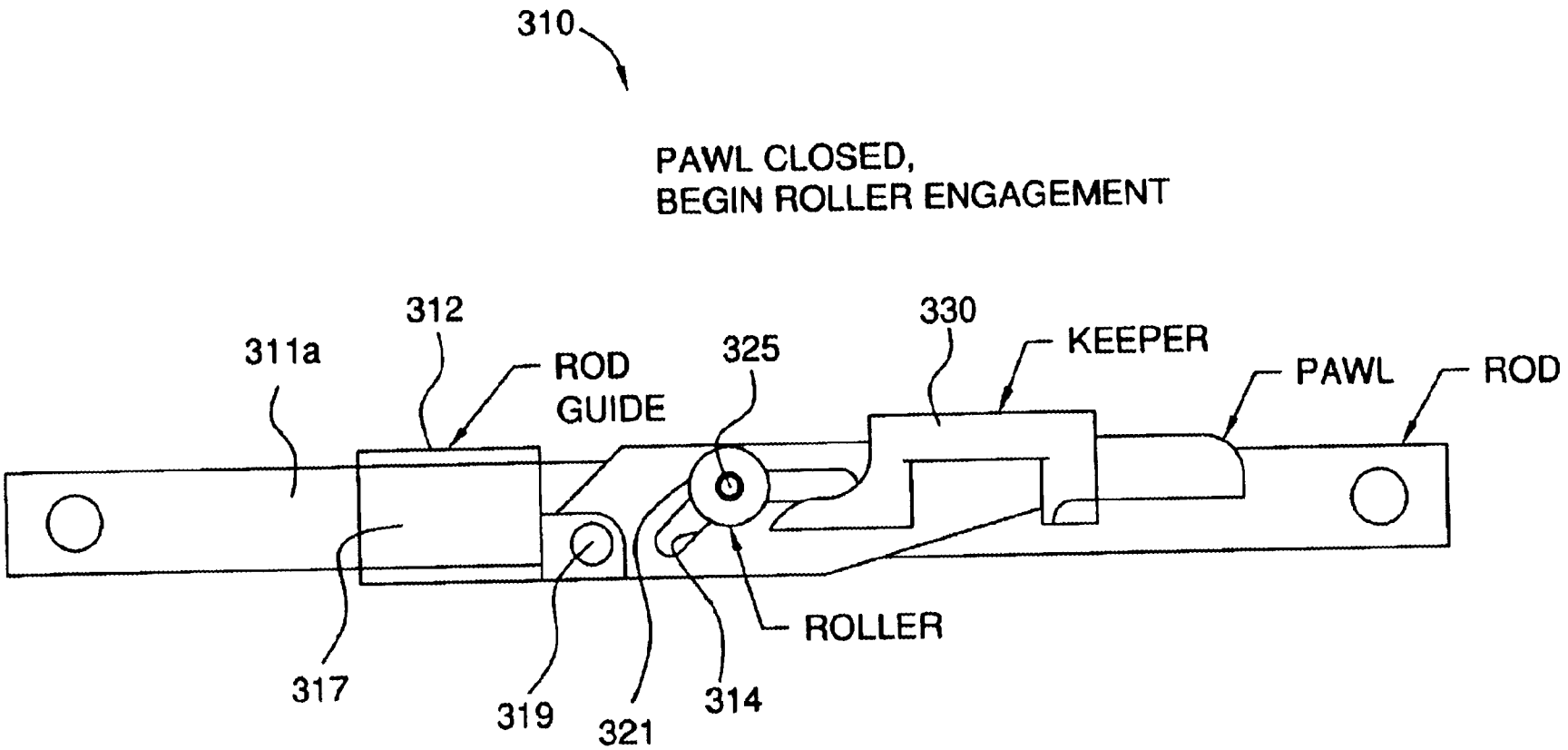

FIG. 12*d* is a right side elevation view of the fifth alternate embodiment of the multi-point latching system shown in the partially closed position.

Figure 12E:
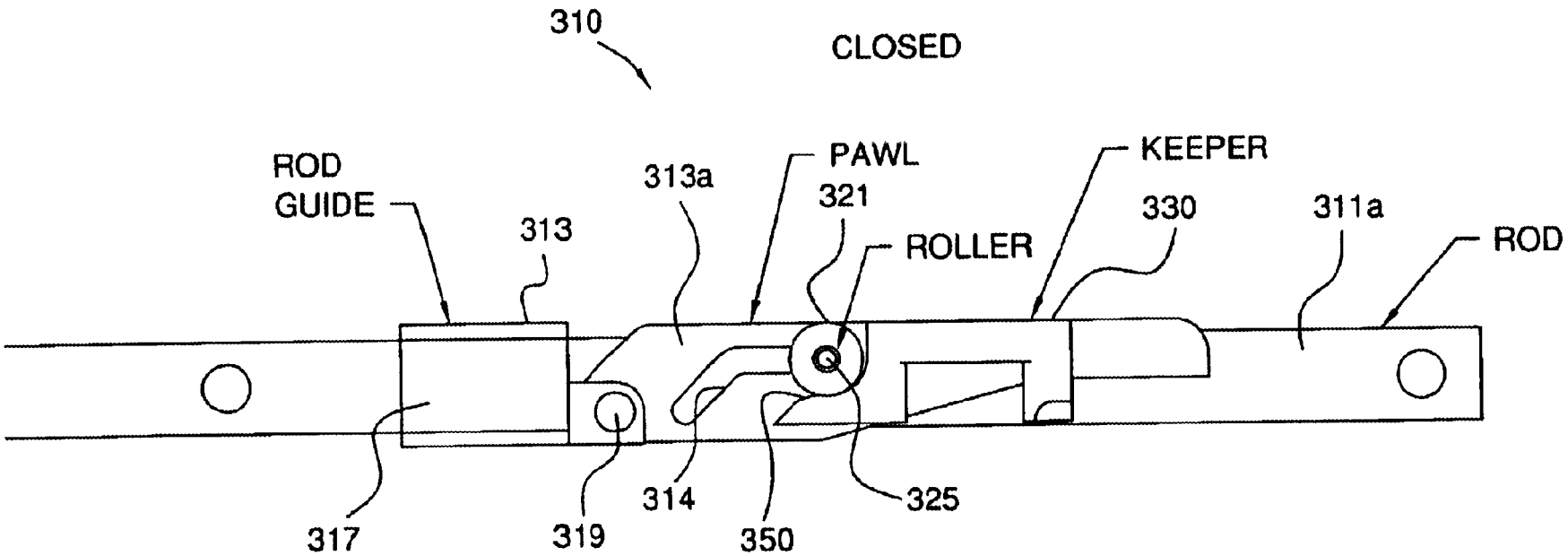

FIG. 12*e* is a right side elevation view of the fifth alternate embodiment of a multi-point latching system according to the present invention, shown in a fully closed position.

Figure 13:
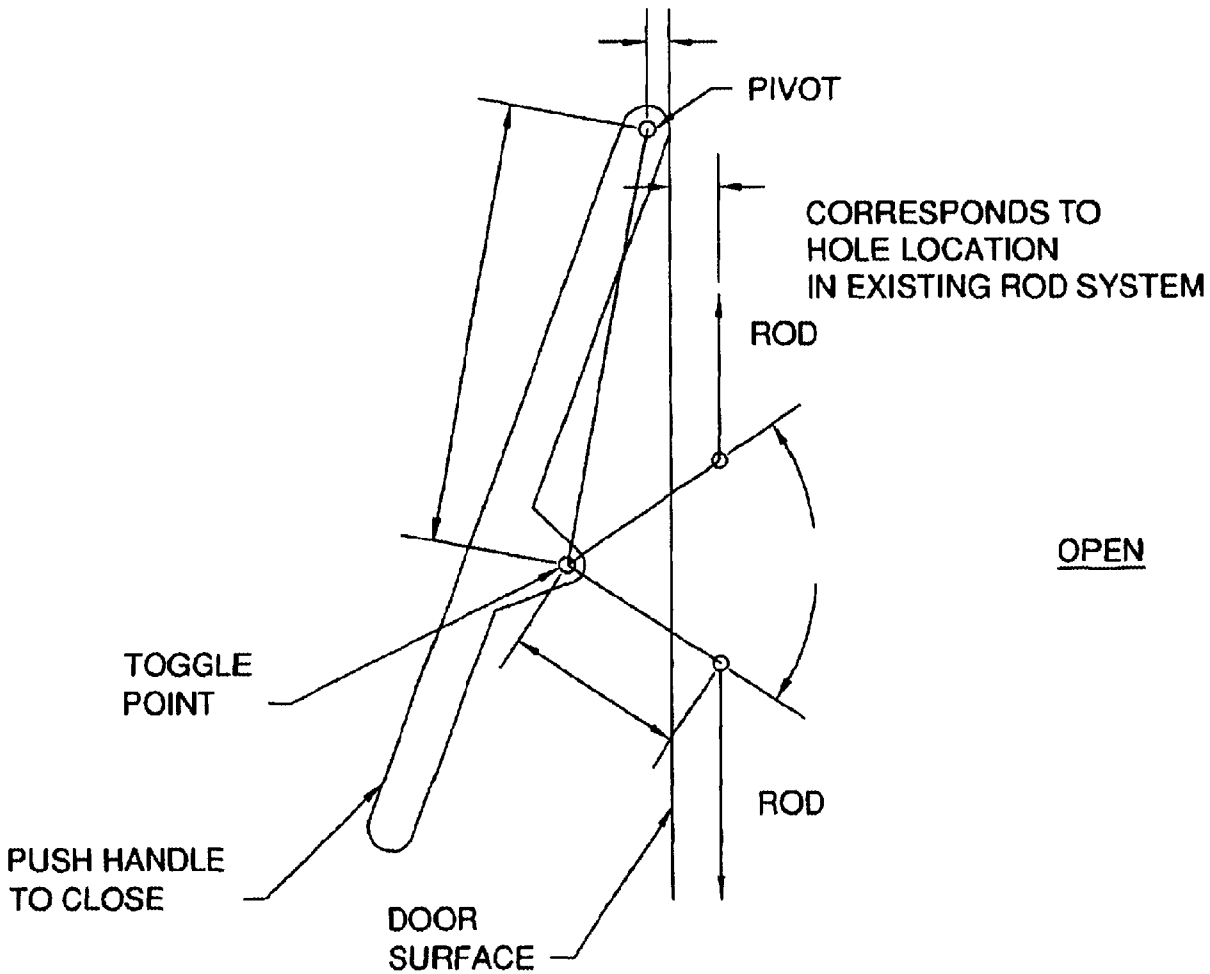

FIG. 13 is a right side elevation view of a second alternate embodiment of an actuator for use with the multi-point latching system according to the present invention, shown in the open position, with the latch system components being represented in schematic format and shown in relation to a door surface.

Figures 14A, 14B, 14C:
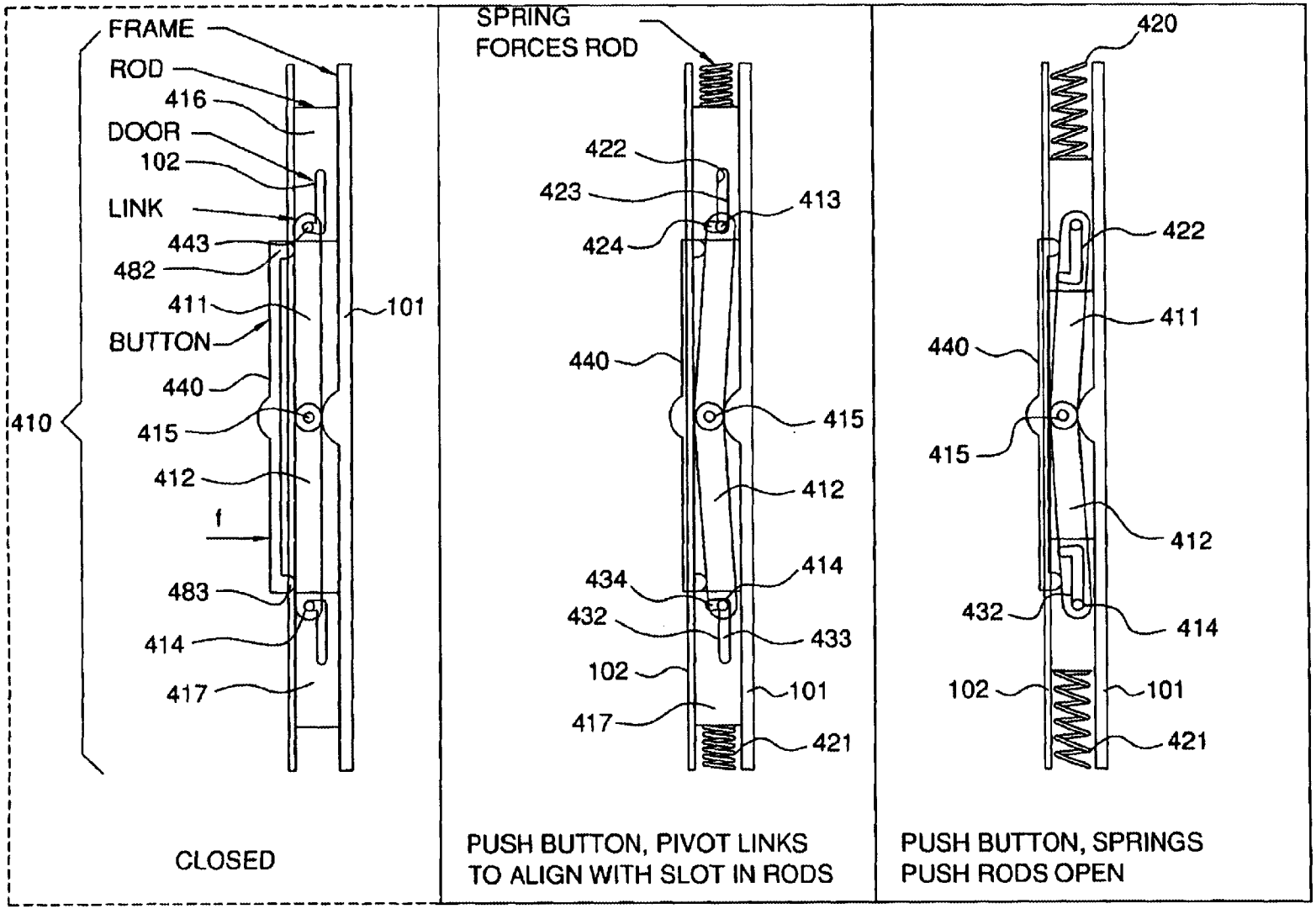

FIG. 14*a* is a left side elevation view of a third alternate embodiment of an actuator according to the present invention, shown in the fully closed position.

FIG. 14*b* is a left side elevation view of a third alternate embodiment of an actuator according to the present invention, shown in the first intermediate position.

FIG. 14*c* is a left side elevation view of a third alternate embodiment of an actuator according to the present invention, shown in the second intermediate position.

Figures 14D, 14E:
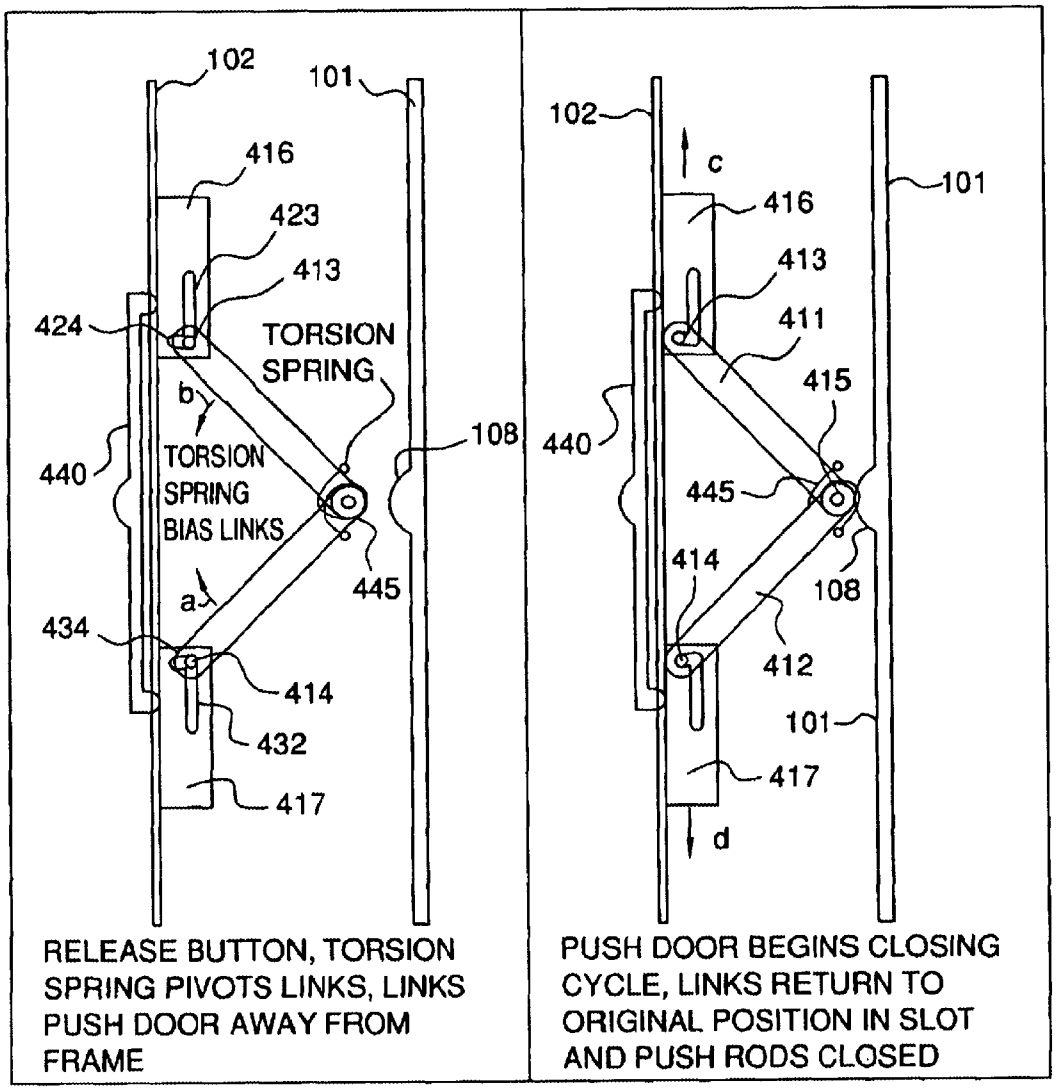

FIG. 14*d* is a left side elevation view of a third alternate embodiment of an actuator according to the present invention, shown in the fully open position.

FIG. 14*e* is a left side elevation view of a third alternate embodiment of an actuator according to the present invention, shown in the start of the closing cycle position.

Figures 15A, 15B, 15C, 15D:
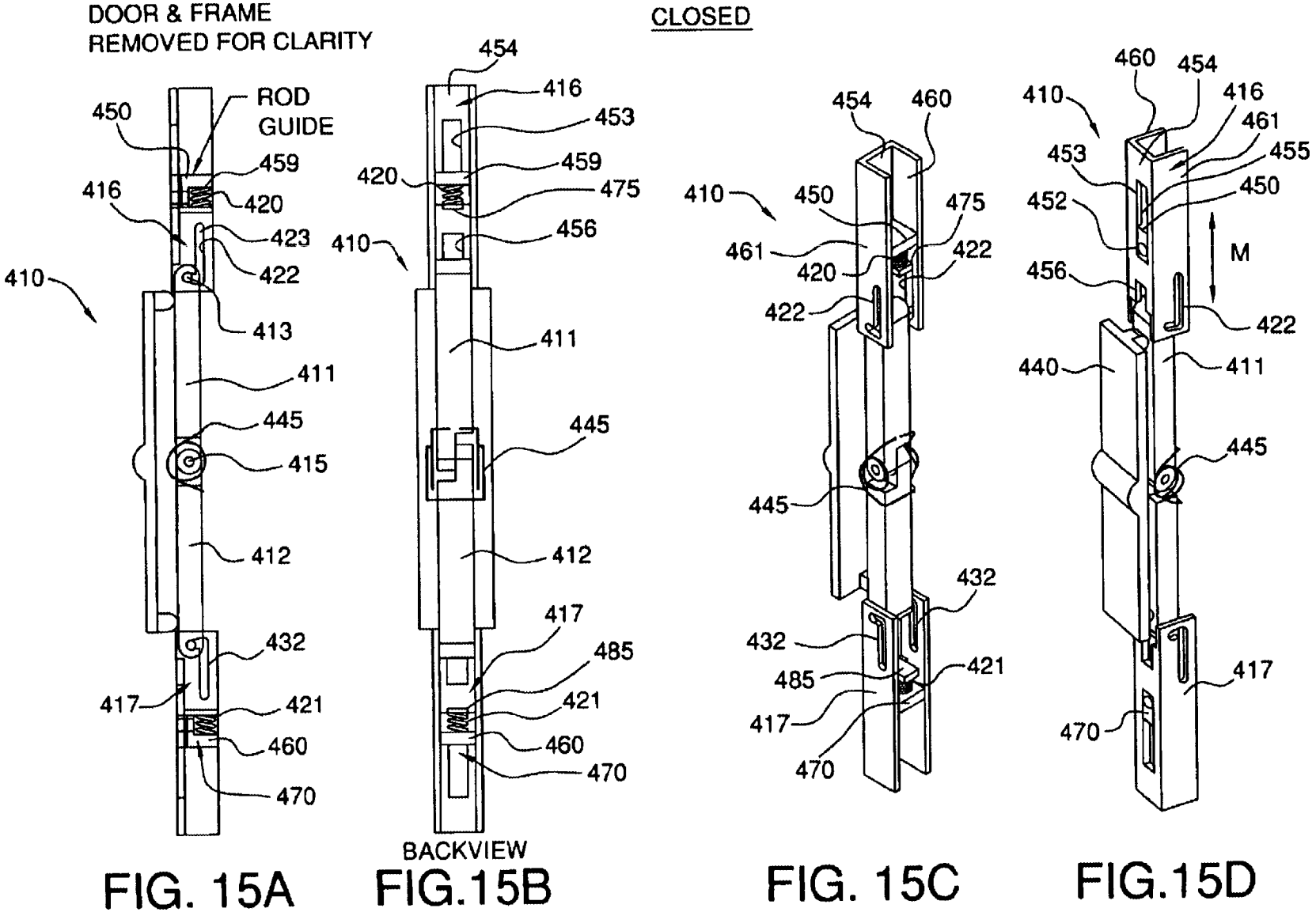

FIG. 15*a* is a left side elevation view of the third alternate embodiment of an actuator, shown in the closed position, according to the present invention shown in FIGS. 14*a* through 14*e*, but with the rod guide installed.

FIG. 15*b* is a rear elevation view of the third alternate embodiment of an actuator, shown in the closed position, according to the present invention shown in FIGS. 14*a* through 14*e*, but with the rod guide installed.

FIG. 15*c* is a perspective view shown from the back of the third alternate embodiment of an actuator, shown in the closed position, according to the present invention shown in FIGS. 14*a* through 14*e*, but with the rod guide installed.

FIG. 15*d* is a perspective view shown from the front of the third alternate embodiment of an actuator, shown in the closed position, according to the present invention shown in FIGS. 14*a* through 14*e*, but with the rod guide installed.

FIGS. 16*a* through 16*d* shows the third embodiment of an actuator according to the present invention, as appears in FIGS. 14*a* through 14*e* and FIGS. 15*a* through 15*d*, but showing the views of FIGS. 15*a* through 15*d* corresponding to FIGS. 16*a* through 16*d*, but in the open position.

Figures 17A, 17B, 17C:
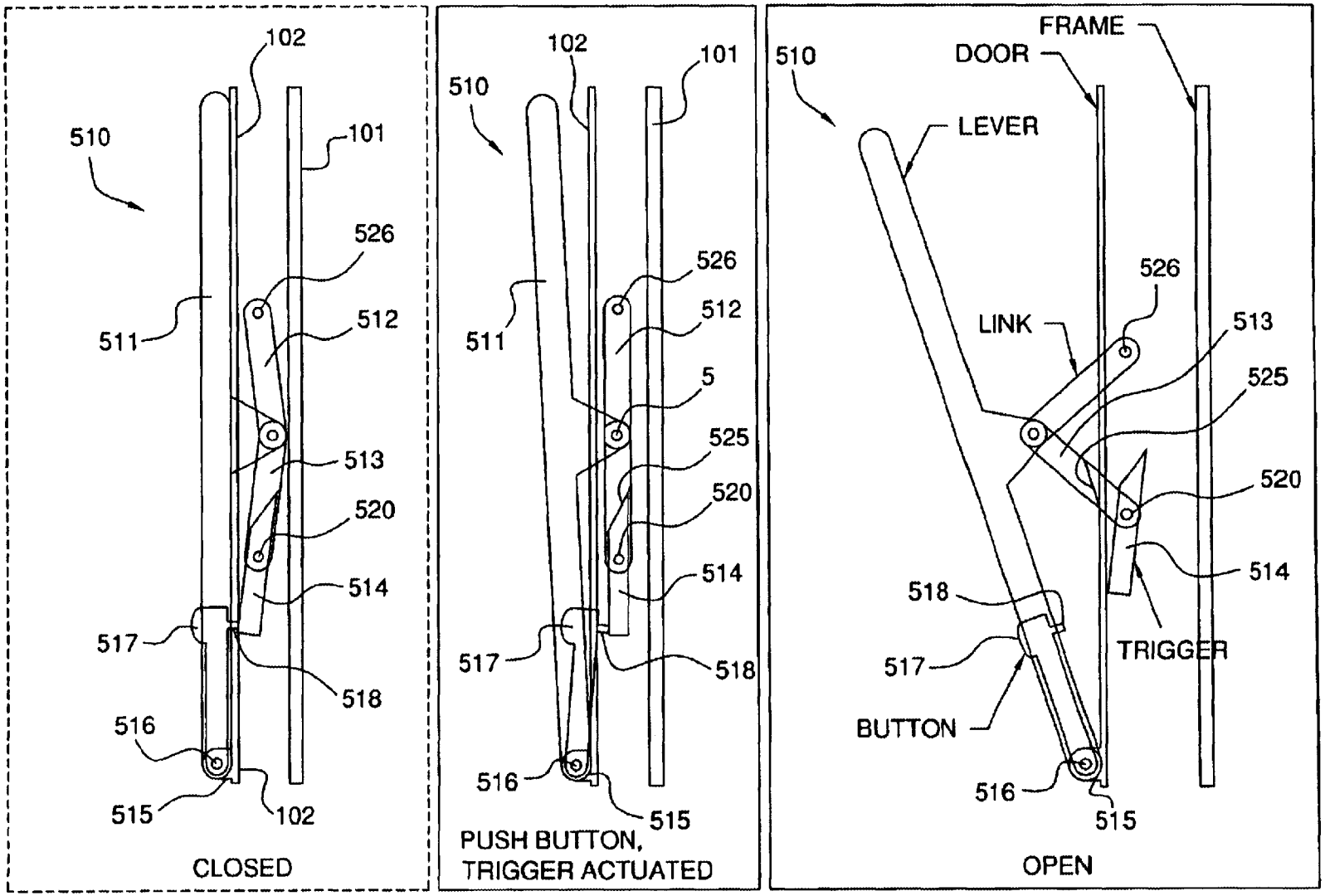

FIG. 17*a* is a left side elevation view of a fourth alternate embodiment of an actuator according to the present invention, shown in the closed position.

FIG. 17*b* is a left side elevation view of a fourth alternate embodiment of an actuator according to the present invention, shown with the latch in the trigger-actuated position.

FIG. 17*c* is a left side elevation view of a fourth alternate embodiment of an actuator according to the present invention, shown in the open position.

Figure 18A:
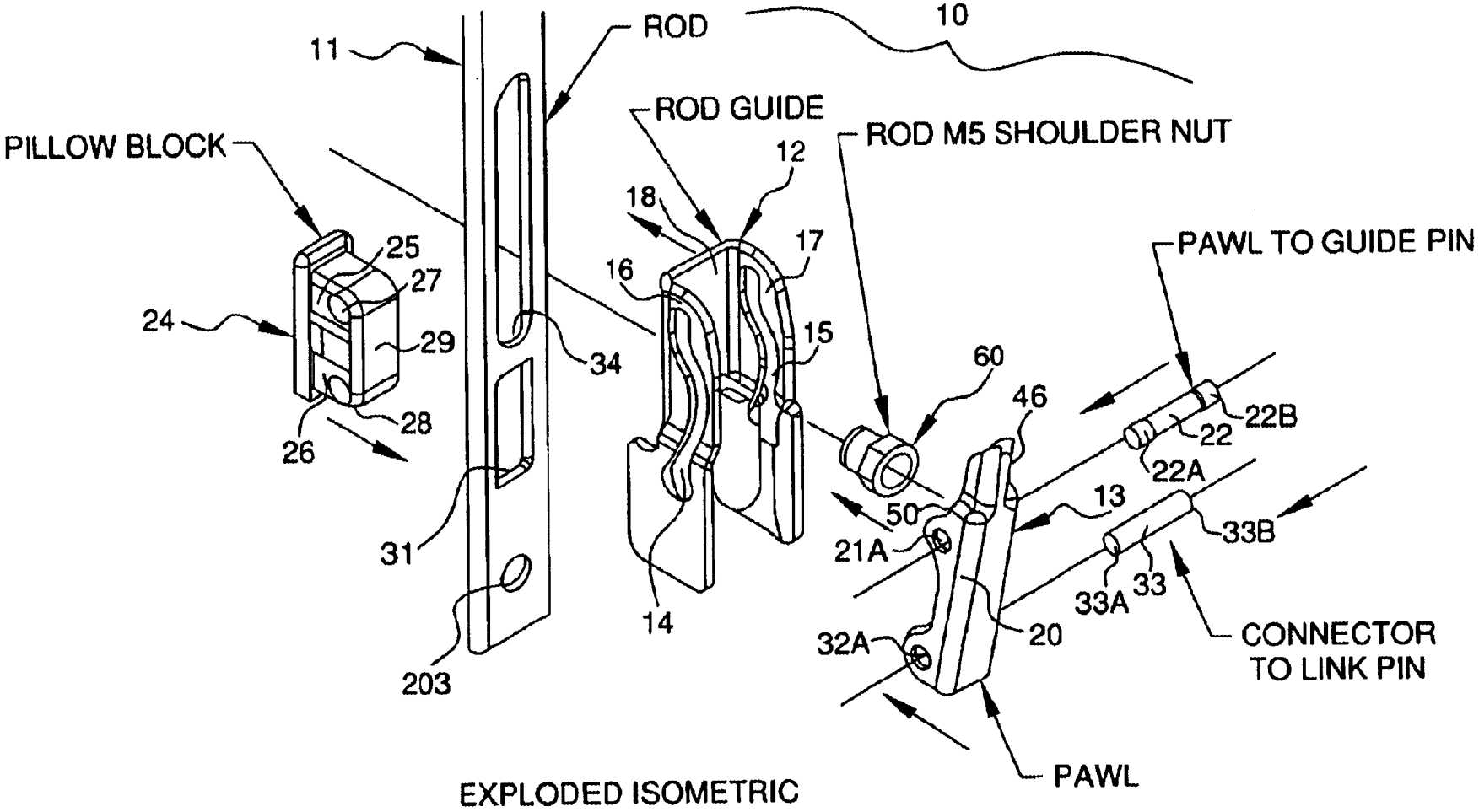
Figure 18B:
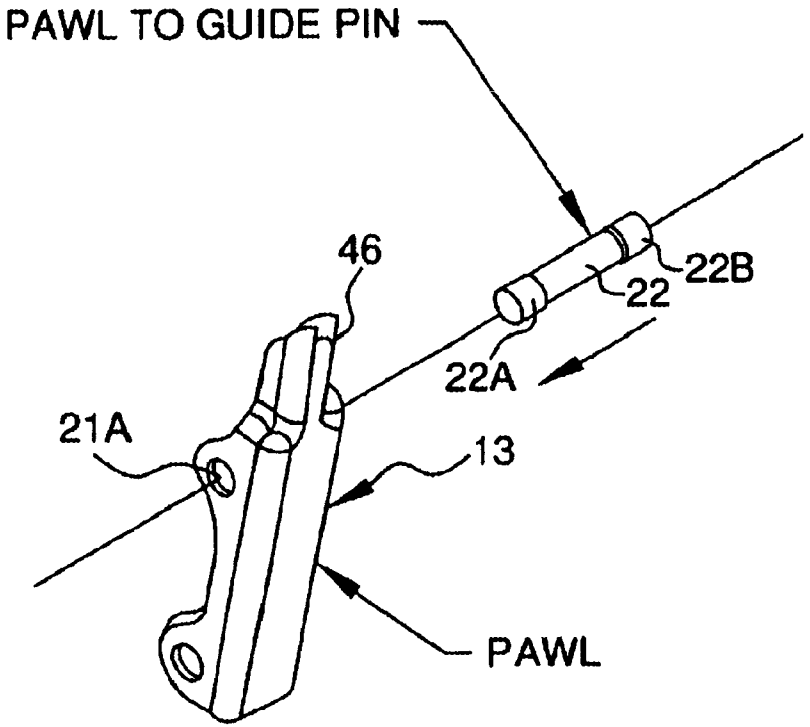

FIG. 18*a* is an exploded view of a sixth alternate embodiment of a multi-point latching system according to the present invention FIG. 18*b* is a perspective view of the pawl of the multi-point latching system of FIG. 18*a*.

Figure 18C:
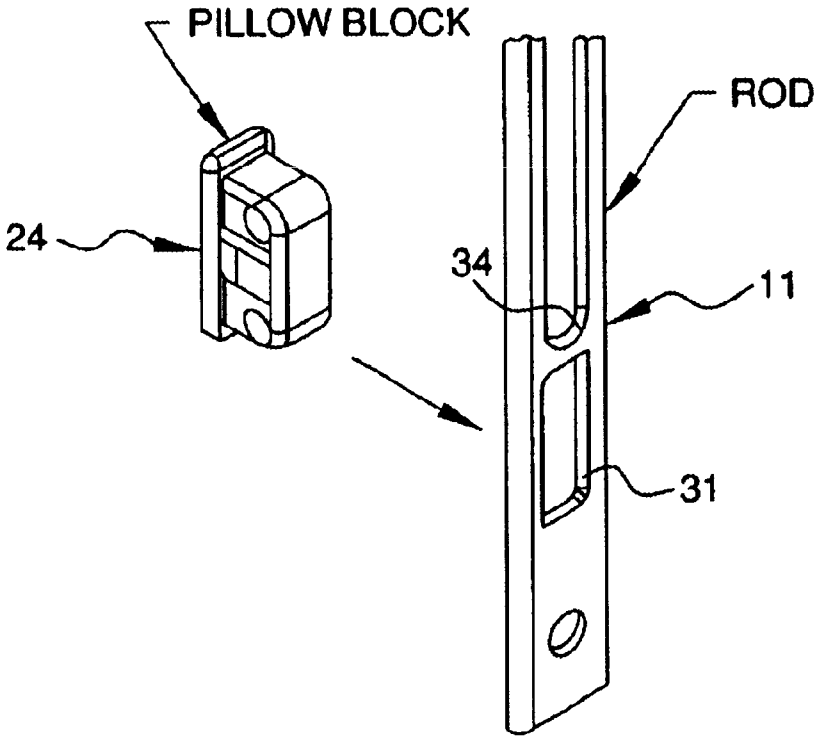

FIG. 18*c* is a perspective view of the pillow block and rod of the multi-point latching system of FIG. 18*a*.

Figure 18D:
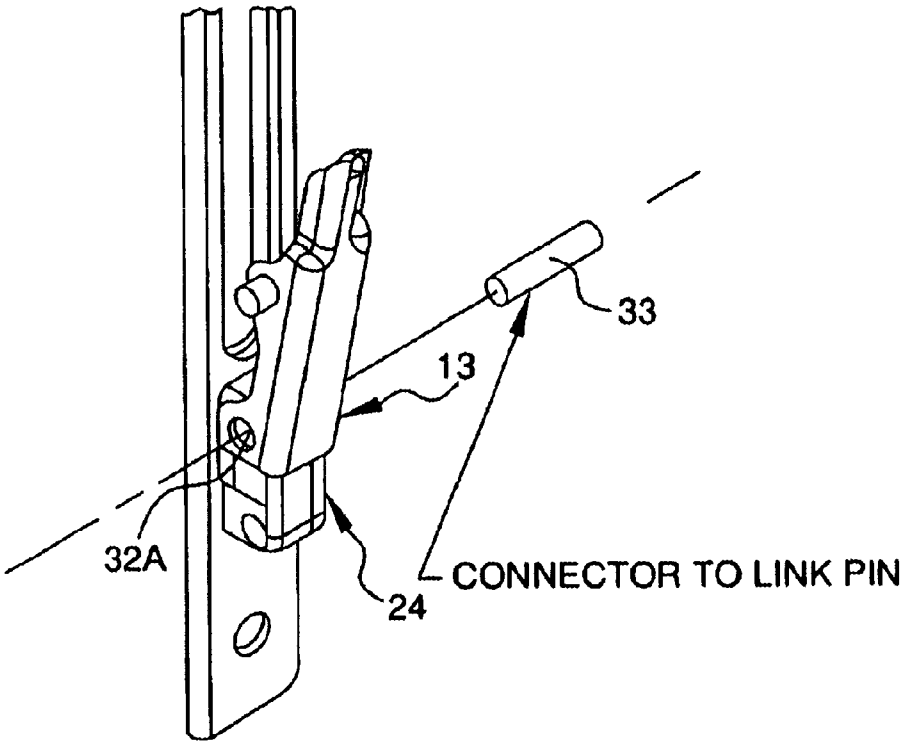

FIG. 18*d* is a perspective view of the pawl and pillow block assembled onto the rod of the multi-point latching system of FIG. 18*a*.

Figure 18E:
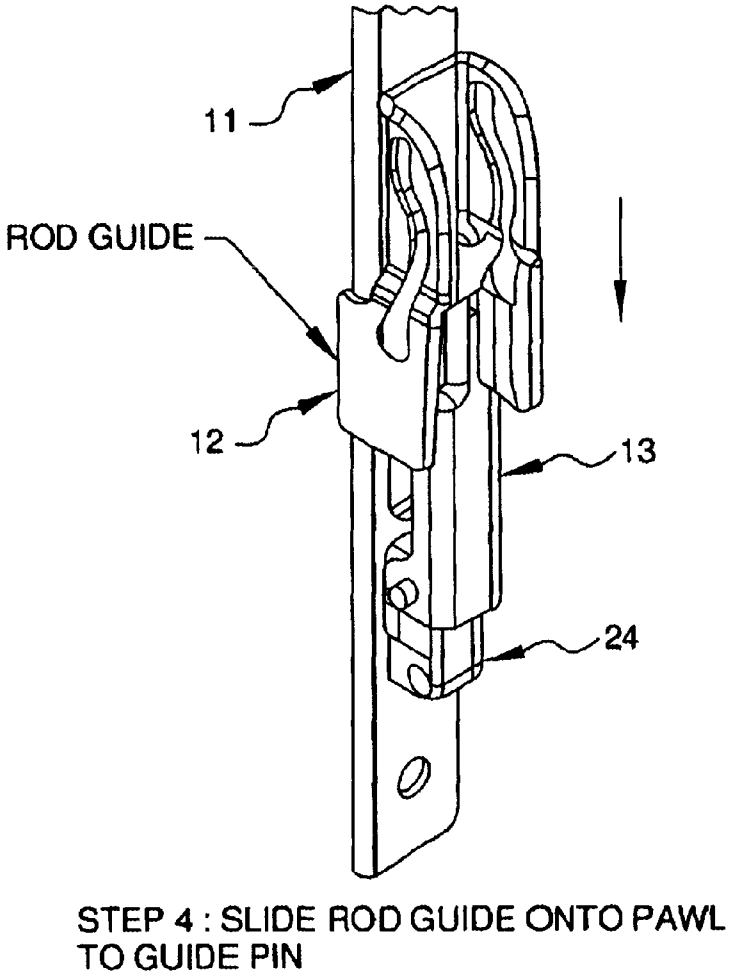

FIG. 18*e* is a perspective view of the rod guide assembled onto the rod of the multi-point latching system of FIG. 18*a*.

Figure 18F:
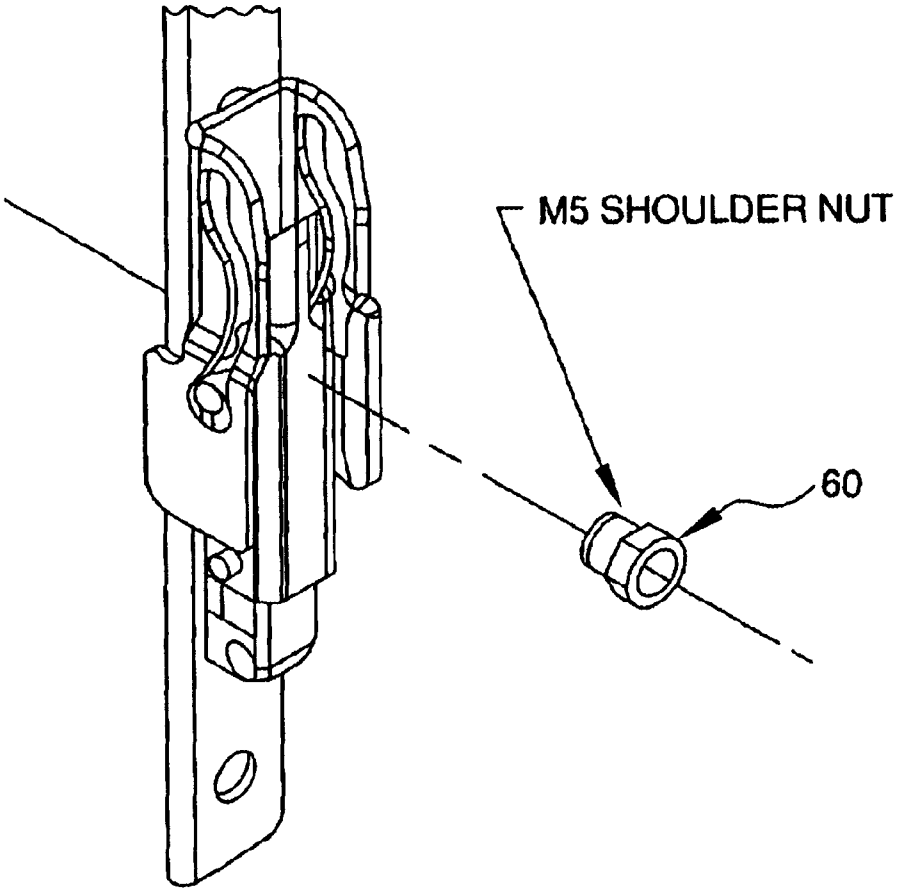

FIG. 18*f* is a perspective view of the shoulder nut of the multi-point latching system of FIG. 18*a*.

Figure 18G:
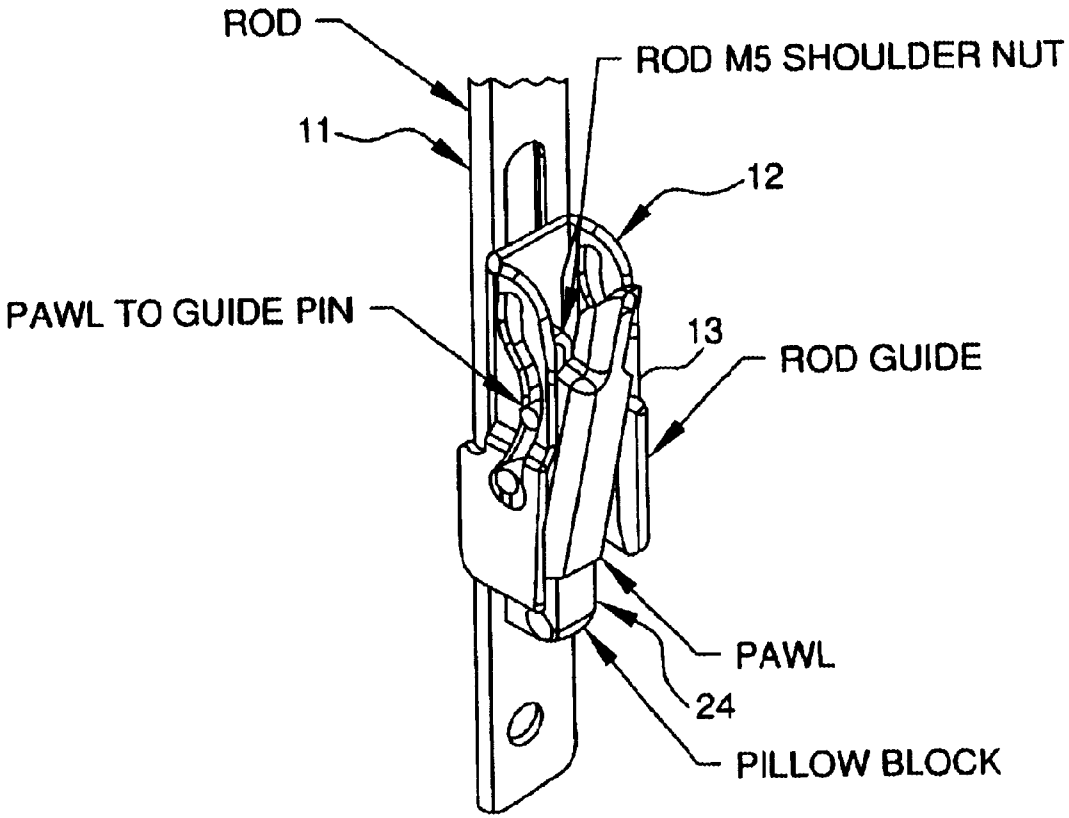

FIG. 18*g* is a perspective view of the assembled multi-point latching system of FIG. 18*a*.

Figure 18H:
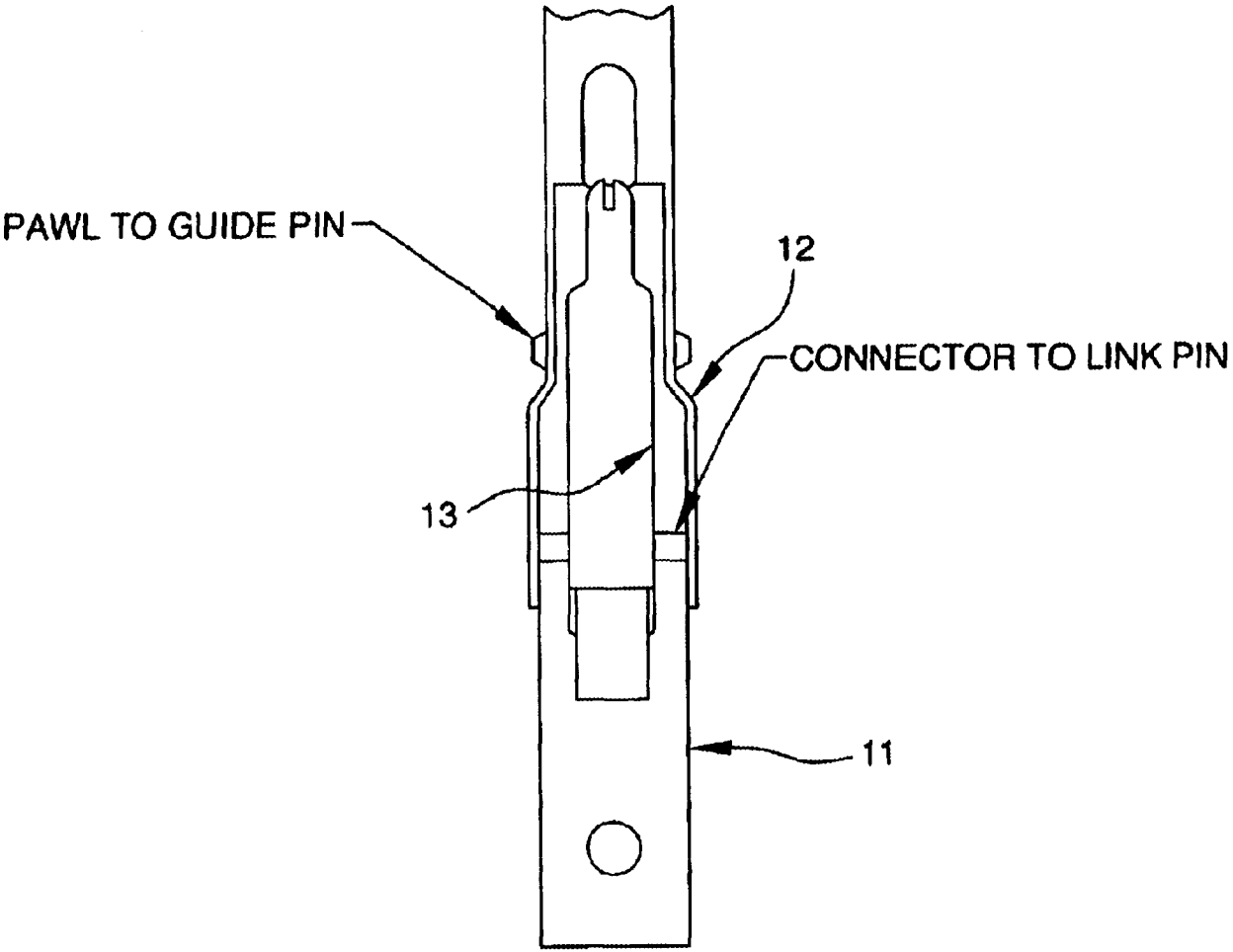

FIG. 18*h* is a front view of the assembled multi-point latching system of FIG. 18*a*.

Figure 19:
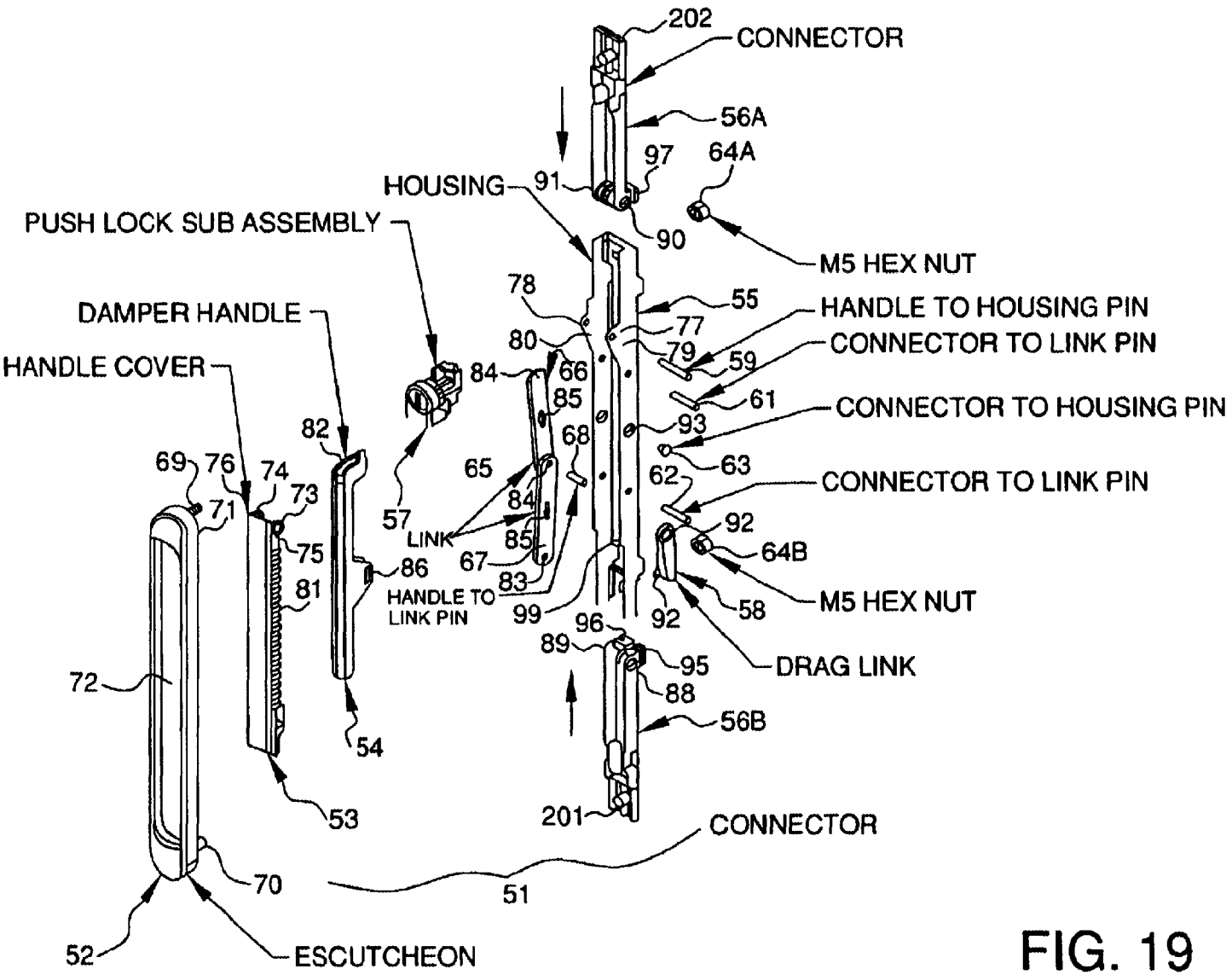

FIG. 19 is an exploded view of a fifth embodiment of an actuator assembly for use with the multi-point latching system according to the present invention.

Figure 20B:
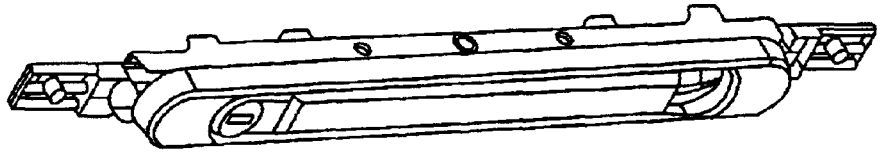
Figure 20A:
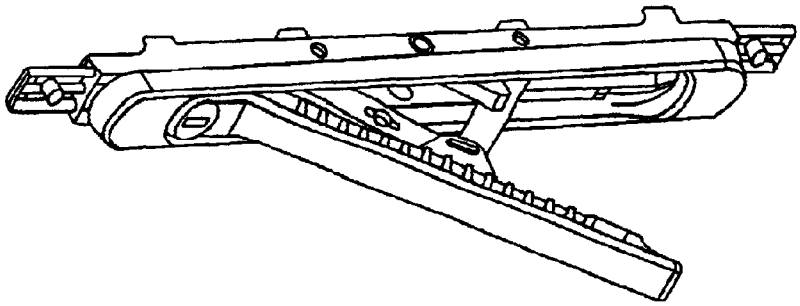

FIG. 20*a* is a perspective view of the fifth embodiment of an actuator assembly of FIG. 19, assembled and shown in the open position.

FIG. 20*b* is a perspective view of the fifth embodiment of an actuator assembly of FIG. 19, assembled and shown in the closed position.

DETAILED DESCRIPTION OF THE PREFERRED EMBODIMENTS

Figure 1:
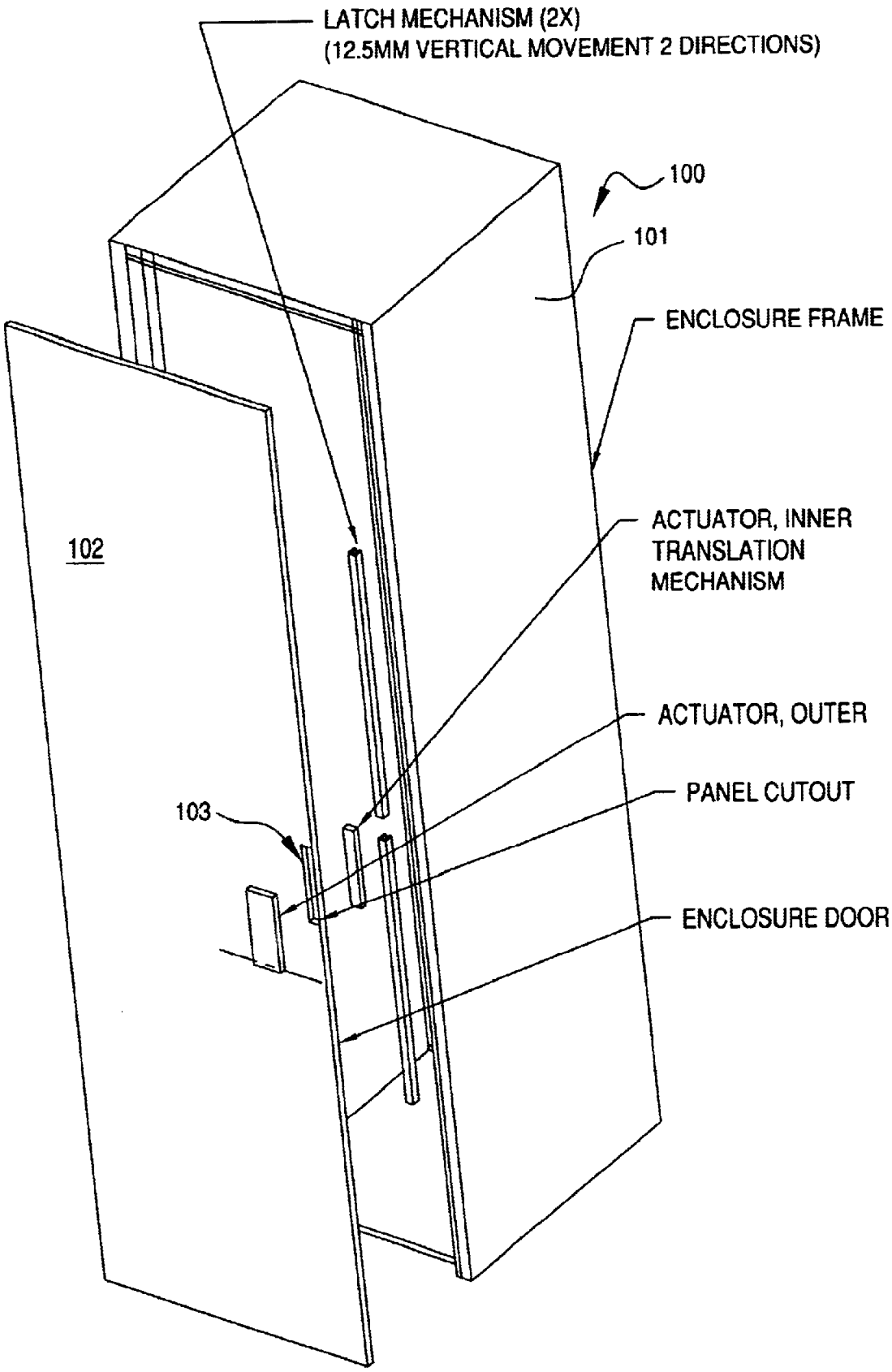
FIG. 1 is a perspective view showing a schematic representation of an enclosure cabinet and door panel with which the multi-point latch system of the present invention can be used.

Referring to FIG. 1, a cabinet enclosure 100 is shown comprising a cabinet enclosure frame 101 an enclosure door panel 102 with a panel cut out 103 disposed therein. The cabinet enclosure 100 is shown with schematic representations to indicate the latch mechanism, actuator (outer), and actuator (inner translation mechanism).

Figure 2:
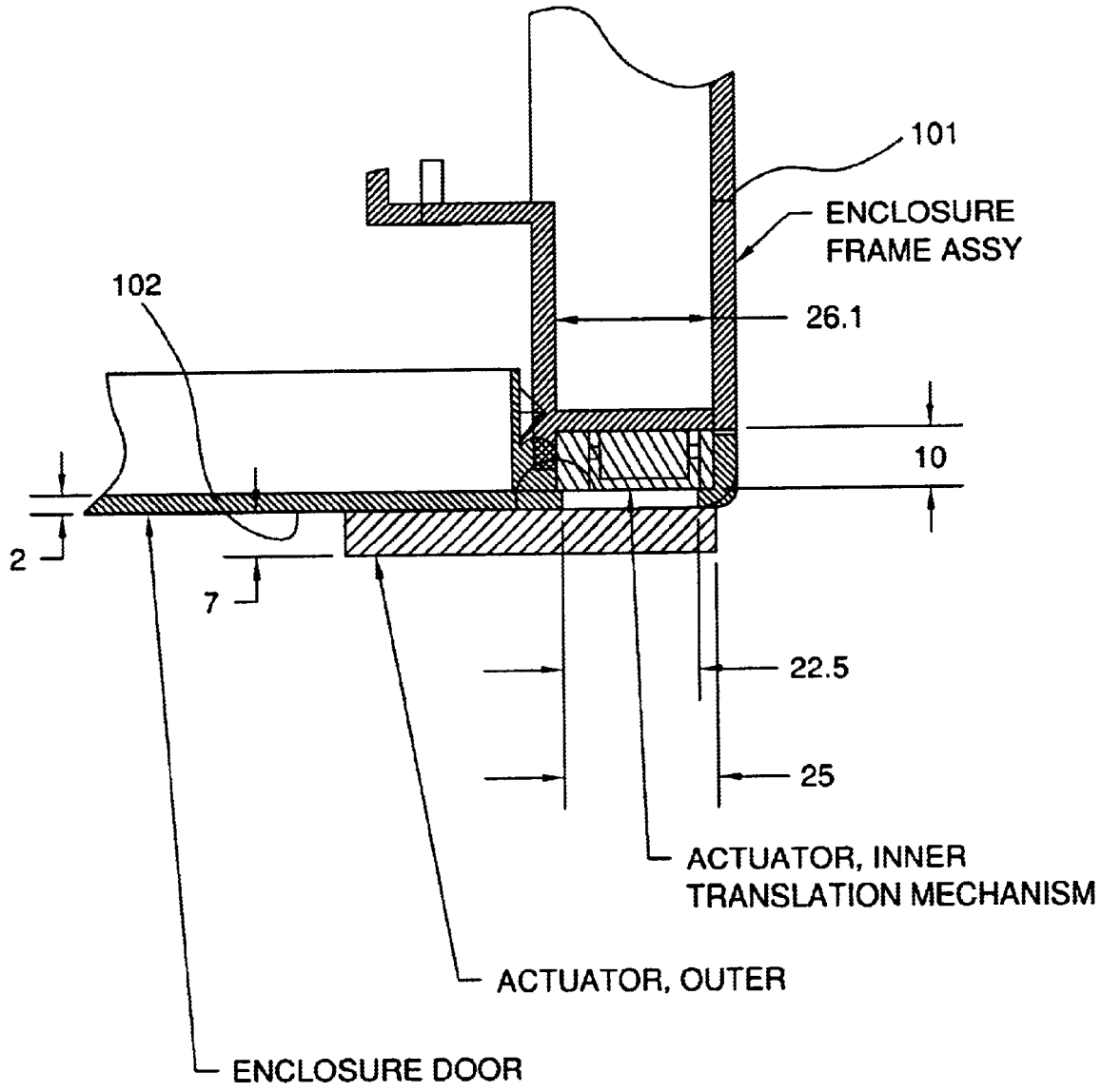
FIG. 2 is a cross sectional view of the door panel and enclosure frame taken cross sectionally through the door and enclosure frame of FIG. 1 in the latching area.

FIG. 2 shows the enclosure door 102 in a closed position engaging against the enclosure frame 101 with the multi-point latch system according to the present invention being represented schematically by an actuator (outer) and an actuator (inner translation mechanism).

Referring now to FIG. 3*a*, a preferred embodiment 710 of a multi-point latch system according to the present invention is shown comprising a rotatable pawl 713 mounted to a translating rod 711 so that the pawl 713 translates with the rod 711 and freely rotates with respect to said rod 711. The rod 711 is mounted on a door panel such as the enclosure door 102 shown in FIG. 1, by a fixed rod guide shell 712 and a rod guide insert 812. The fixed rod guide shell 712 is mounted to the door panel 102. The fixed rod guide shell 712 (as further illustrated in FIG. 3*b*) is shown having a first boss slot 714 and a second boss slot 715 disposed respectively in opposing flanges 716, 717 which extend upwardly from the base 718 of the rod guide shell 712. The rod guide insert 812 further comprises a pair of living hinges 813, 816 located on opposite sides of a base 818. A connector hole 860 is included in said base 818. A pair of flanges 819, 820 extends from each living hinge 813, 816 respectively. The pair of flanges 819, 820 are further described as such: disposed in each flange 819, 820 is a cam slot 814, 815 respectively. Furthermore, a pair of tabs 821, 822 extend from the upper portions of flanges 819, 820. A pair of legs 823, 824 (leg 824 not shown) extend from the lower portions of flanges 819, 820. A pair of bosses 827, 828 (boss 828 not shown) extend from the middle portions of flanges 819, 820. A pair of indent grooves 825, 826 are disposed in the inner lower portions of flanges 819, 820.

FIG. 3*a* further shows the pawl 713, which has a body portion 720 with a pair of cam pinholes 721*a*, 721*b* (721*b* not shown) bored on opposite lateral sides of the pawl body 720. The first and second cam pinholes 721*a*, 721*b* of the pawl 713 are provided to accept a guide pin 722, such that the ends of the guide pin 722 will extend outwardly once inserted in the pinholes 721*a*, 721*b*. The resulting first and second ends 722*a*, 722*b* of the guide pin 722 of the pawl 713 are provided to ride, respectively, in cam slots 814, 815 of the rod guide insert 812 to control the motion of the pawl 713 during actuation of the multi-point latch system 710. The multi-point latch system 710 further includes a pillow block 724 which has mounting means for mounting to the rod 711, and includes a pair of flanges 725, 726 with holes 727, 728 disposed in the respective flanges 725, 726, and a connecting arm 729 to connect the flanges 725, 726. The rod 711 is provided with a first notch 731 for facilitating mounting of the pillow block 724 thereto. The pawl 713 further includes a pivot member 733, shown preferably comprising first and second pivot pin ends 733*a*, 733*b* which extend outwardly on opposite lateral sides of the pawl body 720, once it is inserted in link holes 732*a*, 732*b* (732*b* not shown) in pawl 713, for pivotal mounting of the pawl 713 with the pillow block 724.

FIGS. 3*c* through 3*h* further show the step-by-step procedure of assembling the pawl 713 with the rod 711. In step 1, shown in FIG. 3*c*, the pillow block 724 is snapped into the first notch 731 of the rod 711. In step 2, illustrated in FIG. 3*d*, the pivot member 733 is shown connecting the pawl 713 to the pillow block 724 through link holes 732*a*, 732*b* (732*b* not shown) in pawl 713, and into hole 727 of the pillow block 724. In step 3, shown in FIG. 3*e*, the guide pin 722 is inserted into the pawl 713.

In step 4, best seen in FIG. 3*f*, the rod guide insert 812 is first shown in its open position. Next, the rod guide insert 812 is folded along the pair of living hinges 813, 816. Then, the rod guide insert 812 is inserted into the rod guide shell 712. Bosses 827, 828 of the rod guide insert 812 mount into boss slots 714, 715 of the rod guide shell 712 respectively. Also, tabs 821, 822 of the rod guide insert 812 engage tab slots 829, 830 of the rod guide shell 712 respectively. The rod guide insert 812 mounts into the rod guide shell 812 such that front edges 831, 832 of the flanges 819, 820 respectively of the rod guide insert 812 rests along the inner portion of the front wall guides 833, 834 of the rod guide shell 712, respectively. Additionally, legs 823, 824 of the rod guide insert 812 mount into leg rests 835, 836 located on opposing flanges 716, 717 of the rod guide shell 712, respectively.

In step 5, best seen in FIG. 3*g*, the rod guide shell 712, with the inserted rod guide insert 812, is slidably mounted onto the rod 711, and over pawl 713. Step 6 shown in FIG. 3*h*, shows a shoulder nut 760 being inserted through the connector hole 860 of the rod guide insert 812 and then through an eyelet 734 of the rod 711, and then it flares out, which allows for the rod assembly to be delivered to customers with all pieces of the assembly attached together.

FIG. 3*i* shows the assembled latch system 710 with the pieces of the assembly mounted together. Moreover, FIG. 3*j* shows the assembled latch system 710 from the front view with the pieces of the assembly mounted together.

The latch system 710 is operated from open to closed position, for example, by translating the rod 711 which translates the pawl 713 behind a keeper 30, shown in FIG. 4*a*, mounted on an enclosure frame such as the cabinet enclosure frame 101. The keeper 30 includes a body portion 41 having a locating boss 42 extending outwardly therefrom, a bolthole 47 for securing the keeper 41 onto the enclosure frame 101, and a pair of flanges 43, 44, which extend downwardly from said body 41. The pair of flanges 43, 44 each further comprising a pinhole 48*a*, 48*b*, which accept a roller pin 49. The roller pin 49 further comprises two pin ends 49*a*, 49*b* located opposite each other. A roller 45 is disposed between the keeper flanges 43, 44. The roller pin 49 connects the roller 45 with the keeper 30. The roller 45 is positioned for engagement with the arm 746 (shown in FIG. 3*a*) of the pawl 713. FIG. 4*b* further shows the keeper 30 assembled with the roller 45 connected, and the roller pin end 49*a* protruding outwards from the flange 43 of the keeper 30. FIG. 4*c* further shows the bottom view of the keeper 30 along with the roller 45, with the locating boss 42 shown protruding outwards, along with pin ends 49*a*, 49*b* also extending outwards.

The pawl 713 engages the keeper 30 as the pawl arm 746 moves into further engagement with the keeper 30, with the end of the arm 746 moving beyond the roller 45. It will be appreciated that the pillow block 724 and pawl 713 are provided narrower in relation to the rod guide shell 712 so that the pawl 713 and pillow block 724 can be positioned between the first and second flanges 716, 717, respectively, of the rod guide shell 712.

The multi-point latch system 710 is operated for closing by translating the rod 711 (not shown), which initially begins to translate the pawl 713 into position behind a keeper, such as the keeper 30, which is mounted on a corresponding frame 101. Further translation of the rod 711 causes the pawl 713 to both translate and rotate. This action begins to pull the door panel 102 into the frame 101. The final translation of the rod 711 continues to rotate and translate the pawl 713 behind the keeper 30 until the door panel 102 and frame 101 achieve their final closed position.

FIG. 5 is an exploded representation showing an actuator 751 for actuation of the multipoint latch system 710 shown and described herein. The actuator 751, also shown in the schematic representation of FIG. 1, can comprise an element located on a door panel, which the user can grip and, preferably lift, to cause the translation of the rod for releasing the pawl from a corresponding keeper. For example, the actuation element can include a linkage to facilitate translation of the rod when the actuator is lifted, slid or otherwise used by the user.

The actuator 751 comprises a bezel 752, which includes a pair of screw pegs 769, 770 located at opposite ends of the back wall 771 of the bezel 752. The screw pegs 769, 770 mount onto a housing 755, and are secured to said housing 755 by a pair of hex nuts 764*a*, 764*b*. The bezel 752 has an eyelet 772, which allows a handle cover 753 to extend therefrom. The handle cover 753, further shown in FIG. 6, comprises a pair of flanges 775, 776, which include a pair of slots 773, 774. The handle cover 753 further comprises a pair of snap brackets 901, 902 (902 not shown). The handle cover 753 connects to the housing 755 by rotatably mounting onto a housing pin 759, further comprising a knurl 959, wherein said housing pin 759 extends through a pair of housing pin slots 777, 778 located on a pair of flanges 779, 780 on the housing 755. The knurl 959 allows said housing pin 759 to be pressed into a handle 754.

The handle 754 is further shown in FIG. 7, which is fixably mounted to the back wall 781 of the handle cover 753. A pair of snap wings 903, 904 retain snap brackets 901, 902 respectively, in order to retain the handle 754 onto the handle cover 753. A U-shaped inner portion 782 of the handle 754 allows for enough space to house the connection with a link assembly 765, shown in FIG. 5. The link 765 further comprises a pair of identical separate links 766, 767, each comprising a pair of pinholes 783, 784, and a draglink hole 785. A link pin 768 connects link 766 with link 767, and both links 766, 767 with the handle 754. The link pin 768 extends through holes 786, 787 (787 not shown) on the handle 754, and through pinhole 784 of link 767 and pinhole 783 of link 766. Thus, the link assembly 765 is rotatably connected to the handle 754 by a link rivet 768 extending through the holes 786, 787 (787 not shown) of the handle 754.

The link assembly 765 is connected to connectors 756*a*, 756*b* by a connector link pin 762, which extends through pinhole 783 of link 767, and through connector holes 788, 789 of the connector 756*b* and by a connector link pin 761, which extends through pinhole 784 of link 766, and through connector holes 790, 791 of the connector 756*a*.

Connectors 756*a*, 756*b* are slidably attached to housing 755 by means of connector slots 795, 796, 797, and 798 (798 not shown) engaging housing ribs 799 and 950 (950 not shown). Connector lugs 975, 976 of connectors 756*a*, 756*b* engage holes 903 in rod 711. Rotation and translation of handle 754 causes rotation of links 766, 767, which in turn causes translation of connectors 756*a*, 756*b*.

Link 766 and link 767 each further comprise a drag link hole 785 located in the center of the links 766, 767. A draglink 758, which comprises a pair of extending arms 792, 992, where arm 992 is inserted through a hole 793 in the housing 755, and then is swedged. This allows the draglink 758 to rotate within the housing hole 793, without translating out from the housing hole 793. The extending arm 792 extends through the drag link hole 785 of link 767, which ensures both links 766, 767 and therefore both connectors 756*a*, 756*b*, move equally in substantially the same motion. A lock assembly 757 is also included for allowing for the locking and unlocking of the actuator 751.

FIG. 8*a* shows the handle cover 753 being installed on the handle 754 as the last step in the assembly process, while FIG. 8*b* shows the actuator 751 fully assembled and in the closed position, and FIG. 8*c* shows the actuator 751 fully assembled and in the open position.

Referring to FIG. 9*a*, a second alternate embodiment 610 of a multi-point latching system according to the present invention is shown comprising a rotatable pawl 613 mounted to a translating rod 611 so that the pawl 613 translates with the rod 611 and freely rotates with respect to said rod 611. The rod 611 is mounted on a door panel such as the enclosure door 102 shown in FIG. 1, by a fixed rod guide 612. The fixed rod guide 612 is mounted to the door panel 102. The fixed rod guide 612 is shown having a first cam slot 614 and a second cam slot 615 disposed respectively in opposing flanges 616, 617, which extend upwardly from a base 618 of the rod guide 612.

The pawl 613 has a body portion 620 with a pair of cam pins 621, 622 extending outwardly on opposite lateral sides of the pawl body 620. The first and second cam pins 621, 622 of the pawl 613 are provided to ride, respectively, in the cam slots 614, 615 of the rod guide 612 to control the motion of the pawl 613 during actuation of the multi-point latching system 610. The multi-point latching system 610 further includes a connecting arm 624 which has mounting means for mounting to the rod 611, and includes a pair of flanges 625, 626 with slots 627, 628 disposed in the respective flanges 625, 626. The rod 611 is provided with a first notch 631 for facilitating mounting of the connecting arm 624 thereto. The pawl 613 further includes a pair of pivot members, shown preferably comprising first and second pivot pins 632, 633 which extend outwardly on opposite lateral sides of the pawl body 620 for pivotal mounting of the pawl 613 with the connecting arm 624.

The latch system 610 is operated from an open to a closed position, for example, by translating the rod 611, which translates the pawl 613 behind a keeper 630 mounted on an enclosure frame such as the cabinet enclosure frame 101. As shown in FIGS. 9*b* and 9*c*, the elements of the multi-point latching system 610 are assembled with the rod 611 being installed on a cabinet enclosure door panel 102 with the rod guide 12. The first cam pin 621 of the pawl 613 is shown disposed in a first cam slot 614 of the rod guide 612. The first pawl pivot pin 632 is shown disposed in the first slot 627 of the connecting arm 624. A keeper 630 is mounted to a cabinet enclosure frame 101. As shown in FIG. 9*a*, the keeper includes a body portion 641 having a locating boss 642 extending outwardly therefrom and a pair of flanges 643, 644 which extend downwardly from said body 641. A roller 645 is disposed between the keeper flanges 643, 644. As shown in FIG. 9*b*, the roller 645 is positioned for engagement with the arm 646 of the pawl 613.

Referring to FIG. 9*d*, the relative positions of the pawl 613 and keeper 630 are shown as the pawl arm 646 moves into further engagement with the keeper 630, with the end of the arm 646 moving beyond the roller 645. Referring to FIG. 9*e*, it will be appreciated that the connecting arm 624 and pawl 613 are provided narrower in relation to the rod guide 612 so that the pawl 613 and connecting arm 624 can be positioned between the first and second flanges 616, 617, respectively, of the rod guide 612. Referring to FIGS. 9*f* and 9*g*, the latch system 610 is shown in a closed position, with the roller 645 of the keeper 630 engaging the ramped portion 650 of the pawl 613.

The multi-point latching system 610 is operated for closing by translating the rod 611, which initially begins to translate the pawl 613 into position behind a keeper, such as the keeper 630 shown in FIGS. 9*a–f*, which is mounted on a corresponding frame 101. Further translation of the rod 611 occurs and causes the pawl 613 to both translate and rotate. This action begins to pull the door panel 102 into the frame 101. The final translation of the rod 611 (such as from the FIG. 9*d* position to the FIG. 9*e* position) forces a ramped portion 650 of the pawl 613 to ride up the keeper roller 645.

Referring to FIGS. 10*a–g*, a third alternate embodiment of a multi-point latching system 110 is shown. The third alternate embodiment 110 is provided similar to the second alternate embodiment 610, however, the cam slots 614, 615 are not used and the rod guide 112 is provided with ramped surface 114, 115 disposed on each lateral side thereof The ramped surfaces 114, 115 facilitate pivoting of a pawl 113 using a cantilever action.

As shown in FIG. 10*a*, the third alternate embodiment of the multi-point latch system 110 has a rod 111, which is attached to a door, such as the door panel 102 with the rod guide 112 (FIG. 10*d*). a pawl pin 119 is provided to pivotally connect the pawl 113 to the rod 111. The rod 111 is shown having apertures 170, 171 disposed on opposite side walls 172, 173 thereof to maintain the pawl pin 119. A keeper 130 is shown similar to the keeper 630 shown in the second embodiment, including a roller 145, which is secured to a pair of flanges 143, 144 of the keeper 130 with a roller pin 149.

Referring to FIG. 10*b*, the closing motion of the multi-point latching system 110 is similar to the second embodiment of the multi-point latching system 610, except that during the second phase (from FIG. 10*b* to the closed position at FIG. 10*d*) the bottom end of the pawl 113 rides up the ramped surfaces 114, 115 of the rod guide 112. This action cantilevers the top of the pawl 113 inwardly, toward the door 102, and pulls the door 102 into engagement with the frame 101. Upon opening of the door panel 102 to which the latch 110 is installed, protrusions 128, 129, which are disposed on the pawl 113 interface with the rod guide 112 and push the pawl 113 into its open position (FIGS. 10*b* and 10*d*). The pawl can be released from the keeper 130 by translating the rod 111 with a suitable actuator member (not shown). Preferably, the actuator is linked to the rod 111 through the door panel 102 to facilitate movement thereof to open the latch 110.

A fourth alternate embodiment of a multi-point latching system 210 according to the present invention is shown in FIGS. 11*a* through 11*d*. The multi-point latching system 210 is shown comprising a pawl 213 rotatably mounted to a fixed rod guide 212. A translating rod 211 has a cam pin 221, which extends through one of a plurality of apertures 222 disposed in the rod 211. The cam pin 221, resides in a pair of cam slots 214, 215 disposed on opposite flanges 216, 217, respectively of the pawl 213. As the rod 211 translates, the cam pin 221 translates with the rod and moves along the cam slots 214, 215 of the pawl 213 to rotate the pawl 213 relative to the rod 211.

The rod guide 212 is connected to the pawl 213 and includes a slot 218 for receiving the rod 211 there through.

The pawl member 213 further has mounting means, shown comprising a first mounting boss 232 and a second mounting boss 233 disposed on opposite sides of the pawl on each pawl flange 216, 217, respectively (FIG. 11*b*). The rod guide 212 has a pair of fingers 225, 226 with receiving means, such as, for example, the apertures 227, 228 disposed in each finger 225, 226, respectively, for receipt of the respective first and second pawl mounting bosses 232, 233 therein. The rod guide 212 is adapted to be mounted to a door, such as the enclosure door 102 shown in FIG. 1.

A keeper 230 is also provided, and preferably, has mounting means for mounting the keeper 230 to a corresponding enclosure frame, such as the frame 101 shown in FIG. 1. The keeper mounting means can comprise a mounting aperture 241 through which a bolt or other suitable mounting member such as a rivet, screw or the like (not shown), can extend to secure the keeper 230 to an enclosure frame 101. The keeper 230 preferably has a space 270 defined between the floor 242 of the keeper 230 and a lower element 243, which extends below the floor 242. The space 270 accommodates the free end of the pawl member when the multi-point latching system 210 is closed.

As shown in FIGS. 11*c* and 1*d*, the latch 210 is in the open position (FIG. 11*c*) and moves to the closed position (FIG. 11*d*) by first pushing the door 102 then translating the rod 211 until the pawl 213 is fully secured by the keeper 230. To close the latch 210, the door 102 is pushed shut so that the pawl 213 initially contacts the keeper 230, thereby starting the translation of the rod 211. Further translation of the rod 211 continues to pivot the pawl 213 into a position parallel with the rod 211, pulling the door 102 against the frame 101. The pawl cam slots 214, 215 facilitate rotation of the pawl 213 by providing a significant pawl rotation at the beginning of the closing motion and significant mechanical advantage to compress the pawl 213 against the keeper 230, after the rod 211 has traveled. The configuration of the cam slots 214, 215, which disposed on the pawl 213 facilitate an increase in the gasket compression force as the door is closed.

A fifth alternate embodiment of a multi-point latching system 310 is shown in FIGS. 12*a* through 12*e*. The multi-point latching system 310 is shown comprising a rod 311 having a first section 311*a*, and a second section 311*b*, a rod guide 312, a pawl 213 with a first pawl component 313*a* and a second pawl component 313*b*, a roller 321 and a keeper 330. As shown best in FIG. 12*b*, the rod guide 312 includes a pair of tracks 316, 317 disposed on opposite sides of the rod guide 312 for facilitating movement of the rod 311 there along. Pivot bosses 318, 319 are disposed on opposite sides of the rod guide 312 (FIG. 12*b*).

The pawl 313 has a first element 313*a* and a second element 313*b* with cam slots 314, 315 disposed respectively in each pawl element, 313*a*, 313*b*. Connecting means, such as the apertures 322, 323 are provided respectively in the first pawl element 313*a* and second pawl element 313*b* with a corresponding respective pivot boss 318, 319 of the rod guide 312. The roller 321 is provided with cam pins 324, 325 extending outwardly at each axial end thereof The cam pins 324, 325 are received in a pawl cam slot 314, 315, respectively, for movement therein when the latch 310 is opened and closed.

As shown in FIG. 12*c*, the pawl 330 is in an opening position where it is beginning to engage the keeper 330 to start the latching cycle. The rod roller 321 is shown secured to the rod first section 311, with the first cam pin space 324 of the roller 321 being disposed in a first aperture 341 of the first pawl part 313*a* (FIG. 12*b*). The second cam pin 325 is disposed in a second aperture 342 of the rod second section 311*b* (FIGS. 12*a*, 12*b*). Referring again to FIG. 12*c*, the second roller cam pin 325 is shown at the lower end of the first cam slot 314 of the first pawl part 313*a*. Further translation of the rod 311 rotates the pawl 313 to a substantially horizontal position relative to the rod 311 as indicated in FIG. 12*d*. Further translation of the rod 311 causes the rod roller 321 to climb up a ramp 350 of the keeper 330 to facilitate latching of the multi-point latching system 310.

It will be understood that any suitable mounting means such as screws, bolts, rivets and the like can be used to secure the rod guide 312 to a door panel such as that 102 shown in FIG. 1. The rod guide 312 preferably, includes a mounting aperture 349 through which a bolt, screw, rivet or the like may extend to fixedly attach the rod guide 312 to a mounting surface. Thus, the first and second rod sections 311*a*, 311*b*, are disposed for movement along the tracks 316, 317, respectively, of the fixed rod guide 312. The keeper 330 has mounting means for facilitating mounting to a mounting surface, such as to the enclosure frame 101 shown in FIG. 1. The mounting means can comprise a mounting aperture 352 to which can facilitate mounting of the keeper 330 with bolts, screws, rivets and/or the like.

FIG. 13 is a schematic representation showing the toggle type mechanism serving as a second alternate embodiment of an actuator for actuation of the multi-point latching system embodiments 610, 110, 210, and 310 shown and described herein. The actuator, also shown in the schematic representation of FIG. 1, can comprise an element located on a door panel, which the user can grip and, preferably lift, to cause the translation of the rod for releasing the pawl from a corresponding keeper. For example, the actuation element can include a linkage to facilitate translation of the rod when the actuator is lifted, slid or otherwise used by the user.

FIGS. 14*a* through 14*e* show a third alternate embodiment of an actuator 410 in use installed on a closure panel, such as, for example, the door panel 102 with a corresponding frame 101 to which the door panel 102 can be swingably attached. The actuator 410 is shown comprising a pair of linking members 411, 412. Each linking member 411, 412 has one end connected to the other linking member and a cam pin 413, 414 disposed respectively in each opposite end of each linking member 411, 412. The linking members 411, 412 are joined at one end thereof for pivotal movement about an axis with a connecting member 415. Rod means shown comprising a first rod element 416 and a second rod element 417 are mounted to the door 102 with mounting means for maintaining sliding movement of the first rod 416 and second rod 417 relative to the door panel 102. These rods transfer the actuation motion to the multi-point latch system rods 611, etc. Preferably, a first spring element 420 and a second spring element 421 are provided to bias the respective first rod 416 and second rod 417 inwardly toward the linking members 411, 412. The first rod member 416 has a first cam slot 422, which preferably comprises a first or vertical component 423 and a second horizontal component 424. Preferably, the second horizontal component 424 is provided less than at an angle less than 90° relative to the first component portion 423. The first cam pin 413 is shown disposed in the first cam slot 422 of the first rod element 416.

Similarly, the second rod element 417 includes a second cam slot 432, which is identical to the first cam slot 422 and includes a first vertical component 433 and a second horizontal and slightly angular component 434. The second cam pin 414 carried by the second linking member 412 is disposed in the second rod element cam slot 432.

The cam pins 413, 414 of each respective linking member 411, 412, travel through the respective cam slots 422, 432, as shown in the series of FIGS. 14*a* through 14*e* when the latch system 410 is operated. The latch 410 is opened by the depression of the actuation button 440. The button 440 is depressed inwardly in the direction of arrow F (FIG. 14*a*). When this occurs, the first linking member 411 and second sinking member 412 are moved slightly away from the door panel 102, at each end thereof, which carries the respective first cam pin 413 and second cam pin 414. As shown in FIG. 14*b*, this movement aligns the cam pins 413, 414 with the respective vertical component 423, 433 of a respective cam slot 422, 432. When the cam pins 413, 414 are aligned with the respective vertical slot components 423, 433, the bias exerted by the first spring element 420 and second spring element 421 operate to drive the first rod element 416 and second rod element 417, respectively, inwardly toward each other, as shown in FIG. 14*c*. This movement of the rod elements 416 and 417 inwardly releases a pawl (not shown) from a corresponding keeper (also not shown). Preferably, as shown in the previous embodiments in Figure series 1, 2, 9 through 12 above, the pawl member can be attached to a rod member such as either or both 416, 417, for translational movement so that it engages a corresponding keeper member, which can be installed in the frame 101. In addition, the pawl may be installed so that it also moves along a cam slot, as shown in the previous embodiments so that it is both translated and rotated when the first rod element 416, or the second rod element 417, (or both) is moved.

A torsion spring 445 is provided to bias the first linking member 411 and second linking member 412 toward each other as shown by arrows "a" and "b" in FIG. 14*d*. This is done to facilitate alignment of the first cam pin 413 with the angular component 424 of the first cam slot 423, and similarly to align the second cam pin 414 with the angular component 434 of the second cam slot 432. The torsion spring 445 action facilitates the alignment of the first and second linking members 411, 412 so that when the door 102 is being pushed closed, the linking members 411, 412 will engage the frame 101, as shown in FIG. 14*e*, and return the first rod element 416 and second rod element 417 to their closed positions, respectively by translating them along arrows "c" and "d" to return them from the open (FIG. 14*e*) position to the closed (FIG. 14*a*) position. Preferably, the enclosure cabinet 100 can have an engaging member such as the protrusion 108 shown in FIGS. 14*a*–14*e* provided on frame 101.

Referring to FIGS. 15*a* through 15*d*, the multi-point latching system 410 is shown with the detail of the rod guide 450, which has an end 459 against which the first spring 420 is biased and which has mounting means such as, for example, the mounting aperture 452 shown in FIG. 15*d*. The mounting aperture 452 is disposed in the rod guide 450 for facilitating mounting of the rod guide 450 to a door panel, such as the door 102 shown and described in connection with FIGS. 14*a* through 14*e* and above in FIGS. 1 and 2. The first rod member 416 is shown best in FIGS. 15*b* and 15*d* having a rectangular slot 453 disposed in a rear wall 454 thereof. The rectangular slot 453 permits the first rod element 416 to move along the guide portion 455 of the rod guide 450. The first rod guide 450 is fixably mounted to a door panel 102, whereas the first rod member 416 is provided for vertical movement in the direction of double arrow "m" (FIG. 15*d*) relative to the fixed rod guide 450.

The first rod element 416 further has a notched configuration 456 disposed in its rear wall to accommodate other elements of the latch 410, such as the first linking member 411 and the first engaging member 482 of the button 440 when the first rod element 416 is translated. The first rod element further is shown having a pair of side walls 460, 461 extending outwardly from the rear wall 454, at each side thereof in which the pair of opening cam slots 422 are disposed.

A second rod guide 470 is provided in association with the second rod element 417. Preferably, the second rod guide 470, is identical to that first rod guide 450, has an end 460 for biasing the second spring 421, and mounts and operates in the same manner as the first rod guide 450 does with respect to the first rod element 416, but in association with the second rod element 417. The second rod guide 470 has an end 469, which supports the second rod spring 421.

Figures 16A, 16B, 16C, 16D:
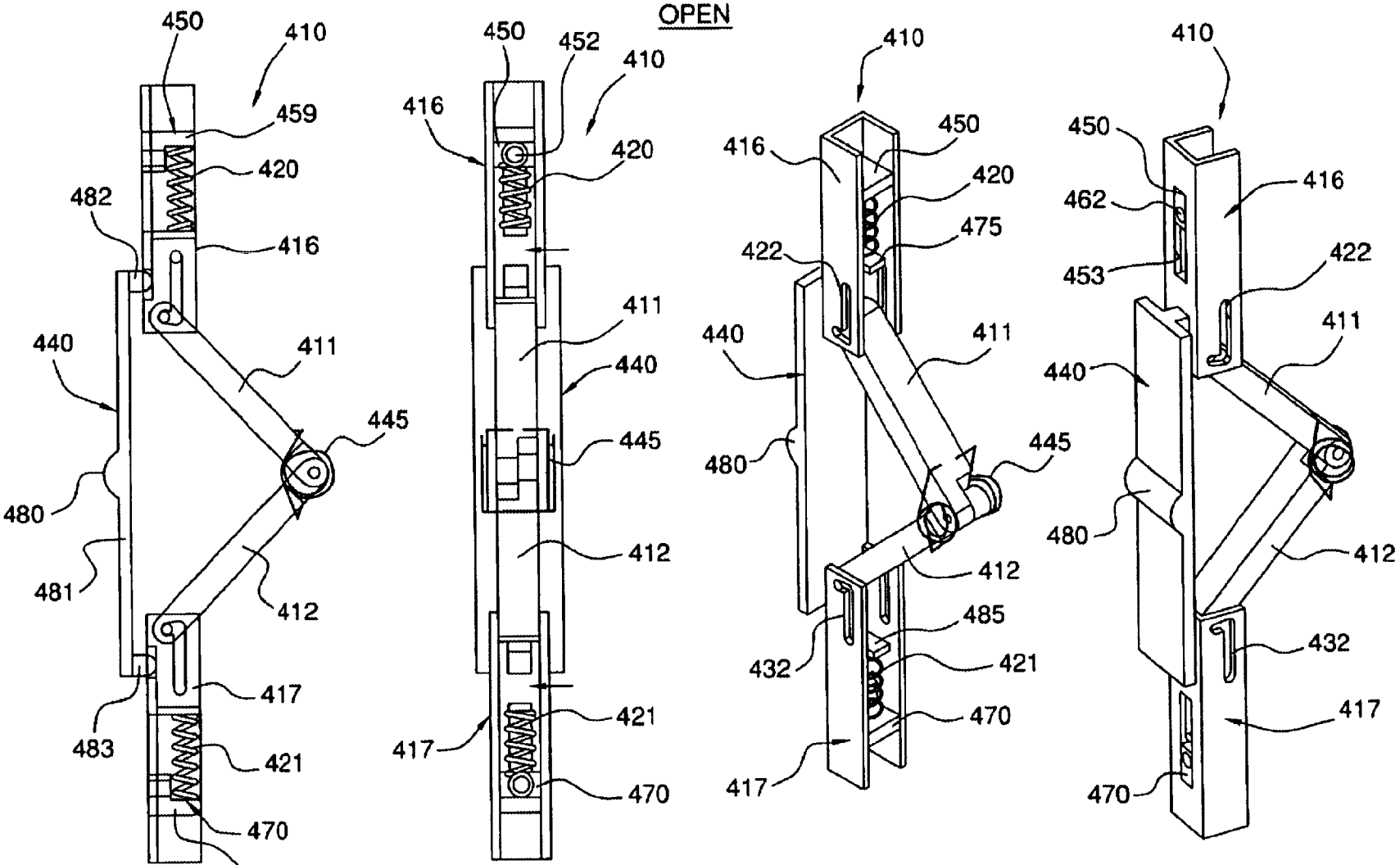

Referring to FIGS. 15*b*, 15*c* and 16*c*, the first rod element 416 has a spring engaging member 475 carried thereon against which the bias of the first spring 420 acts on when the first cam pin 413 is aligned with the vertical component 423 of the slot 422 of the first rod element 416. Similarly, a spring engaging member 485 is provided on the second rod element.

Preferably, as shown in FIGS. 15*c* and 15*d*, the first cam slots 422 are provided on the first wall 460 and second wall 461 of the first rod element 416. The cam pin 413 preferably extends so that it is received in each opposing first cam slot 422. Similarly, with respect to the second rod element 417, the second cam slots 432 are provided on opposite sides of the second rod element 417 so that the second cam pin 414 is disposed in both slots simultaneously.

FIGS. 16*a* through 16*d* show different views of the multi-point latch system 410 in an open position, with the first linking member 411 and second linking member 412 being angled toward each other and biased by the torsion spring element 445. The first spring member 420 and second spring member 421 are shown expanded and biasing the first rod element 416 and second rod element 417, respectively, inwardly in relation to one another.

The button 440 is shown having an actuating portion 480, a face 481, a first engaging element 482, and a second engaging element 483 for engaging, respectively, the first linking member 411 and the second linking member 412 when the button 480 is depressed. As shown in FIG. 14*b*, the first engaging element 482 and the second engaging element 483 engage with an end of a respective linking member 411, 412, and move the respective first linking member 411 and second linking member 412, rearwardly to the position shown in FIG. 14*b*. The bias from the first spring element 420 and second spring element 421 then operates to direct and translate the first rod element 416 and second rod element 417 inwardly toward each other, thus releasing a pawl which is carried on the rod member from a keeper (not shown in the Figures).

Reference now being made to FIGS. 17*a* through 17*c*, wherein a fourth alternate embodiment of an actuator 510 according to the present invention is shown comprising a lever 511, linking means comprising a first liking member 512 and a second linking member 513, and a trigger 514. The lever 511 is pivotally mounted at one end thereof to a door 102, such as, for example, with mounting means shown comprising the mounting bracket 515 and mounting pin 516, which pivotally secure an end of the lever 511. An actuation member, such as the button 517, is shown being pivotally mounted on the mounting bracket 515 coaxially with the mounting pin 516. The button 517 includes an arm 518 extending rearwardly therefrom and positioned to engage the trigger 514.

The trigger 514 is preferably pivoted around a trigger pivot pin 520 at the end of the second linking member 513.

The opposite end of the second linking member 513 is pivotally connected with an end of the first linking member 512 and is also connected with the lever 511. The trigger 514 is free to rotate clockwise about the trigger pin 520 axis so as not to interfere with the frame 101 on closing. A clockwise rotation of the trigger 514, however, engages the trigger 514 with the second linking member 513. Preferably, a flange or stop element 525 is provided on the second linking member 513 to permit the trigger 514 to move the second linking member 513. When the button 517 is depressed, the trigger 514 is engaged to push the second linking member 513 from its over center position to just on center or slightly past. This causes the lever 511 to pivot into a first open position (FIG. 17*b*) wherein the first rod element (not shown and second rod element (not shown) which are attached to the respective first linking member 512 and second linking member 513 remain essentially in their same position. Referring to FIG. 17*c*, as the lever 511 is rotated further open, the cam pins 520, 526 move toward each other, causing the rods to translate. The linking system shown in the fourth embodiment of the actuator 510 is provided to be used in conjunction with the rod members 611, etc. shown and described above.

Referring now to FIG. 18*a*, a sixth alternate embodiment 10 of a multi-point latch system according to the present invention is shown comprising a rotatable pawl 13 mounted to a translating rod 11 so that the pawl 13 translates with the rod 11 and freely rotates with respect to said rod 11. The rod 11 is mounted on a door panel such as the enclosure door 102 shown in FIG. 1, by a fixed rod guide 12. The fixed rod guide 12 is mounted to the door panel 102. The fixed rod guide 12 is shown having a first cam slot 14 and a second cam slot 15 disposed respectively in opposing flanges 16, 17 which extend upwardly from the base 18 of the rod guide 12.

The pawl 13 has a body portion 20 with a pair of cam pinholes 21*a*, 21*b* (21*b* not shown) bored on opposite lateral sides of the pawl body 20. The first and second cam pinholes 21*a*, 21*b* of the pawl 13 are provided to accept a guide pin 22, such that the ends of the guide pin 22 will extend outwardly once inserted in the pinholes 21*a*, 21*b*. The resulting first and second ends 22*a*, 22*b* of the guide pin 22 of the pawl 13 are provided to ride, respectively, in cam slots 14, 15 of the rod guide 12 to control the motion of the pawl 13 during actuation of the multi-point latch system 10. The multi-point latch system 10 further includes a pillow block 24 which has mounting means for mounting to the rod 11, and includes a pair of flanges 25, 26 with slots 27, 28 disposed in the respective flanges 25, 26, and a connecting arm 29 to connect the flanges 25, 26. The rod 11 is provided with a first notch 31 for facilitating mounting of the pillow block 24 thereto. The pawl 13 further includes a pivot member 33, shown preferably comprising first and second pivot pin ends 33*a*, 33*b* which extend outwardly on opposite lateral sides of the pawl body 20, once it is inserted in link holes 32*a*, 32*b* (32*b* not shown) in pawl 13, for pivotal mounting of the pawl 13 with the pillow block 24.

FIGS. 18*b* through 18*h* further show the step-by-step procedure of assembling the pawl 13 with the rod 11. In step 1, shown in FIG. 18*b*, the guide pin 22 is inserted into the pawl 13. In step 2, shown in FIG. 18*c*, the pillow block 24 is snapped into the first notch 31 of the rod 11. In step 3, illustrated in FIG. 18*d*, the pivot member 33 is shown connecting the pawl 13 to the pillow block 24 through link holes 32*a*, 32*b* (32*b* not shown) in pawl 13. In step 4, best seen in FIG. 18*e*, the rod guide 12 is slidably mounted onto the pawl 13. FIG. 18*f*, which details step 5, shows a shoulder nut 60 being inserted through the rod guide 12 and then through an eyelet 34 of the rod 11, and then it flares out, which allows for the rod assembly to be delivered to customers with all pieces of the assembly attached together. FIG. 18*g* shows the assembled latch system 10 with the pieces of the assembly mounted together. Moreover, FIG. 18*h* shows the assembled latch system 10 from the front view with the pieces of the assembly mounted together.

The latch system 10 is operated from open to closed position, for example, by translating the rod 11 which translates the pawl 13 behind a keeper 30, shown in FIG. 4*a* (and fully described above), mounted on an enclosure frame such as the cabinet enclosure frame 101. The roller 45 is positioned for engagement with the arm 46 (shown in FIG. 18*a*) of the pawl 13.

The pawl 13 engages the keeper 30 as the pawl arm 46 moves into further engagement with the keeper 30, with the end of the arm 46 moving beyond the roller 45. It will be appreciated that the pillow block 24 and pawl 13 are provided narrower in relation to the rod guide 12 so that the pawl 13 and pillow block 24 can be positioned between the first and second flanges 16, 17, respectively, of the rod guide 12.

The multi-point latch system 10 is operated for closing by translating the rod 11 (not shown), which initially begins to translate the pawl 13 into position behind a keeper, such as the keeper 30, which is mounted on a corresponding frame 102. Further translation of the rod 11 causes the pawl 13 to both translate and rotate. This action begins to pull the door panel 102 into the frame 101. The final translation of the rod 11 continues the rotation and translation of the pawl until the door 102 and frame 101 have achieved their closed position.

FIG. 19 is an exploded representation showing a fifth alternate embodiment of an actuator 51 for actuation of the multi-point latch system 10 shown and described herein. The actuator 51, also shown in the schematic representation of FIG. 1, can comprise an element located on a door panel, which the user can grip and, preferably lift, to cause the translation of the rod for releasing the pawl from a corresponding keeper. For example, the actuation element can include a linkage to facilitate translation of the rod when the actuator is lifted, slid or otherwise used by the user.

The actuator 51 comprises an escutcheon 52, which includes a pair of screw pegs 69, 70 located at opposite ends of the back wall 71 of the escutcheon 52. The screw pegs 69, 70 mount onto a housing 55, and are secured to said housing 55 by a pair of hex nuts 64*a*, 64*b*. The escutcheon 52 has an eyelet 72, which allows a handle cover 53 to extend therefrom. The handle cover 53 comprises a pair of flanges 75, 76, which include a pair of connector holes 73, 74. The handle cover 53 connects to the housing 55 by rotatably mounting onto a housing pin 59, which extends through a pair of housing pin holes 77, 78 located on a pair of flanges 79, 80 on the housing 55.

A handle 54 is shown in FIG. 19, which is fixably mounted to the back wall 81 of the handle cover 53. A U-shaped inner portion 82 of the handle 54 allows for enough space to house the connection with a link assembly 65. The link 65 further comprises a pair of identical separate links 66, 67, each comprising a pair of pinholes 83, 84, and a draglink hole 85. A link pin 68 connects link 66 with link 67, and both links 66, 67 with the handle 54. The link pin 68 extends through an eyelet 86, 87 (87 not shown) on the handle 54, and through pinhole 84 of link 67 and pinhole 83 of link 66. Thus, the link assembly 65 is rotatably connected to the handle 54 by a link pin 68 extending through the eyelet 86, 87 (87 not shown) of the handle 54.

The link assembly 65 is connected to connectors 56*a*, 56*b* by a connector link pin 62, which extends through pinhole 83 of link 67, and through connector holes 88, 89 of the connector 56*b* and by a connector link pin 61, which extends through pinhole 84 of link 66, and through connector holes 90, 91 of the connector 56*a*.

Connectors 56*a*, 56*b* are slidably attached to housing 55 by means of connector slots 95, 96, 97, and 98 (98 not shown) engaging housing ribs 99 and 200 (200 not shown). Connector lugs 201, 202 of connectors 56*a*, 56*b* engage holes 203 in rod 11. Rotation of handle 54 causes rotation of links 66, 67, which in turn causes translation of connectors 56*a*, 56*b*.

Link 66 and link 67 each further comprise a drag link hole 85 located in the center of the links 66, 67. A draglink 58, which comprises an extending arm 92, is rotatably mounted to the housing 55 by a draglink housing pin 63, which extends through link hole 93. The extending arm 92 extends through the drag link hole 85 of link 67, which ensures both links 66, 67 and therefore both connectors 56*a*, 56*b*, move equally in substantially the same motion. A lock assembly 57 is also included for allowing for the locking and unlocking of the actuator 51.

FIG. 20*a* shows the actuator 51 in the open position, while FIG. 20*b* shows the actuator 51 in the closed position.

These and other advantages of the present invention will be understood from reading the above summary of the invention, brief description of the drawing figures and detailed description of the preferred embodiments. The invention is to be construed in accordance with the description set forth herein.

What is claimed is:

1. A multipoint latch system for securing a first panel to a second panel, said multipoint latch system comprising:

a) a translating rod member comprising a plurality of notches;

b) a rod guide shell comprising a plurality of slots;

c) a rod guide insert comprising a plurality of cam slots;

d) a rotatable pawl member comprising a pawl arm and means for attaching said rotatable pawl member onto said rod guide; wherein said pawl member further comprises a pivot member;

e) a pillow block comprising means for mounting said pillow block to said translating rod member; wherein said pillow block further comprises holes for accepting said pivot member;

f) connecting means for attaching said rod guide to said rod member;

g) means for actuating said latch from an open to a closed position; wherein said means for actuating said latch from an open to a closed position comprises an actuator further comprising a bezel, a handle, a handle cover, a lock mechanism, a housing, a plurality of connectors, a draglink, a link assembly comprising a plurality of links, and a plurality of connecting means for attaching said housing to said connector; and h) a keeper member;

wherein said draglink connects said plurality of links to said housing and allows said plurality of connectors to move in an equal and directionally equivalent motion.

2. The multipoint latch system according to claim 1, wherein said plurality of notches on said translating rod member comprises at least one notch for acceptance of said pillow block, and at least one notch for acceptance of said rod guide.

3. The multipoint latch system according to claim 1, wherein said rod guide slidably mounts onto said rod member.

4. The multipoint latch system according to claim 1, wherein said keeper member comprises a bracket, a roller pin, and a roller, wherein said roller pin slidably mounts through a pair of pinholes and through said roller mounted therebetween.

5. The multipoint latch system according to claim 4, wherein said bracket comprises a locating boss, a bolthole, and a pair of flanges, wherein said flanges each comprise at least one pinhole.

6. The multipoint latch system according to said claim 4, wherein said keeper member is mounted on said second panel.

7. The multipoint latch system according to claim 1, wherein said pawl arm selectively engages said roller member of said keeper member.

8. The multipoint latch system according to claim 7, wherein said pawl arm further comprises a ramped portion, wherein said ramped portion engages said roller of said keeper member.

9. The multipoint latch system of claim 1, wherein said bezel mounts onto said housing, and wherein said bezel further comprises an elongated eyelet.

10. The multipoint latch system of claim 9, wherein said handle cover is configured to receive said handle, wherein said handle cover rotatably mounts onto said housing, and wherein said handle cover extends through said eyelet of said bezel.

11. The multipoint latch system of claim 1, wherein said handle is dimensioned in a U-shape, and comprises a pair of eyelets for engaging said links.

12. The multipoint latch system of claim 1, wherein said handle includes a pair of eyelets and said link assembly comprises said plurality of links rotatably mounted in the eyelets of said handle.

13. The multipoint latch system of claim 12, wherein said plurality of links comprises two links, each rotatably mounted to each other.

14. The multipoint latch system of claim 1, wherein said plurality of connectors comprises a plurality of connector slots for slidably mounting on said housing, and connector holes for receiving said plurality of links.

15. The multipoint latch system of claim 14, wherein said plurality of links rotatably mounts onto said plurality of connectors.

16. The multipoint latch system of claim 15, wherein said connectors comprise connector lugs, wherein said connector lugs mount on an external mechanism.

17. The multipoint latch system of claim 1, wherein said draglink comprises at least one extending arm, whereby said draglink is rotatably mounted on said housing, whereby actuation of said handle causes said draglink to engage said link assembly, which causes said connectors to translate with equal motion in equal and directionally equivalent distance.

18. A multipoint latch system for securing a first panel to a second panel, said multipoint latch system comprising:

a) a translating rod member comprising a plurality of notches;

b) a rod guide comprising a plurality of cam slots;

c) a rotatable pawl member comprising a pawl arm and means for attaching said rotatable pawl member onto said rod guide; wherein said pawl member further comprises a pivot member;

d) a pillow block comprising means for mounting said pillow block to said translating rod member; wherein said pillow block further comprises slots for accepting said pivot member;

e) connecting means for attaching said rod guide to said rod member;

f) means for actuating said latch from an open to a closed position; wherein said means for actuating said latch from an open to a closed position comprises an actuator further comprising a bezel, a handle, a handle cover, a lock mechanism, a housing, a plurality of connectors, a draglink, a link assembly comprising a plurality of links, and a plurality of connecting means for attaching said housing to said connector; and g) a keeper member;

wherein said draglink connects said plurality of links to said housing and allows said plurality of connectors to move in an equal and directionally equivalent motion.

19. A multipoint latch system for securing a first panel to a second panel, said multipoint latch system comprising:

a) a translating rod member comprising a plurality of notches;

b) a rod guide comprising a plurality of cam slots;

c) a rotatable pawl member comprising a pawl arm and means for attaching said rotatable pawl member onto said rod guide; wherein said pawl member further comprises a pivot member;

d) a pawl connecting arm comprising slots for accepting said pivot member;

e) connecting means for attaching said rod guide to said rod member;

f) means for actuating said latch from an open to a closed position; wherein said means for actuating said latch from an open to a closed position comprises an actuator further comprising a handle, a housing, a plurality of connectors, a draglink, a link assembly comprising a plurality of links, and a plurality of connecting means for attaching said housing to said connector; and g) a keeper member;

wherein said draglink connects said plurality of links to said housing and allows said plurality of connectors to move in an equal and directionally equivalent motion.

20. An actuator for opening and closing a multipoint latch system, wherein said actuator comprises: a plurality of linking members, means for connecting said plurality of linking members to one another; a connecting member, wherein said connecting member allows for pivotal movement of said plurality of linking members; means for connecting said actuator to a frame, wherein said means for connecting said actuator to a frame comprises a plurality of rods, wherein said rods comprise a plurality of slots further comprising a plurality of components; mounting means for maintaining sliding movement of said plurality of rods; a plurality of spring members; and a plurality of cam pins.

21. The actuator of claim 20, wherein said actuator further comprises a rod guide.

22. The actuator of claim 20, wherein said actuator further comprises means for actuating said actuator, wherein said means for actuating said actuator comprises a button.

23. The actuator of claim 21, wherein said rod guide comprises a plurality of rod elements, further comprising a plurality of slots.

24. The actuator of claim 23, wherein at least one of said rod elements further comprises a spring engaging member.

25. The actuator of claim 23, wherein a plurality of cam pins engage said plurality of slots.

26. The actuator of claim 22, wherein said button further comprises an actuation portion, and a plurality of engaging elements.

27. A multipoint latch system for securing a first panel to a second panel, said multipoint latch system comprising:

a) a translating rod member comprising a plurality of notches;

b) a rod guide comprising a plurality of cam slots;

c) a rotatable pawl member comprising a pawl arm and means for attaching said rotatable pawl member onto said rod guide; wherein said pawl member further comprises a pivot member;

d) a pawl connecting arm comprising slots for accepting said pivot member;

e) connecting means for attaching said rod guide to said rod member; and f) means for actuating said latch from an open to a closed position; wherein said means for actuating said latch from an open to a closed position comprises an actuator further comprising a handle, a housing, a plurality of connectors, a draglink, a link assembly comprising a plurality of links, and a plurality of connecting means for attaching said housing to said connector;

wherein said draglink connects said plurality of links to said housing and allows said plurality of connectors to move in an equal and directionally equivalent motion.

* * * * *